United States Patent [19]

Holcomb

[11] 4,098,057

[45] Jul. 4, 1978

[54] ICE CREAM SANDWICH WRAPPING MACHINE

[75] Inventor: Gregory W. Holcomb, Yorba Linda, Calif.

[73] Assignee: Interbake Foods Inc., Richmond, Va.

[21] Appl. No.: 722,323

[22] Filed: Sep. 10, 1976

[51] Int. Cl.[2] ..... B65B 11/06; B65B 49/00; B65B 51/32

[52] U.S. Cl. ..... 53/230; 53/33; 53/375; 53/379

[58] Field of Search ..... 53/33, 228, 230, 231, 53/375, 379, 388, 180, 182; 99/450.4, 450.7

[56] References Cited

U.S. PATENT DOCUMENTS

| | | | |
|---|---|---|---|
| 2,794,404 | 6/1957 | Rapp | 99/450.4 |
| 2,875,708 | 3/1959 | Hensgen | 99/450.4 |
| 2,993,453 | 7/1961 | Fay | 99/450.7 |
| 3,006,119 | 10/1961 | Fingerhut | 53/230 |
| 3,110,143 | 11/1963 | Schooler | 53/230 |
| 3,114,226 | 12/1963 | Taggart et al. | 53/388 |
| 3,343,334 | 9/1967 | Bode et al. | 53/198 R |
| 3,383,832 | 5/1968 | Grant et al. | 53/230 |
| 3,600,875 | 8/1971 | Como | 53/230 |
| 3,763,629 | 10/1973 | Carlstrom et al. | 53/379 |
| 3,828,660 | 8/1974 | Mueller | 99/450.4 |
| 3,834,119 | 9/1974 | Armitt | 53/230 |
| 3,855,758 | 12/1974 | Walter et al. | 53/230 |

*Primary Examiner*—Othell M. Simpson
*Attorney, Agent, or Firm*—Charles B. Cannon

[57] ABSTRACT

An ice cream sandwich with a wrapper sheet thereon is raised by an elevator to the level of a horizontal trackway during which side and bottom panels of the wrapper sheet are downfolded along the sides of the sandwich. A horizontally slidable and reciprocable pusher and folding device pushes the sandwich and wrapper sheet off the elevator device onto and along the trackway. During this operation folding devices in the form of combination vertically extending elevator guide members and folding devices which form parts of the pusher and folding device coact to infold the bottom panels of the wrapper sheet under the bottom surface of the sandwich. As the sandwich is moved over the horizontal trackway folding devices embodied in the pusher and folding device act to infold the trailing end panels of the wrapper sheet against the end walls of the sandwich; folding devices embodied in the pusher and folding device cooperate with stationary folding devices on the trackway to infold the leading end panels of the wrapper sheet against the end walls of the sandwich; stationary folding devices on the trackway upfold the bottom end-sealing panels of the wrapper sheet over the end panels and downfold the top end-sealing panels against the bottom end-sealing panels. The thus folded top and bottom end-sealing panels are then heat-sealed together following which the sandwich is moved through a cooling device to the delivery or discharge end of the trackway.

51 Claims, 44 Drawing Figures

73
74
76
78
62
83
77
75
79
30
51
53
61
52
71
57
56
47
102
104
106
105
103
107
201
187
108
111
110
109
112
49

57
56
57
61
37
37
37
37
51
52
53
36
37
178
165
197
45
46
38
38
38
38
38
38
38
38
111
108
167
109
172
171
55
45
43
46
116
160
158
159
54
113
114
49
119
11
11
117
118

212
212
35
36
38
37
41
45
46

36
39
35
38
41
37
42
212
212
40

35
36
37
199
45
46
119
118
117

37
38
39
36
58
59
43
46
45
44
199
202
203
206

ICE CREAM SANDWICH WRAPPING MACHINE

BACKGROUND OF THE INVENTION

Various types of ice cream sandwich wrapping machines have been known and used heretofore in the art.

However, most of the prior art ice cream sandwich wrapping machines heretofore used have been relatively complicated and expensive in construction and relatively slow in operation, and have required the use of relatively large quantities of wrapping material, due in a substantial part, to the fact that in certain of such prior art machines the wrapping and folding operations have been performed while the ice cream sandwiches are moved along a horizontal trackway through various folding devices and through a heat-sealing device and to the delivery end of the wrapping machine by means of a horizontally moving endless conveyor or most of the folding operations have been performed while the ice cream sandwich is being moved vertically upwardly through a relatively long stroke of the elevator device. Moreover, such prior ice cream sandwich wrapping machines have customarily sealed the wrapper around the ice cream sandwich along the bottom panels thereof and it has not been considered possible heretofore to seal the wrapped ice cream sandwich at the end panels thereof, as is done in the practice of the present invention.

OBJECTS

An object of the present invention is to provide a new and improved ice cream sandwich wrapping machine which is capable of continuous high speed operation and production and is capable of wrapping and heat-sealing the ice cream sandwiches at the top and bottom end-sealing panels thereof, and at a higher rate of speed and production than has been possible heretofore in the use of the prior ice cream wrapping machines.

An additional object of the invention is to provide a new and improved ice cream sandwich wrapping machine which effects a distinct economy, in the order of 15 percent, in the amount of wrapping material which is required to wrap each individual ice cream sandwich.

A further object of the invention is to provide a new and improved high speed wrapping machine for wrapping ice cream sandwiches which embodies a novel construction and combination of folding devices for sequentially performing the various folding operations on the wrapper sheet.

Another object of the invention is to provide in the new wrapping machine a novel combination and arrangement of a vertically and reciprocably movable elevator device including an elevator head which sequentially elevates the ice cream sandwiches with their wrapper sheets thereon up to the level of a horizontal trackway, and first folding means in the form of combination vertically extending elevator guide members and folding devices which cooperate with the head of the elevator device to downfold the side and bottom panels of the wrapper sheet along the sides of the ice cream sandwich as the ice cream sandwich is elevated by the head of the elevator device up to the level of the horizontal trackway.

Another object of the invention is to provide in the new ice cream sandwich wrapping machine a novel combination ice cream sandwich pusher and folding device which is arranged adjacent the elevator device and adjacent the input end of a horizontal trackway and which pushes the ice cream sandwich with its wrapper sheet thereon off the head of the elevator device and along the horizontal trackway through successive folding operations in which the panels of the wrapper sheet on the ice cream sandwich are folded into their proper positions as the ice cream sandwich is moved along the horizontal trackway by the combination pusher and folding device.

An additional object of the invention is to provide in the new wrapping machine a novel combination pusher and folding device which is slidably and reciprocably mounted adjacent the elevator device and adjacent the input end of the horizontal trackway and which cooperates with the head of the elevator device and with one of the parallel combination elevator guide and folding members to provide second folding means which infolds the bottom panels under the bottom surface of the ice cream sandwich as the ice cream sandwich is slidably moved off the head of the elevator device onto the horizontal trackway by the combination pusher and folding device.

An additional object of the invention is to provide in the new wrapping machine a novel combination pusher and folding device which embodies first novel end panel folding shoe members which provide the third folding means embodied in the new wrapping machine for infolding the first or trailing end panels of the wrapper sheet over the end walls of the ice cream sandwich as the ice cream sandwich with its wrapper sheet thereon is slidably moved by the combination pusher and folding device off the head of the elevator device onto the upper surface of the horizontal trackway.

Still another object of the invention is to provide in the new wrapping machine a novel combination pusher and folding device which embodies second novel folding shoe members which cooperate with the novel stationary folding shoe members mounted on the horizontal trackway to provide the fourth folding means embodied in the new wrapping machine and which infold the second and leading end panels against the end walls of the ice cream sandwich as the ice cream sandwich is moved along the horizontal trackway by the combination pusher and folding device.

An additional object of the invention is to provide in the new wrapping machine novel fifth folding means mounted on the horizontal trackway for infolding the bottom end-sealing panels against the end panels as the ice cream sandwich is slidably moved along the horizontal trackway by the combination pusher and folding device and a horizontal row of ice cream sandwiches which are arranged between the combination pusher and folding device and the leading ice cream sandwich on the horizontal trackway.

Another object of the invention is to provide in the new wrapping machine novel sixth folding means stationarily mounted on the horizontal trackway between the fifth folding means and the heat-sealing devices for downfolding the top end-sealing panels against the bottom end-sealing panels as the ice cream sandwich is slidably moved along the horizontal trackway by the combination pusher and folding device and the horizontal row of ice cream sandwiches disposed behind the leading ice cream sandwich and the combination pusher and folding device.

A further object of the invention is to provide in the new wrapping machine novel heat-sealing devices which are mounted on the horizontal trackway between the sixth folding means and the delivery end of the trackway for heat-sealing the top and bottom end-sealing panels together and which heat-sealing devices embody a novel construction for forcing the top and bottom end-sealing panels together and into intimate heat-sealing contact with each other as each successive ice cream sandwich is moved through the heat-sealing devices by the combination pusher and folding device and the horizontal row of ice cream sandwiches between the combination pusher and folding device and the leading ice cream sandwich on the horizontal trackway.

A further object of the invention is to provide therein novel cooling devices for cooling the heat-sealed top and bottom end-sealing panels after the heat-sealing operation.

Still another object of the present invention is to provide therein novel back-up strip pressure members arranged along the side marginal edges of the horizontal trackway inwardly of the heat-sealing devices and inwardly of the cooling devices and which are engaged by the wrapped ice cream sandwiches as they are moved along the horizontal trackway for urging the top and bottom end-sealing panels into close and intimate heat-sealing engagement with the heat-sealing devices to effect a more effecient and better heat-seal between the top and bottom end-sealing panels than could otherwise be possible, and thereafter urging the top and bottom heat-sealed end-sealing panels into intimate cooling contact with the cooling devices.

An additional object of the invention is to provide a new and improved wrapping machine for wrapping ice cream sandwiches which has the following desirable characteristics and accomplishes the following advantages: (1) effects a distinct economy in the amount of wrapping material required to wrap the ice cream sandwich as compared to prior ice cream sandwich wrapping machines; (2) has a higher rate of production than has been possible heretofore; (3) operates with less noise and in a more quiet operation than prior ice cream sandwich wrapping machines; (4) has fewer moving parts than prior ice cream sandwich wrapping machines; (5) operates with less breakage of the wafers in the ice cream sandwich than prior ice cream sandwich wrapping machines; (6) has lower maintenance costs than prior ice cream sandwich wrapping machines; (7) employs no tucker or tucker devices; and (8) wraps and heat-seals the wrapper on the ice cream sandwich at the ends thereof rather than along the bottom of the ice cream sandwich which has not been considered possible heretofore in the art due to the relatively soft character of the ice cream body in the ice cream sandwich. Thus, it has not been considered possible heretofore in the art to apply sufficient pressure on the end panels of the wrapper to effect the desired heat-seal at the ends of the ice cream sandwich as distinguished from heat-sealing the bottom panels of the ice cream sandwich wrapper as has been customary heretofore in the art.

A further object of the invention is to provide a new and improved ice cream sandwich wrapping machine which is relatively simple in construction and operation and embodies fewer moving parts than are embodied in comparable prior ice cream sandwich wrapping machines.

Other objects will appear hereinafter.

DESCRIPTION OF FIGURES IN THE DRAWINGS

Figures 3, 3A:
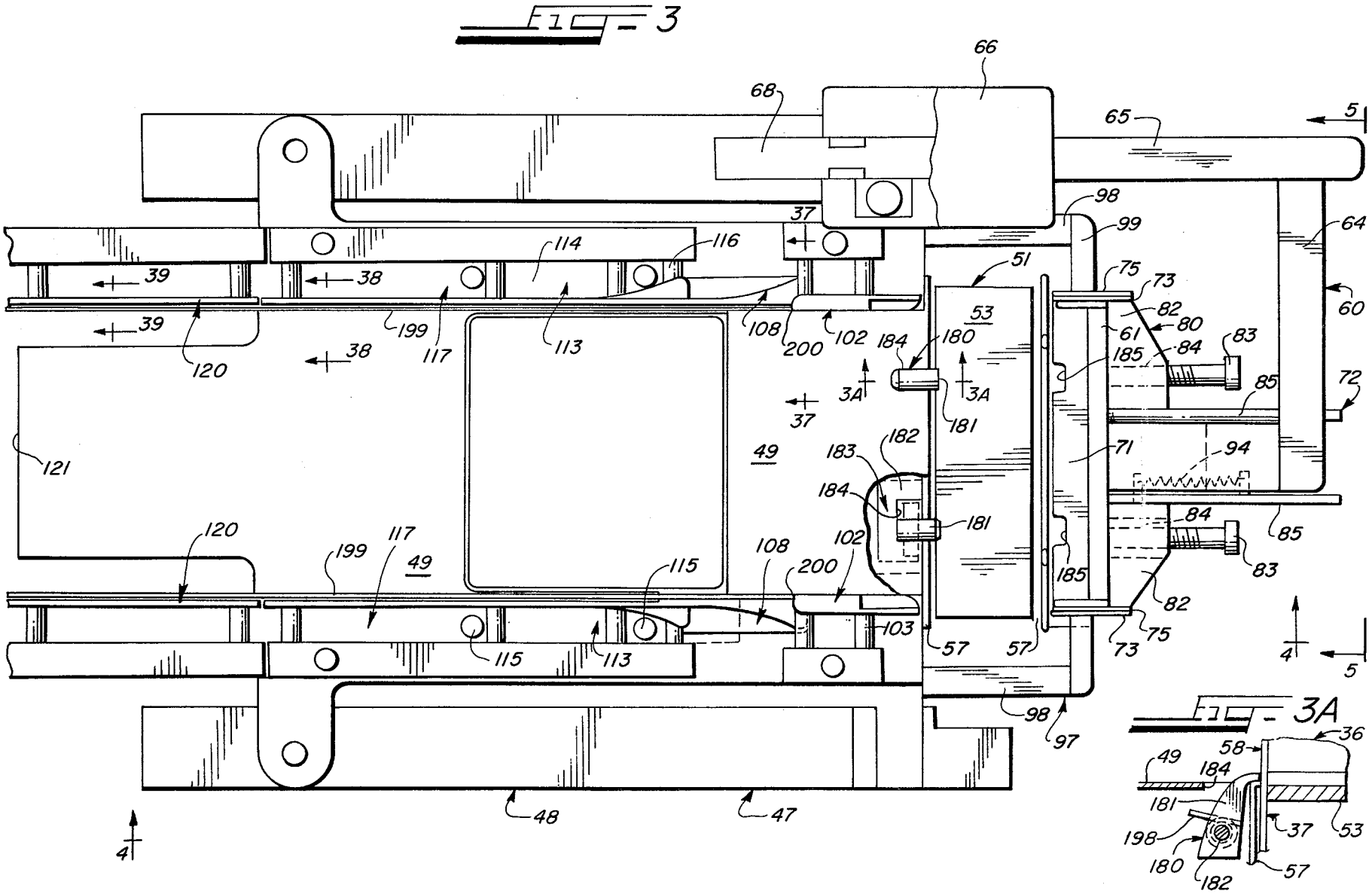
FIG. 3 is a top plan view of the new wrapping machine.
FIG. 3A is a fragmentary sectional detail view on line 3A—3A in FIG. 3.
Figure 10:
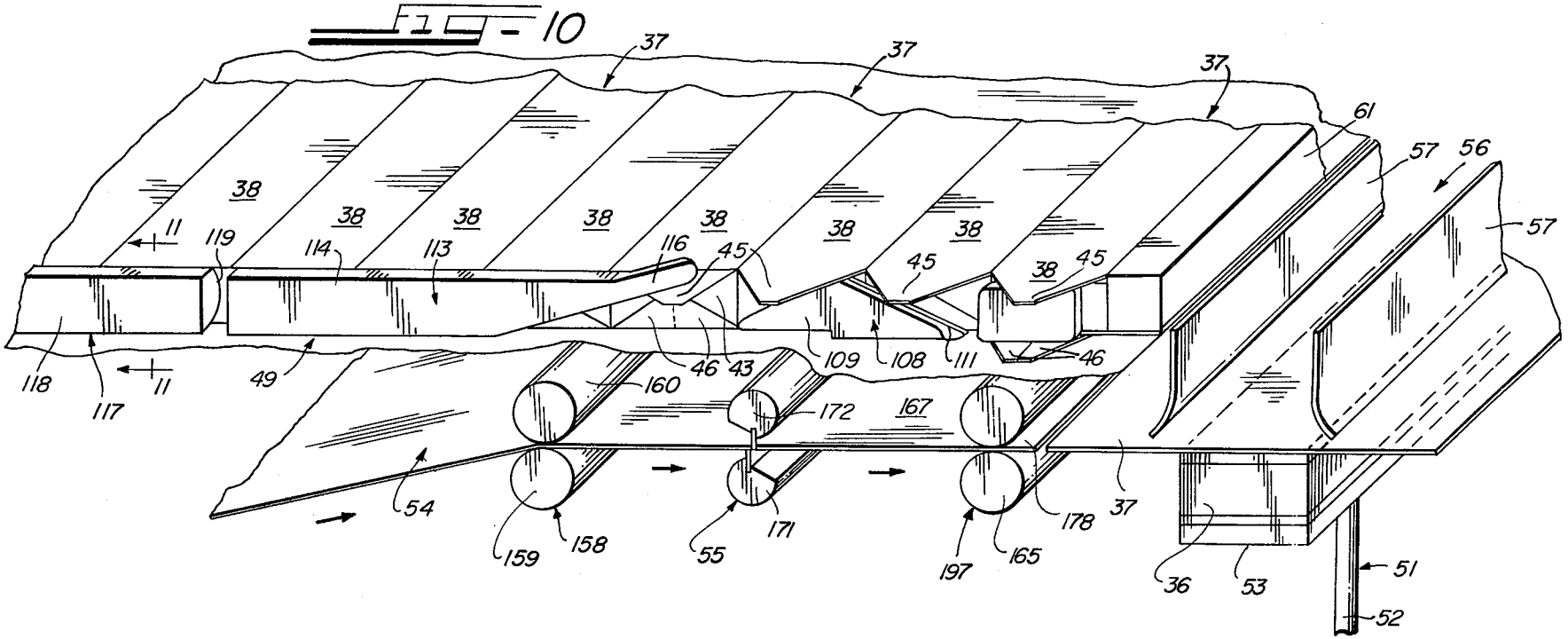
Figure 13:
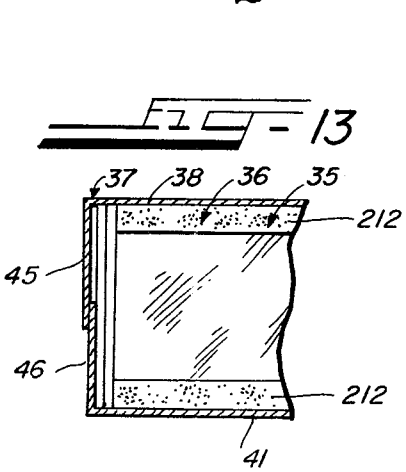
Figure 12:
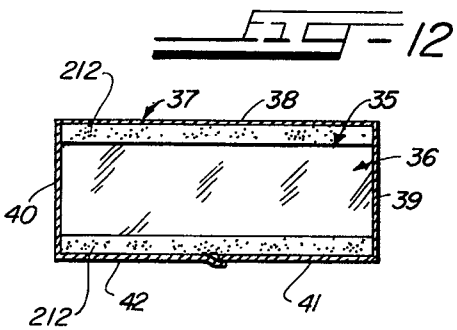
Figure 11:
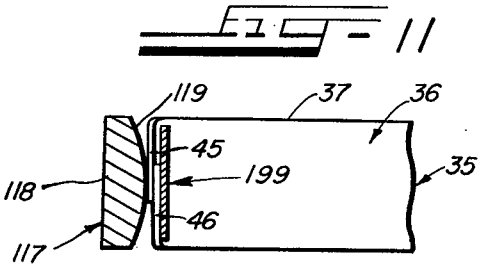
Figures 14, 14A, 15, 16:
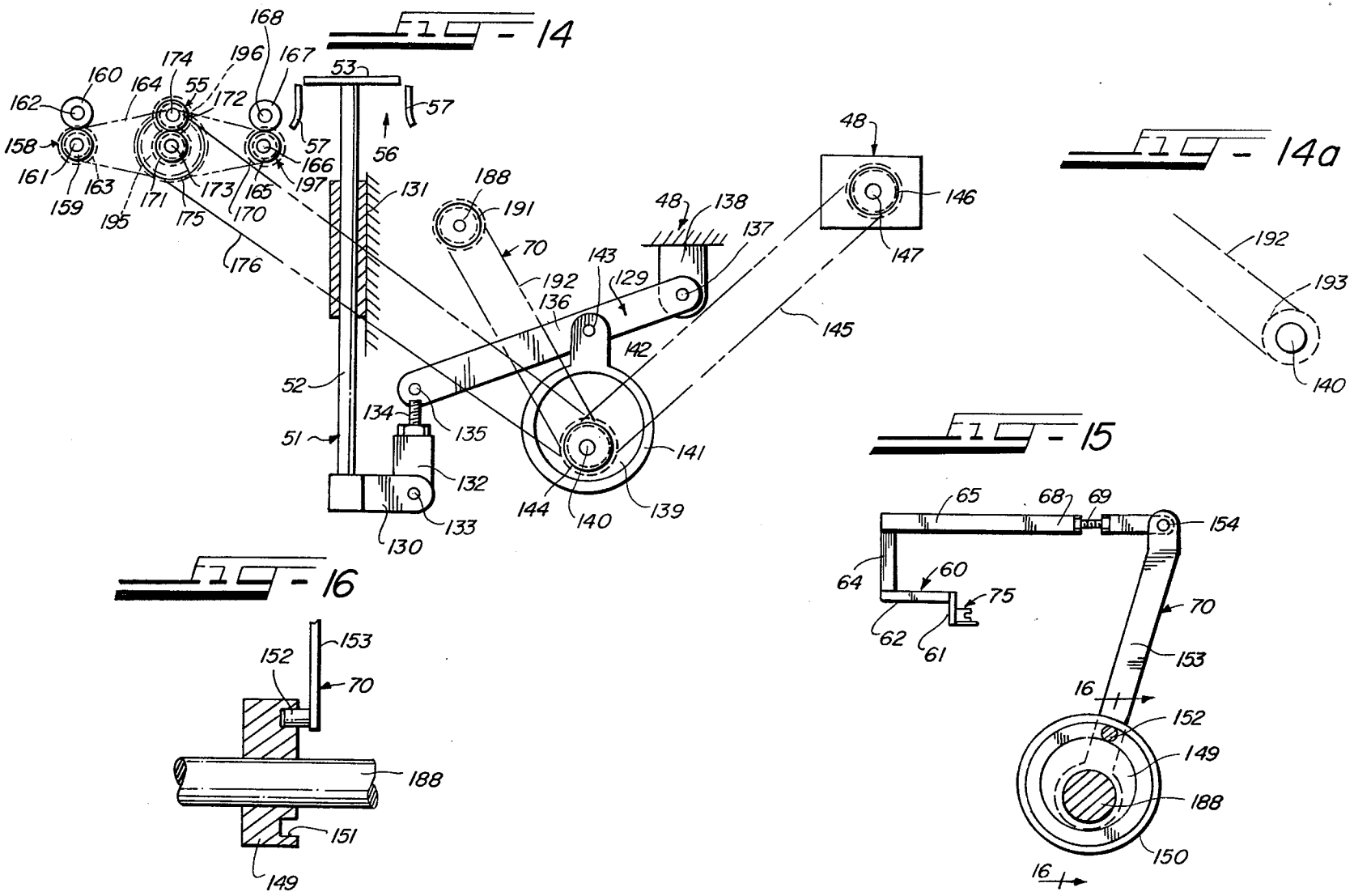
Figure 17:
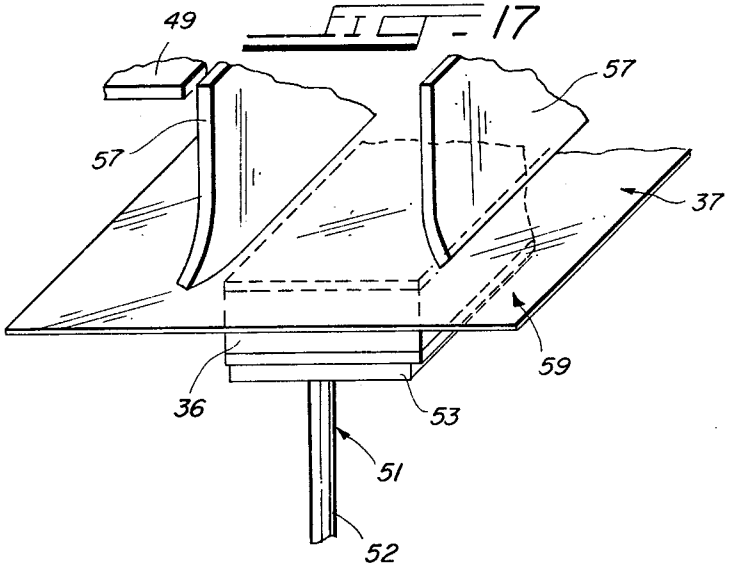
Figure 18:
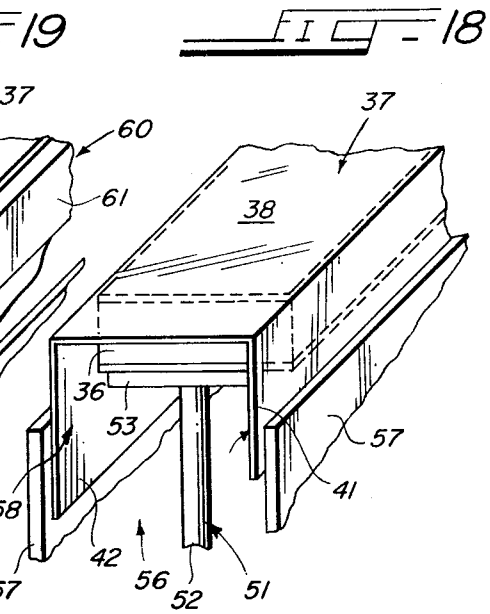
Figure 19:
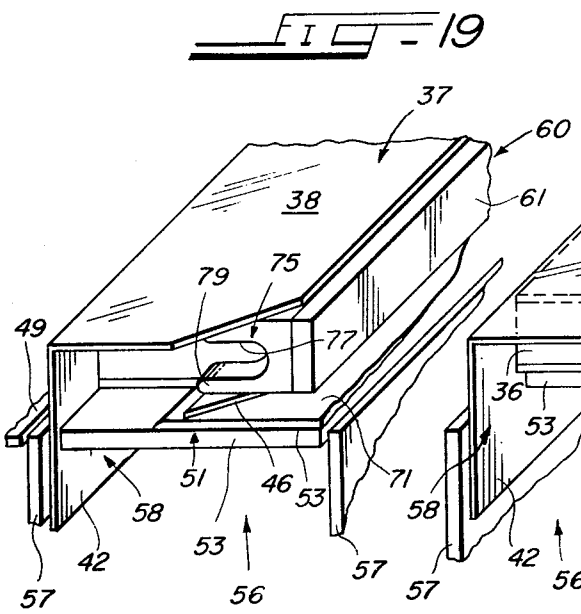
Figure 20:
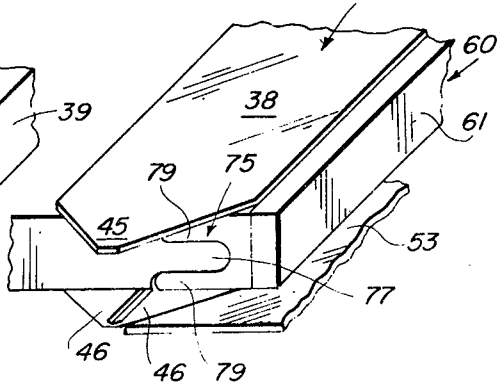
Figure 21:
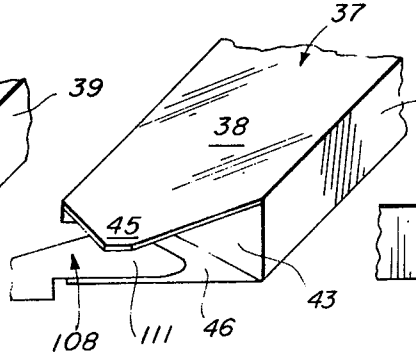
Figure 22:
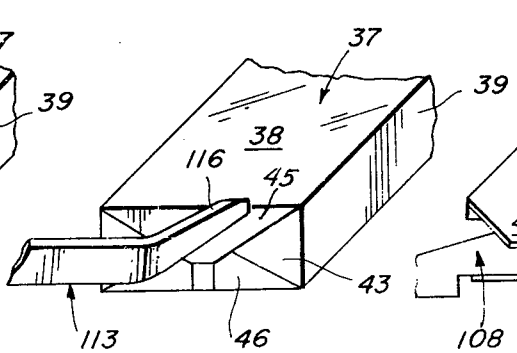
Figure 23:
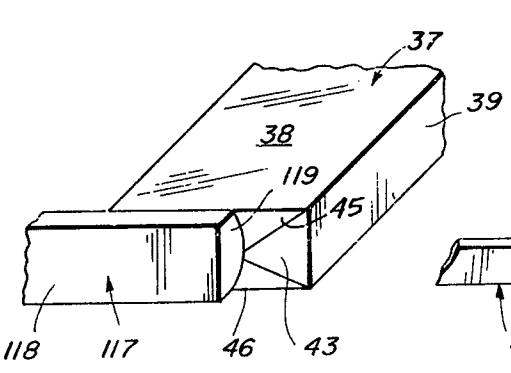
Figures 24, 25, 26, 27, 28, 29:
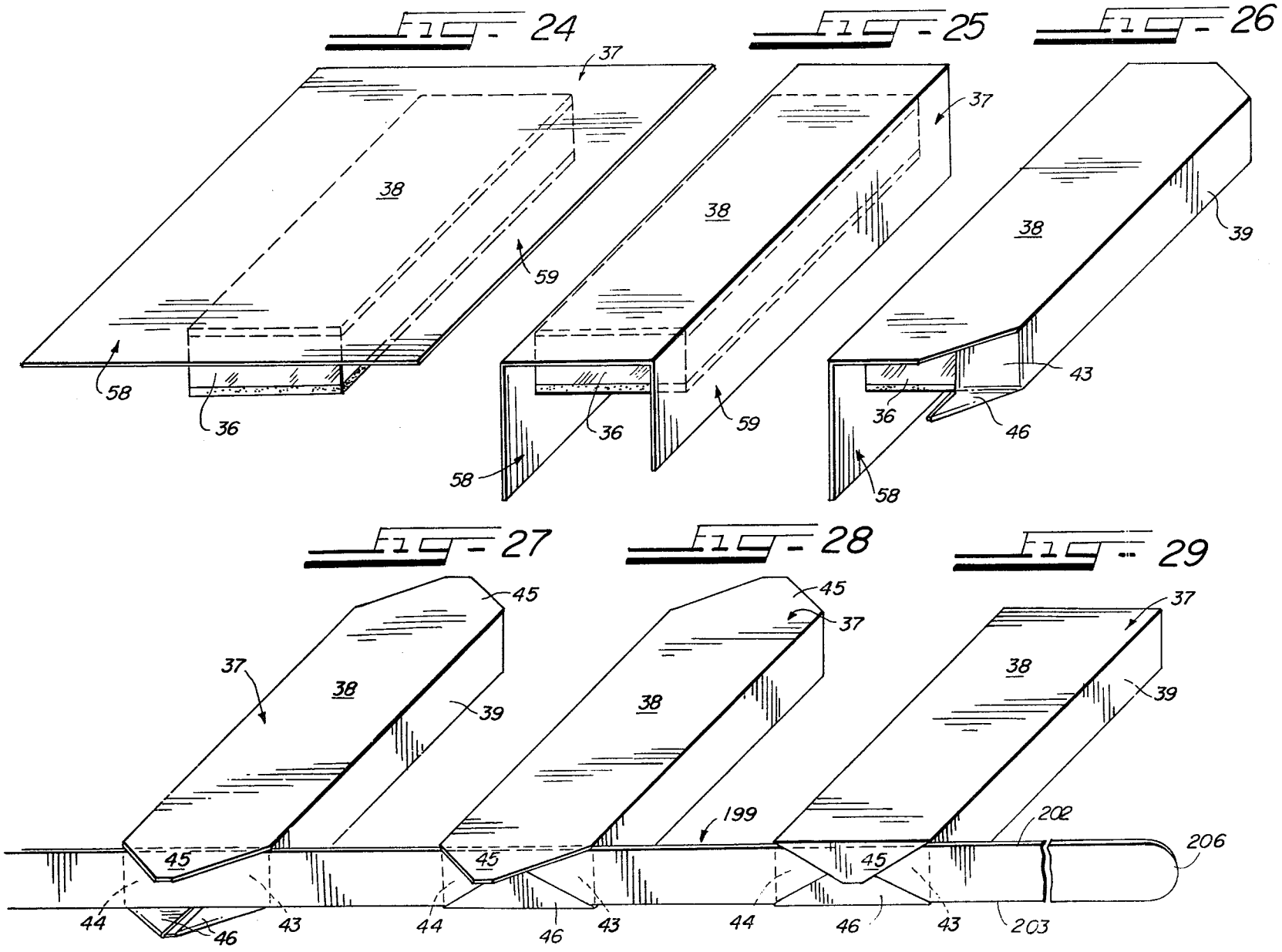
Figure 31:
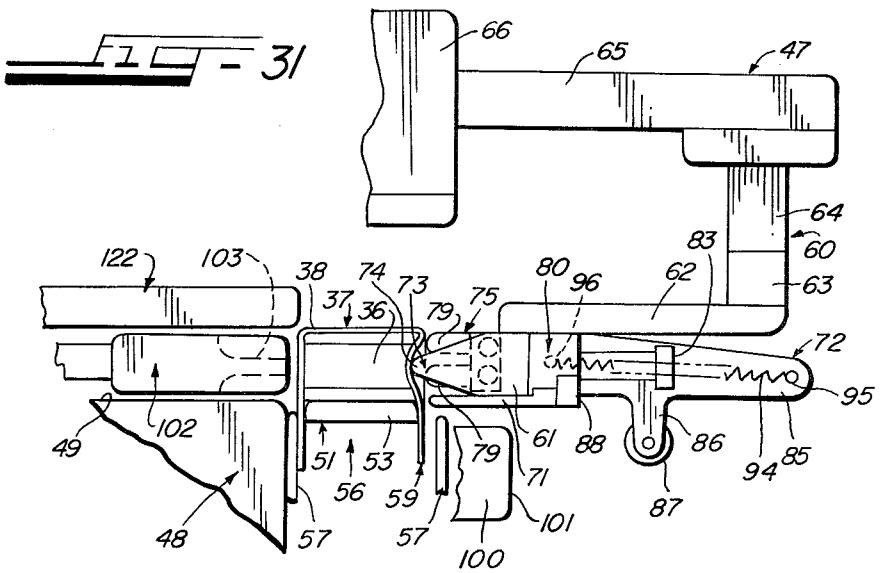
Figure 33:
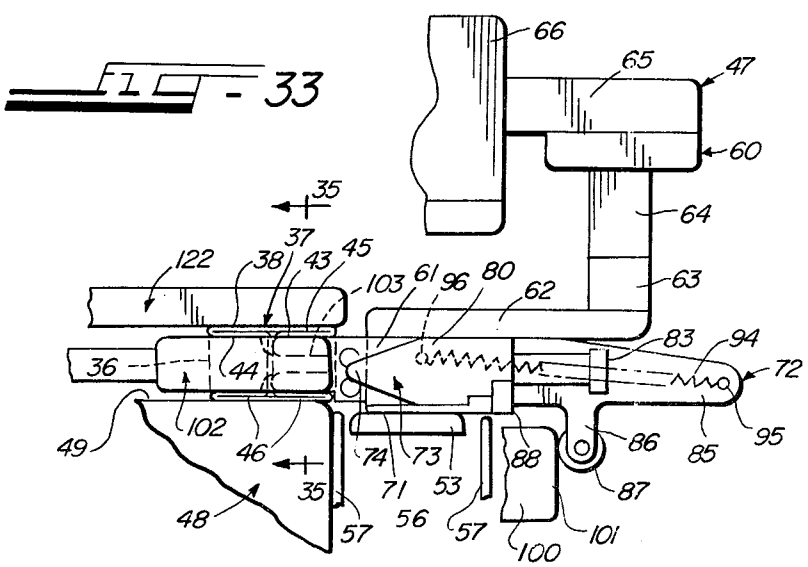
Figure 30:
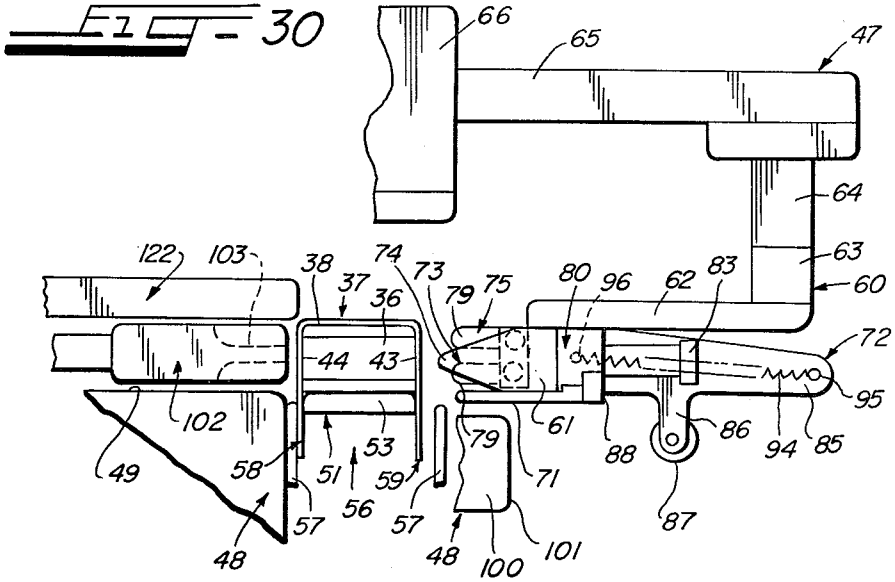
Figure 32:
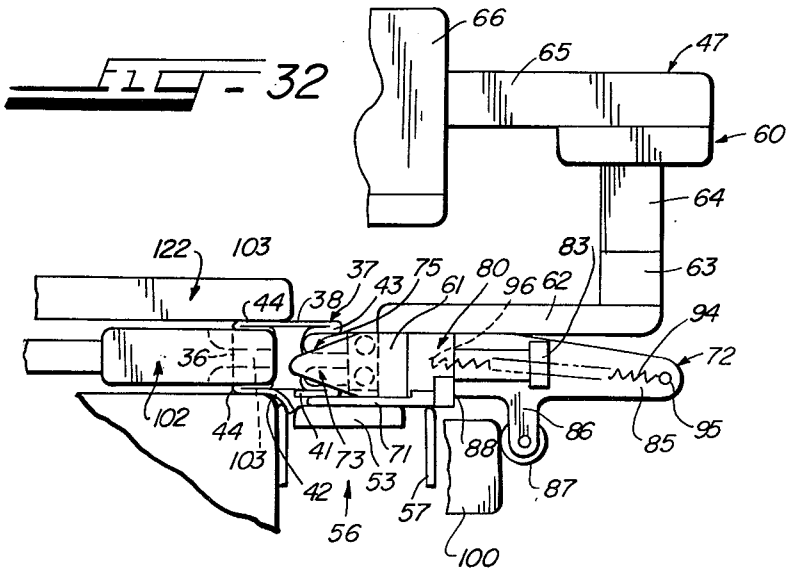
Figure 34:
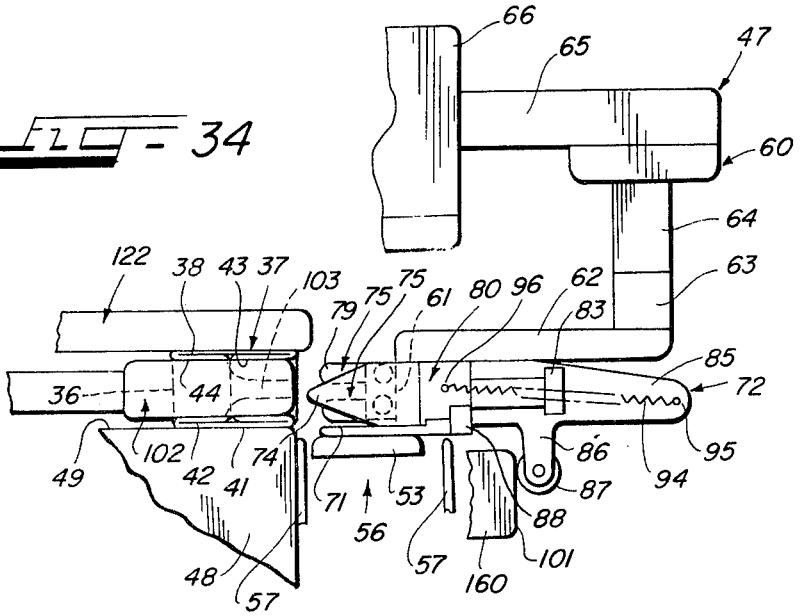
Figure 35:
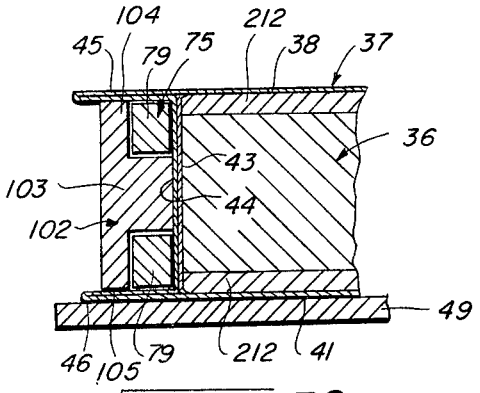
Figure 36:
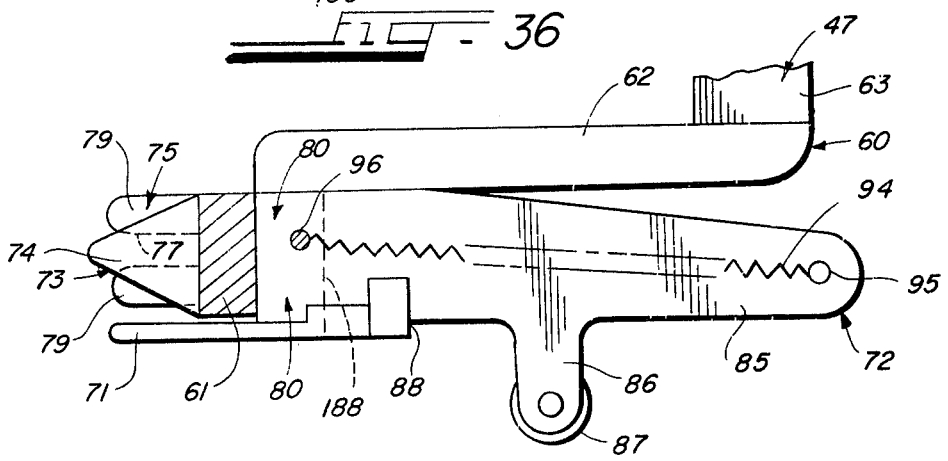
Figure 37:
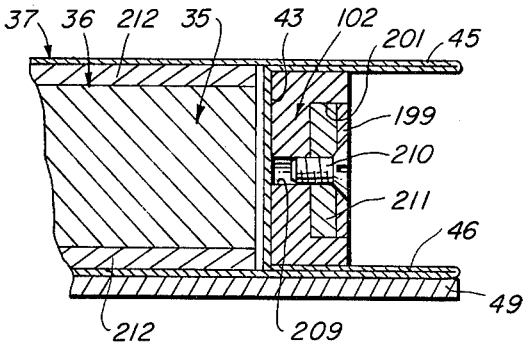
Figure 38:
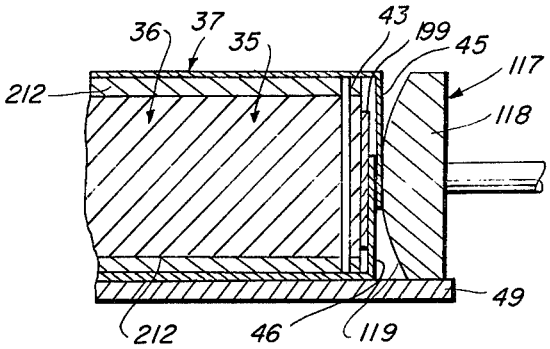
Figure 39:
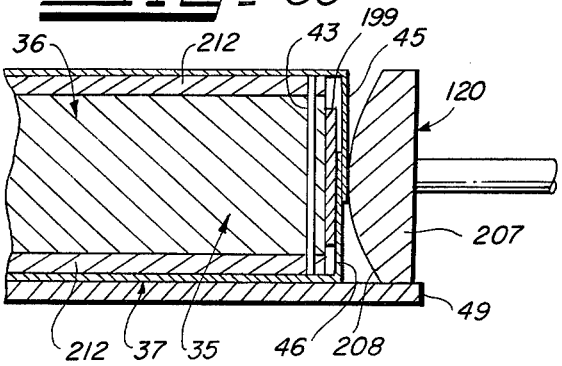
Figure 41:
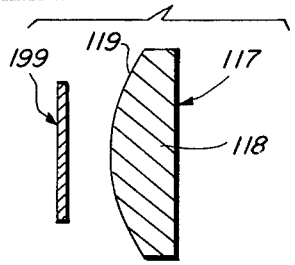
Figure 40:
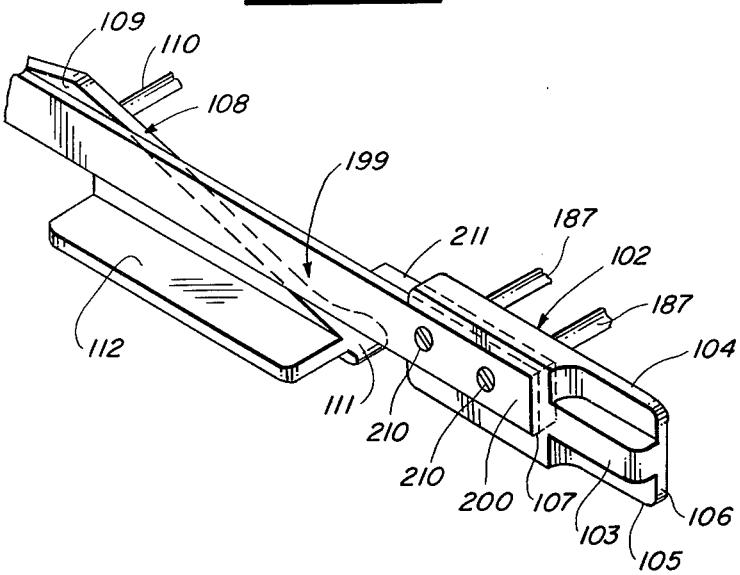

FIG. 10 is a fragmentary perspective view illustrating part of the horizontal trackway; the elevator device; parts of the folding devices on the horizontal trackway; the heat-sealing devices; and the wrapper web-advancing device and web-severing device which are arranged below the horizontal trackway; and illustrating a horizontal row of the ice cream sandwiches being slidably moved along the horizontal trackway and through the folding and heat-sealing devices thereon;

FIG. 11 is a fragmentary sectional view, on line 11—11 in FIG. 10, illustrating the construction of one of the novel heat-sealing devices embodied in the invention;

FIG. 12 is a fragmentary transverse vertical sectional view of the ice cream sandwich and its wrapper and illustrating the overlapping bottom panels of the wrapper sheet on the ice cream sandwich;

FIG. 13 is a fragmentary vertical sectional view illustrating part of the ice cream sandwich and parts of the wrapper sheet thereon;

FIG. 14 is an elevational view, partly in section, and partly schematic, illustrating the operating mechanisms for the elevator device, the slidable and reciprocating combination pusher and folding device, and for the web-advancing and web-cutting devices;

FIG. 14A is a diagrammatic view of part of the operating mechanism for the combination pusher and folding device as shown in FIGS. 14, 15 and 16;

FIG. 15 is a side elevational view, partly in section, illustrating the operating mechanism for the slidable and reciprocating combination pusher and folding device embodied in the new wrapping machine;

FIG. 16 is a fragmentary sectional device view on line 16—16 in FIG. 15;

FIG. 17 is a fragmentary perspective view of the elevator device and of the elevator head embodied therein and the vertically extending elevator guideway and the vertically extending combination elevator side wall and guide and folding members which form the first folding means embodied in the new wrapping machine for downfolding the side panels of the wrapper along the sides of the ice cream sandwich as the ice cream sandwich with its wrapper sheet thereon is moved on the head of the elevator from its lower and initial position, below the horizontal trackway, as in FIG. 17, up to the level of the horizontal trackway;

FIG. 18 is a fragmentary persepective view of the parts shown in FIG. 17, but showing the head of the elevator device and the ice cream sandwich with its wrapper sheet thereon in elevated position and showing the side panels of the ice cream sandwich wrapper sheet downfolded by the vertically extending combination elevator side wall and guide and folding members;

FIG. 19 is a fragmentary perspective view illustrating the ice cream sandwich with its wrapper sheet thereon being slidably pushed off the head of the elevator device and onto the horizontal trackway by the combination pusher and folding device and illustrating how the combination pusher and folding device cooperates with the head of the elevator device and with one of the combination elevator side wall guide and folding members to form the second folding means embodied in the new wrapping machine for infolding the bottom panels under the bottom surface of the ice cream sandwich; and partially illustrating part of the third folding means embodied in the new wrapping machine for infolding the first or trailing end panels of the wrapper sheet;

FIG. 20 is a fragmentary perspective view illustrating the ice cream sandwich and its wrapper sheet, further advanced from the position in which the parts are shown in FIG. 19, and with the bottom panels infolded under the bottom surface of the ice cream sandwich;

FIG. 21 is a fragmentary perspective view of the partially wrapped ice cream sandwich illustrated in FIG. 20 moved further along the horizontal trackway and illustrating the fifth folding means embodied in the new wrapping machine for infolding and upfolding the bottom end-sealing panels against the end panels of the wrapper sheet on the ice cream sandwich;

FIG. 22 is a fragmentary perspective view of the partially wrapped ice cream sandwich illustrated in FIG. 21 further moved along the horizontal trackway from the position in which it is shown in FIG. 21 and into engagement with the sixth and final folding means embodied in the invention for infolding and down-folding the top end-sealing panels against the bottom end-sealing panels of the wrapper sheet on the ice cream sandwich;

FIG. 23 is a fragmentary perspective view illustrating the fully wrapped ice cream sandwich, shown in FIG. 22, moved further along the horizontal trackway by the combination pusher and folding device from the position in which it is shown in FIG. 22 and into engagement with one of the heat-sealing devices for heat-sealing the top and bottom end-sealing panels together;

FIGS. 24 and 29, inclusive, are perspective views illustrating the sequence in which the various panels of the ice cream wrapper sheet are successively formed and folded over the body of the ice cream sandwich; Thus, FIG. 24 is a perspective view illustrating the wrapper sheet laid over the top or upper surface of the ice cream sandwich;

FIG. 25 is a perspective view illustrating the first folding operation in the use of the new wrapping machine in which the side and bottom panels of the wrapper sheet are downfolded along the sides of the ice cream sandwich;

FIG. 26 is a perspective view illustrating part of the second folding operation involved in the use of the new wrapping machine and in which the first bottom panel is infolded under the body of the ice cream sandwich and illustrating part of the third folding operation in which the first and trailing end panels are infolded against the end walls of the ice cream sandwich;

FIG. 27 is a perspective view illustrating the fourth folding operation involved in the use of the new wrapping machine in which the leading end panels are infolded against the end walls of the ice cream sandwich and on the outer side of the back-up strip pressure members;

FIG. 28 is a perspective view illustrating the fifth folding operation involved in the use of the new wrapping machine and illustrating the bottom end-sealing panels infolded and upfolded against the end panels on the ice cream sandwich and on the outer side of the back-up strip or member;

FIG. 29 is a perspective view illustrating the sixth and final folding operation involved in the use of the new wrapping machine and in which the top end-sealing panels are downfolded over the bottom end-sealing panels and on the outer side of the back-up strip pressure member to complete the wrapping and folding operation;

FIG. 30 is a fragmentary side elevational view illustrating the combination pusher and folding device embodied in the new wrapping machine, and the slidable and reciprocating carriage which is embodied in the combination pusher and folding device, in their initial positions;

FIG. 31 is a fragmentary side elevational view of the parts shown in FIG. 30 moved into their first folding position in the initial part of the forward stroke of the combination pusher and folding device and the slidable and reciprocating carriage and showing the combination pusher and folding device and the first folding shoe members carried by the pusher plate member which forms part of the slidable and reciprocating carriage engaging and partially infolding the trailing end panels of the ice cream sandwich wrapper sheet against the end walls of the ice cream sandwich;

FIG. 32 is a fragmentary side elevational view of the parts shown in FIGS. 30 and 31, but showing the combination pusher and folding device further advanced in its forward stroke and showing the slidable and reciprocating carriage which is embodied in the combination pusher and folding device moved to the end of its forward stroke with the trailing end panels of the wrapper sheet fully infolded by the coaction of the first movable folding shoe members on the pusher plate member and the second movable folding shoe members, which are mounted on the pusher head, and showing the leading end panels of the wrapper sheet partially infolded by the second and movable folding shoe members on the pusher head;

FIG. 33 is a fragmentary elevational view of the parts shown in FIGS. 30 to 32, inclusive, showing the slidable and reciprocating carriage in the position in which it is shown in FIG. 32, at the limit of its forward or inward stroke, but showing the pusher head further advanced with the second folding shoe members on the pusher head engaging and coacting with the first stationary folding shoe members on the horizontal trackway to infold the leading end panels against the end walls of the ice cream sandwich;

FIG. 34 is a fragmentary elevational view of the parts shown in FIGS. 30 to 33, inclusive, showing the trailing and leading end panels of the wrapper sheet fully infolded against the end walls of the ice cream sandwich and showing the slidable and reciprocating carriage in the position in which it it shown in FIG. 33 but showing the combination pusher and folding device and its pusher head at the inception of their rearward or return stroke;

FIG. 35 is an enlarged fragmentary sectional view on line 35—35 in FIG. 33, showing the coaction of the movable folding shoe members on the pusher head with the stationary folding shoe members on the horizontal trackway to infold the leading end panels against the end walls of the ice cream sandwich and showing the leading end panels fully infolded;

FIG. 36 is a fragmentary elevational view, partly in section, illustrating the slidable and reciprocating carriage and showing the pusher head engaging the slidable and reciprocating carriage to return the carriage and the pusher plate member and the folding shoe members thereon to their initial position, as in FIG. 30;

FIG. 37 is a transverse vertical sectional view on line 37—37 in FIG. 3 showing the mounting of one end portion of the back-up strip pressure members;

FIG. 38 is a transverse vertical sectional view on line 38—38 in FIG. 3 showing one of the back-up strip pressure members in relation to one of the adjacent heat-sealing devices and the end-sealing panels of the ice cream sandwich wrapper;

FIG. 39 is a transverse vertical sectional view on line 39—39 in FIG. 3 showing one of the back-up strip pressure members in relation to one of the adjacent cooling devices and the end-sealing panels of the ice cream sandwich wrapper;

FIG. 40 is a perspective view illustrating the mounting of the back-up strip pressure members and one of the stationary folding devices on the horizontal trackway; and FIG. 41 is an exploded vertical sectional view of one of the heat-sealing devices and the adjacent back-up strip pressure members.

THE ICE CREAM SANDWICH AND ITS WRAPPER (FIGS. 10, 11, 12, 13 AND 19 TO 23 AND 27 TO 29, BOTH INCLUSIVE, AND 37, 38 and 39

A typical wrapped and heat-sealed ice cream sandwich, as wrapped and heat-sealed in the use of the new ice cream sandwich wrapping machine, is generally indicated at 35 in the drawings (FIGS. 11, 12 and 13) and includes and ice cream sandwich body 36, which is arranged between cookies or wafers 212, and around which a wrapper sheet 37 of flexible coated heat-sealable wrapping material is arranged. As shown in FIGS. 10, 11, 12, 13, 20 to 23 and 27 to 29, inclusive, the wrapper sheet 37 includes a top panel 38, side panels 39 and 40, bottom panels 41 and 42, end panels 43 and 44, a top end-sealing panel 45 and a pair of bottom end-sealing panels 46, respectively. The new wrapping machine is concerned with the wrapping, folding and heat-sealing of the wrapper sheet 37 around the body 36 of the ice cream sandwich 35, and the cooling of the heat-sealed top and bottom end-sealing panels 45 and 46 thereof, respectively, after the heat-sealing operation, as will be described hereinafter.

GENERAL DESCRIPTION OF THE CONSTRUCTION AND OPERATION OF THE ICE CREAM SANDWICH WRAPPING MACHINE

THE HORIZONTAL TRACKWAY

A preferred and typical embodiment of the new ice cream sandwich wrapping machine is illustrated in the drawings, wherein it is generally indicated at 47, and includes a supporting frame 48 on which a generally horizontally extending trackway 49 is mounted and along which the ice cream sandwiches are sequentially moved through certain of the folding operations, the heat-sealing devices, and the cooling device, as will be described hereinafter.

Figure 1:
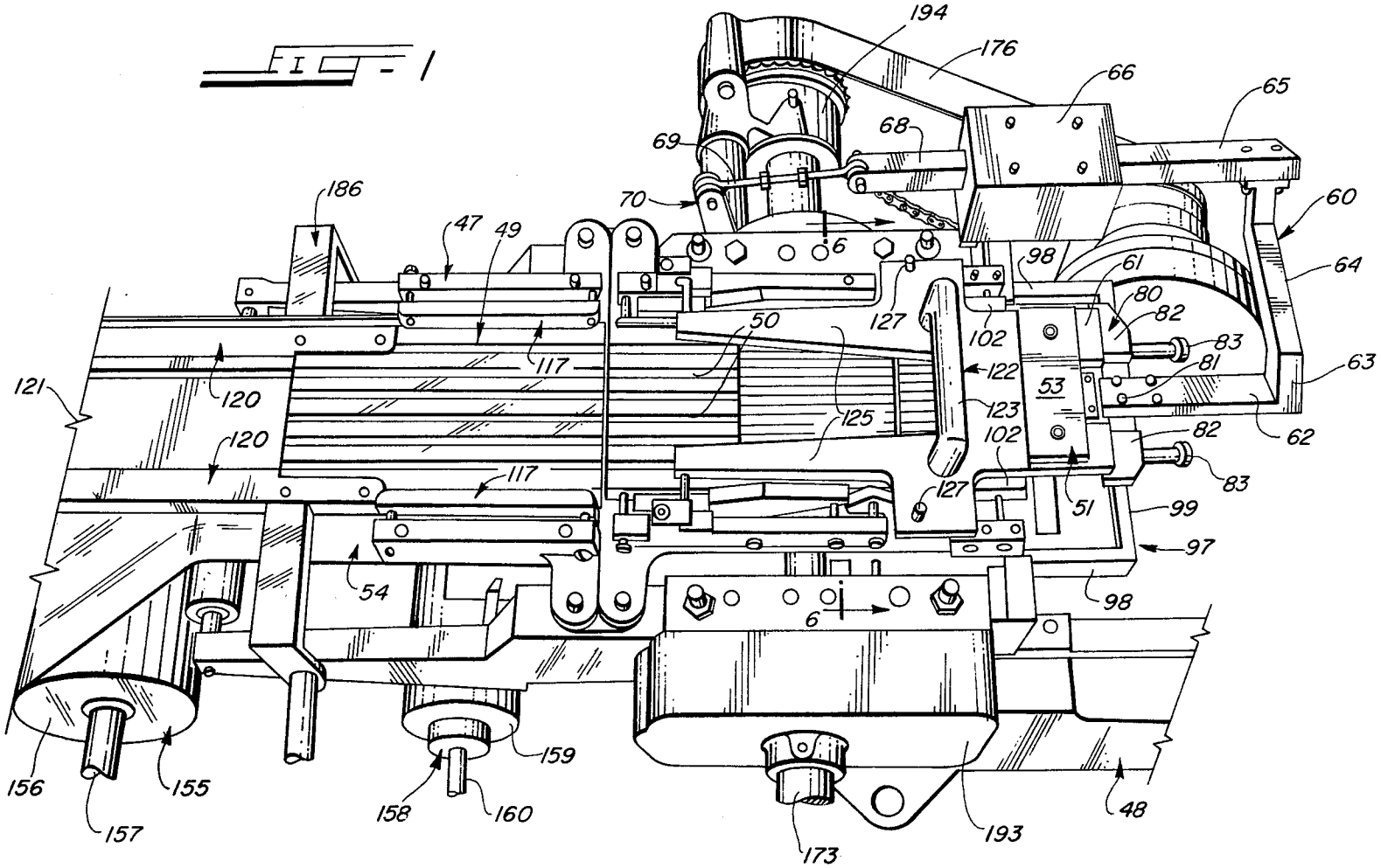
FIG. 1 is a top perspective view of the new ice cream sandwich wrapping machine, as seen from one side thereof.
Figure 2:
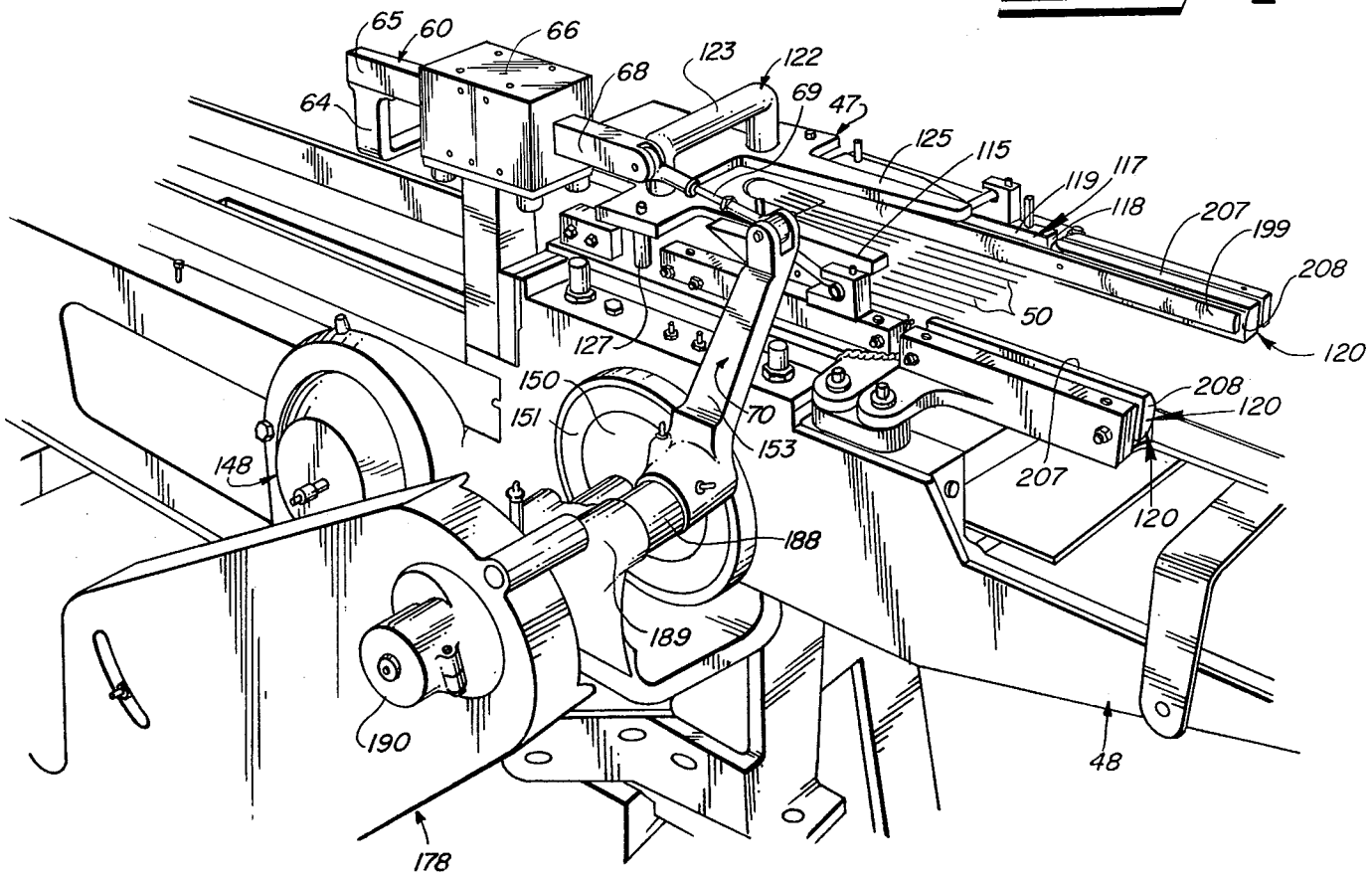
FIG. 2 is a top perspective view of the new wrapping machine as seen from the side opposite that shown in FIG. 1.
Figure 6:
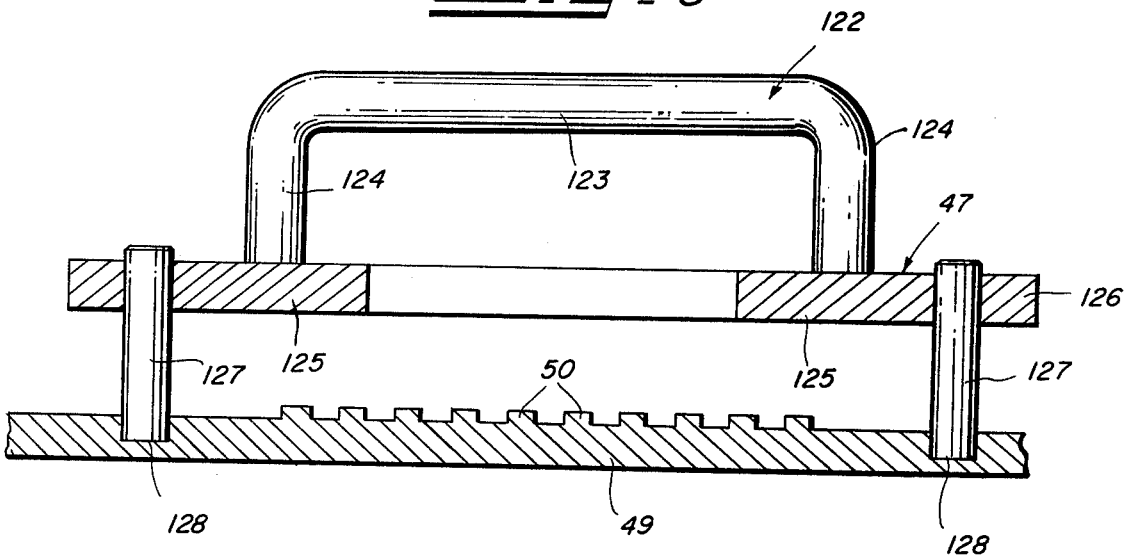
FIG. 6 is a vertical sectional view, partly in elevation, of an ice cream sandwich hold-down device which is embodied in the new wrapping machine.

As shown in FIGS. 1, 2 and 6 the upper surface of the horizontal trackway 49 has generally parallel ribs 50 formed on the upper surface thereof to reduce the friction on the ice cream sandwiches 36 as they are slidably moved thereover.

THE ELEVATOR DEVICE (FIGS. 1, 3, 4, 7, 10, 14 17, 18, 19 AND 30 TO 34, INCLUSIVE)

A vertically movable and reciprocating elevator device, which is generally indicated at 51, is movably mounted for vertical reciprocating movement at the input end of the horizontal trackway 49, and includes a vertically extending supporting shaft 52 on the upper end portion of which is mounted a generally flat elevator head 53. In the use of the new wrapping machine 47, the ice cream sandwiches 36 are deposited one at a time on the head 53 of the elevator device 51 when the head 53 of the elevator device 51 is in its lowermost position below the horizontal trackway 49. During the upward vertical stroke or movement of the elevator device 51 and its head 53 the ice cream sandwich 36 which is disposed on the head 53 of the elevator device 51, comes under and engages a web 54 of heat-sealable wrapping material and concurrently therewith the wrapper sheet section 37 of the wrapping material is severed from the body of the web 54 thereof by a web-severing or cutting device 55 (FIGS. 4 and 10), which will be described hereinafter, so that the wrapper sheet section 37 is thus disposed over the top of the ice cream sandwich 36 as it is moved on the head 53 of the elevator device 51 up to the level of the upper surface of the horizontal trackway 49.

THE FIRST FOLDING DEVICE AND OPERATION (FIGS. 10, 17, 18 AND 25)

The head 53 of the elevator device 52 is slidably and reciprocably movable through a vertically extending guideway 56 which includes a pair of horizontally spaced vertically extending combination guide plate members and first folding members 57 which are mounted on the supporting frame 48 at the input end of the trackway 49 (FIGS. 4, 7, 10, 14, 17, 18, 19 and 30 to 34, inclusive) and, as shown, each of the members 57 has an outwardly flared lower end portion, for a reason which will be pointed out hereinafter.

As the head 53 of the elevator device 51 moves upwardly through the vertically extending guideway 56, with the ice cream sandwich 36 thereon and with the severed wrapper sheet 37 disposed in a flat position over the upper or top surface of the ice cream sandwich 36, the outwardly extending portions of the wrapper sheet 37 engage the outwardly flared lower end portions of the vertically extending combination guide plate members and first folding members 57 as the ice cream sandwich 36 with its wrapper sheet 37 enters the elevator guideway 56 (FIGS. 10 and 17). During this operation the first folding operation involved in the use of the new wrapping machine takes place, that is, the two side and bottom forming panels 58 and 59 of the wrapper sheet 37 are downfolded along the sides of the body of the ice cream sandwich 36, as shown in FIG. 18, thereby completing the first folding operation in the cycle of folding operations which are involved in the use of the new wrapping machine 35 (FIGS. 18 and 25).

When the head 53 of the elevator device 51 with the ice cream sandwich 36 thereon, and with the two side and bottom forming panels 56 and 57 downfolded along the sides of the body of the ice cream sandwich 36, reaches the upper level or surface of the horizontal trackway 49, the ice cream sandwich 36 with its wrapper sheet 37 thereon is slidably pushed off the head 53 of the elevator device 51 onto and along the upper surface of the horizontal trackway 49 by a combination pusher and folding device and during this movement additional folding operations are performed on the wrapper sheet 37, as will be described hereinafter.

THE COMBINATION PUSHER AND FOLDING DEVICE (FIGS. 1, 2, 3, 4, 5, 7, 15, 19, 30 TO 34, INCLUSIVE, AND 36)

The new wrapping machine 47 includes a slidably mounted and horizontally reciprocating combination pusher and folding device, which is generally indicated at 60 and includes a horizontally disposed upright pusher head 61 (FIGS. 1, 2, 3, 4, 5, 7, 15, 17, 19, 20, 30 to 34, inclusive, and 36) which is arranged adjacent the elevator device 51 and the elevator head 53 at the input end of the horizontal trackway 49 and is slidably mounted for movement over and relative to a combination pusher and supporting plate member 71, which will be described hereinafter.

As shown in FIGS. 1 to 5, 7, 15 and 30 to 34, inclusive, and 36, the slidably mounted and reciprocating combination pusher and folding device 60 and its pusher head 61, and associated parts, are carried by and depend from a horizontally extending supporting arm 62 of a generally L-shaped supporting arm structure 62-63-64 which is attached to and depends from a main operating slide bar 65 which is slidably and reciprocably mounted in a guide housing 66 which is stationarily mounted, as at 67 (FIG. 4), on the supporting frame 48. The slidably mounted reciprocating operating slide bar 65 has an end portion 68 which is attached to a linkage 69 which forms part of an operating mechanism 70 for the slidable and reciprocating operating slide bar 65 and the combination pusher and folding device 60 and the pusher head 61 (FIGS. 14, 15 and 16), as will be described hereinafter.

The combination pusher and folding device 60 includes a horizontally extending pusher and folding shoe supporting plate member 71 which is disposed below the pusher head 61 and forms part of a slidable and reciprocating carriage 72 which is embodied in and forms part of the combination pusher and folding device 50 (FIGS. 3, 4, 7, 20 and 30 to 34, inclusive, and 36).

The combination pusher and folding device 60 includes a first pair of folding shoe members 73 which are rigidly mounted on and rigidly attached to the horizontal supporting and pusher plate member 71 on the upper surface and at opposite end portions thereof, and each of these first folding shoe members 73 has a tapered forwardly extending front end or nose portion 74 (FIGS. 7, 8 and 30 to 34, inclusive, and 36).

In addition, the combination pusher and folding device 60 also includes a second pair of folding shoe members 75 each of which includes an upright body 76, which is rigidly attached in upright position to one of the end walls of the pusher head 61 (FIGS. 4, 7, 20 and 30 to 34, inclusive, and 36).

The second folding shoe members 73 are arranged inwardly of and extend parallel to the outer and first folding shoe members 73 (FIG. 7) and each of the second folding shoe members 75 has a horizontally extending slot 77 formed therein which extends inwardly from the front end portion of the body 76 of the folding shoe member 73 to an end wall 78 of the slot, thereby providing a pair of spaced horizontally extending arms 79 in each of the second folding shoe members 73 (FIGS. 4, 7, 20 and 30 to 34, inclusive, and 36).

THE ADJUSTMENT SCREW HEAD (FIGS. 3, 4, 5, 7 AND 30 TO 34, INCLUSIVE, AND 36)

As shown in FIGS. 1, 3, 4, 5, 7 and 30 to 34, inclusive, and 36, an adjustment screw head 80 for the pusher head 61 is disposed rearwardly of the pusher head 61 and extends parallel thereto and extends transversely across the horizontal supporting bar 62 to which it is attached, as at 81 (FIG. 1). The adjustment screw head 80 includes a pair of spaced adjusting screw supporting block portions 82 in each of which a pusher head adjusting screw member 83 is adjustably mounted (FIGS. 1, 3, 4, 5, 7 and 30 to 34, inclusive) and these pusher head adjustments screw members 83 extend into and are threadedly mounted in screw threaded openings 84 which are formed in the body of the pusher head 61 (FIG. 3). In this manner the pusher head 61 is attached to and is movable with the adjustment screw head 80 and both the pusher head 61 and the adjustment screws 83 therefor, and the adjustment screw head 80, are thus carried by and are movable with the horizontal supporting arm 62 and the reciprocating supporting arm structure 62-63-64-65 of which the supporting arm 62 forms a part.

In addition, the adjustment screw members 83 enable the pusher head 61 to be adjusted forwardly and rearwardly relative to the adjustment screw head 80 and relative to the head 53 of the elevator device 51 to accommodate the pusher head 61 and the folding shoe members 75 carried thereby, to ice cream sandwiches of varying widths.

THE SLIDABLE AND RECIPROCATING CARRIAGE (FIGS. 4, 5, 30 TO 34, INCLUSIVE, AND 36)

The slidable and reciprocating carriage 72 includes a pair of spaced vertically extending and parallel side rail frame members 85 each of which includes a depending arm 86 and a resilient rubber roller or like motion-limiting stop roller 87 is rotatably mounted between the depending arms 86 of the carriage 72 (FIGS. 4, 5 and 30 to 34, inclusive, and 36).

The combination pusher and supporting plate member 71 is rigidly attached, as at 88 (FIGS. 4 and 30 to 34, inclusive, and 36) to the front end portions of the horizontal side rail frame members 85 of the slidable and reciprocating carriage 72 so that the slidable and reciprocating carriage 72 and the combination pusher and supporting plate member 71 attached thereto are movable together as a unit.

Figure 5:
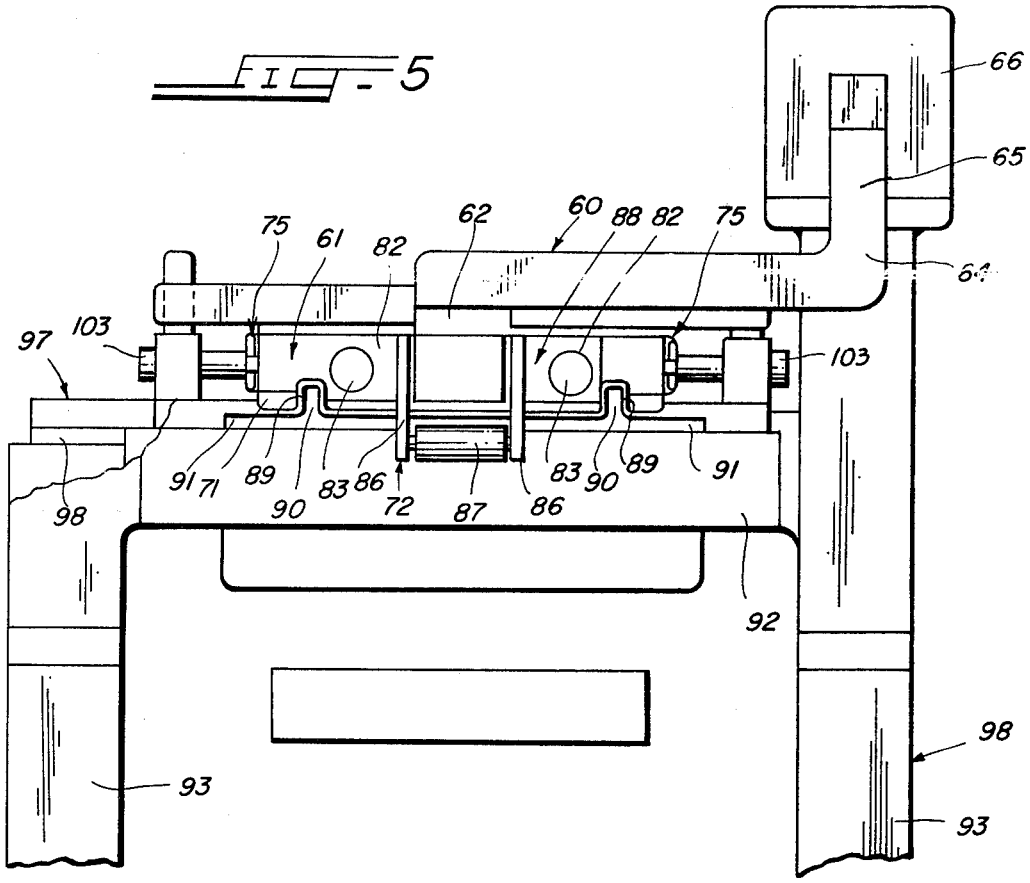
FIG. 5 is a front end elevational view along the line 5—5 in FIG. 3.

As shown in FIG. 5, the combination pusher and supporting plate member 71 has a pair of parallel longitudinally extending guide grooves 89 formed in its undersurface and upstanding guide rails 90 extend into the guide grooves 89. Each of the upstanding guide rails 90 is formed as an integral upward extension of a guide plate member 91 which is rigidly mounted on the upper surface of a horizontal supporting member 92 which extends transversely between and is attached to upright supporting legs 93 of the supporting frame 48 so that in this manner the slidable and reciprocating carriage 72, and the combination pusher and supporting plate member 71 embodied therein, are slidably mounted on and are guided by the guide rails 90.

As shown in FIGS. 3, 4 and 30 to 34, inclusive, and 36, a coil spring 94 is arranged and extends between the parallel side rail frame members 85 of the slidable and reciprocating carriage 72, and has its rear end portion attached to a pin 95 which extends between and is fastened to the rear end portions of the side rail frame members 85, the other and front end portion of the coil spring being attached, as at 96, to the adjustment screw head 80 (FIGS. 4 and 30 to 34, inclusive, and 36).

As shown in FIGS. 1, 3 and 5, the supporting frame 48 includes a generally U-shaped reinforcing bracket 97 which includes side arm portions 98 which are mounted on the upright supporting leg members 93 of the supporting frame 48, and the reinforcing bracket 97 includes a transverse or bight portion 99 which extends between the side arm portions 98 and reinforces the frame structure 48. In addition, the supporting frame 48 includes additional reinforcing and bracing structures, such as 186 (FIG. 1) which extend transversely of the supporting frame 48 (FIG. 1).

During its forward or inward movement, the resilient bumper or motion-limiting roller 87, which is carried by the depending arms 86 of the slidable and reciprocating carriage 72, engages a vertically extending wall surface 100 of a stationary stop member 101 which is rigidly mounted on the supporting frame 48 (FIGS. 4 and 30 to 34, inclusive) thereby stopping the forward or inward motion of the slidable and reciprocating carriage 72 and the combination pusher and supporting plate member 71 embodied therein, and the folding shoe members 73 on the combination pusher and supporting plate member 71, as will be described further hereinafter.

The construction of the combination pusher and folding device 60, and the slidable and reciprocating carriage 72 embodied therein, are such that as the combination pusher and folding device 60 and the pusher head 61 and the combination pusher and supporting plate member 71 are slidably moved forwardly from their initial positions, as in FIG. 30, by the slidable and reciprocating operating bar 65 and attached supporting arm structure 62-63-64, the adjustment screw head 80 is also moved inwardly and forwardly by the horizontal supporting arm 62 (FIG. 1) and by reason of the interconnection of the adjusting screw members 83 with the pusher head 61, the pusher head 61 is thus slidably moved forward on its inward stroke. This forward movement of the pusher head 61 on its inward stroke also moves the slotted second and inner folding shoe members 75, which are attached to the pusher head 61, forwardly over and relative to the combination pusher and supporting plate member 71 and the folding shoe members 73 thereon, and toward the head 53 of the elevator device 51, from the initial position in which the pusher head 61 and the second and slotted folding shoe members 75 carried thereby are shown in FIG. 30, successively into the positions in which the parts are shown in FIGS. 31, 32, 33 and 34.

During the forward stroke and inward movement of the pusher head 61 and the inner and second and slotted folding shoe members 75 carried thereby, the slidable and reciprocating carriage 72 and the combination pusher and supporting plate member 71, which forms a part thereof, and the first and outer folding shoe members 73 attached to the plate member 71, are also slidably moved forwardly and inwardly with the pusher head 61 and attached second and slotted folding shoe members 75 by reason of the fact that the coil spring 94 yieldably interconnects the slidable and reciprocating carriage 72 and the adjustment screw head 80-82 and the pusher head 61. During this movement, the coil spring 94 is tensioned.

As the pusher head 61 and the pusher plate 71 are thus slidably moved forward toward the head 53 of the elevator device 51 and the pusher plate member and the folding shoe members 73-74 thereon, slide onto and over the upper surface of the elevator head 53 (FIG. 32) and the pusher plate member 71 cooperates with the pusher head 61 to push the ice cream sandwich 36 with its wrapper sheet 37 thereon off the head 53 of the elevator device 51 toward and onto the upper surface of the horizontal trackway 49 at the input end thereof.

As this operation is cyclically repeated the pusher head 61 and the combination pusher and supporting plate member 71 move each succeeding ice cream sandwich 36 with its wrapper sheet 37 thereon against the next preceeding ice cream sandwich 36 and its wrapper sheet 37, and as this operation continues a horizontal row of the ice cream sandwiches 36 with their wrapper sheets 37 thereon is created (FIG. 10) and the entire row of ice cream sandwiches 36 with their wrapper sheets 37 thereon are thus slidably advanced over the upper surface of the horizontal trackway 49 through the successive folding operations and the heat-sealing devices 117 and cooling devices 120, as will be described hereinafter.

As the ice cream sandwich 36 with its wrapper sheet 37 thereon it thus slidably moved off the head 53 of the elevator device 50 by the pusher head 61 and the combination pusher and supporting plate member 71, the third and fourth folding operations which are involved in the cycle of folding operations performed in the use of the new wrapping machine 47 take place, as will be described hereinafter in connection with the description of the third and fourth folding operations.

THE SECOND FOLDING OPERATION (FIG. 19)

As the ice cream sandwich 36 with its wrapper sheet 37 thereon is thus slidably pushed off the head 53 of the elevator device 50 by the pusher head 61 it cooperates with the head 53 of the elevator device 50 to provide the second folding device embodied in the new wrapping machine 47, and to perform the second folding operation which is involved in the cycle of folding operations of the new wrapping machine. Thus, as illustrated in FIG. 19 of the drawings, as the pusher head 61 is slidably moved over the head 53 of the elevator device 50 it cooperates with the pusher plate member 71 and the head 53 of the elevator device 50 to infold the first or trailing bottom panel 41 under the bottom surface of the body of the ice cream sandwich 36.

Thereafter, as the ice cream sandwich 36 with its wrapper sheet 37 thereon is pushed by the pusher head 61 off the head 53 of the elevator 51 onto the horizontal trackway 49 the pusher hed 61 cooperates with the inner combination elevator guide and folding member 57 to infold the second and leading bottom panel 42 under the bottom surface of the ice cream sandwich (FIGS. 19 and 20), thereby completing the second folding operation involved in the use of the new wrapping machine 47.

THE THIRD FOLDING OPERATION (FIGS. 4, 7, 8, and 30 to 32, INCLUSIVE)

As the combination pusher and supporting plate member 71 with the first and outer folding shoe members 73 thereon is slidably moved inwardly toward the horizontal trackway 49, with and as a part of the slidable and reciprocating carriage 72, the front or nose portions 74 of the folding shoe members 73 engage the first and trailing end panels 43 of the wrapping sheet 37 on the ice cream sandwich 36, as shown in FIG. 31, and partially infold them against the end walls of the body of the ice cream sandwich 36. As the slidable and reciprocating carriage 72, and the combination pusher and supporting plate member 71 which forms a part thereof, continues to move forwardly from the position in which the parts are shown in FIG. 31 into the position in which they are shown in FIG. 32, the resilient bumper roller 87, which is carried by the depending arms 86 of the supporting frame 85—85 of the carriage 72, engages the vertically extending wall surface 101 of the wall 100, thereby stopping further forward movement of the carriage 72, the plate member 71 and the first and outer folding shoe members 73-74 on the plate member 71, thus preventing further folding action of the first folding shoe members 73-74 on and against the trailing end panels 43.

However, as further infolding action of the first and outer folding shoe members 73-74 is thus prevented by the engagement of the resilient bumper roller 87 against the wall surface 101 of the wall 100 the pusher head 61 and the second and slotted folding shoe members 75 carried thereby continue to move forwardly, and as this action continues the second and inner folding shoe members 75 on the pusher head 61 engage the trailing end panels 43 of the wrapper sheet 37 and complete the infolding of the trailing end panels 43 against the end walls of the ice cream sandwich 36, thereby completing the third folding operation involved in the use of the new wrapping machine 47 (FIG. 32).

THE FOURTH FOLDING OPERATION (FIGS. 4, 7, 33 and 35)

Figures 7, 8:
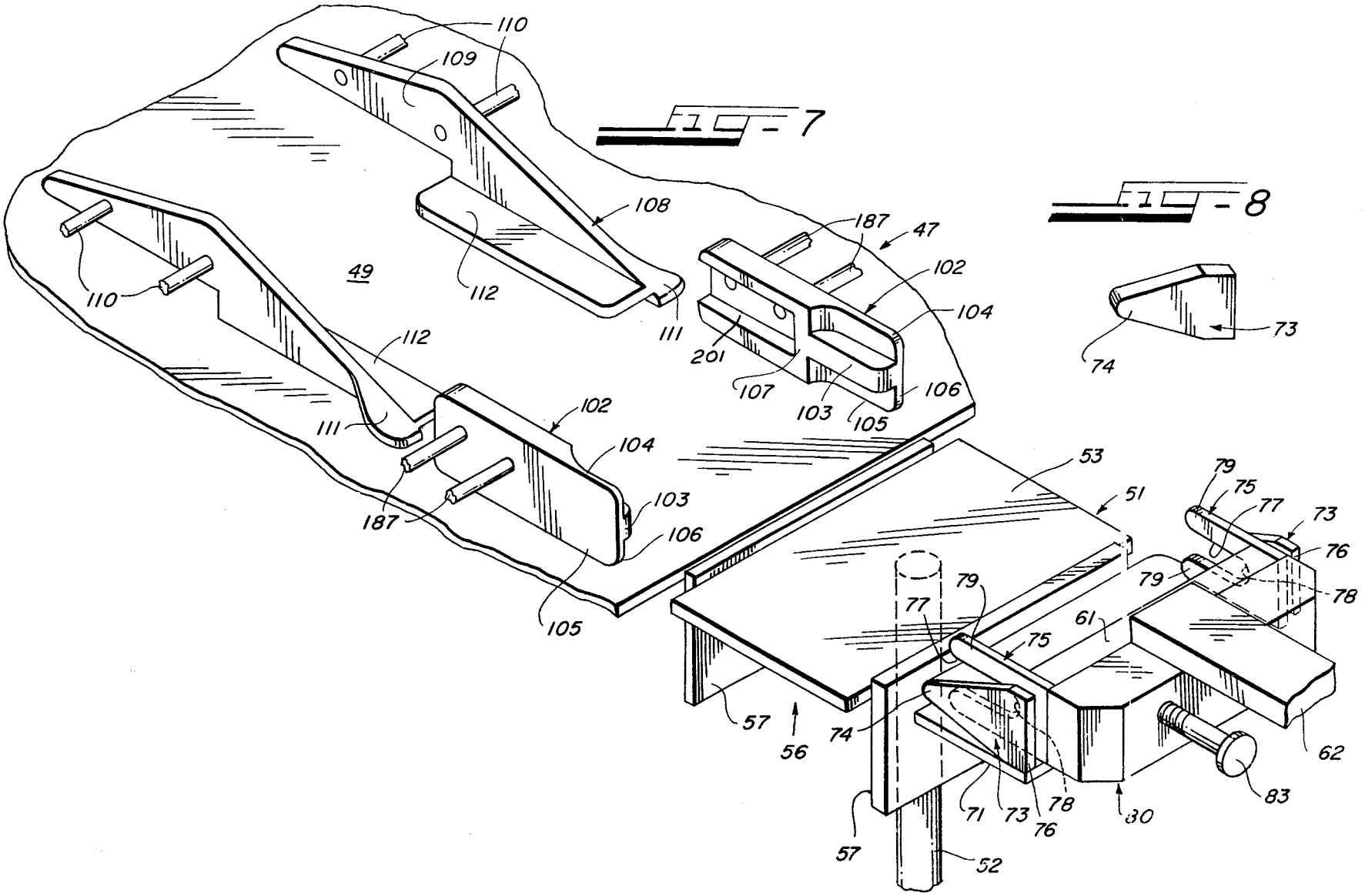
FIG. 7 is a fragmentary exploded perspective view illustrating parts of the ice cream sandwich elevator device; parts of the combination pusher and folding device; the folding shoe members which form part of the combination pusher and folding device; part of the horizontal trackway; and certain of the folding devices which are stationarily mounted on the horizontal trackway.
FIG. 8 is a perspective view illustrating one of the end panel folding shoe members which are embodied in the combination pusher and folding device.

The new wrapping machine 47 includes a pair of stationary folding shoe members 102 which are stationarily mounted in upright position on the upper surface of the horizontal trackway 49 and are held in position by supporting rods 187 which are suitably mounted in the supporting frame 48 (FIG. 7). Each of the stationary folding shoe members 102 has a horizontal flange or shelf portion 103 formed on its inner surface and each of these shelf portions 103 is disposed between the top and bottom edges 104 and 105, respectively, of the folding shoe member 102 and extends inwardly from the inner vertically extending wall 106 of the stationary folding shoe member 102 to a transverse vertically extending wall 107 which is formed on the inner surface of each of the stationary folding shoe members 102 (FIG. 7).

In the use of the new wrapping machine 47, as the slidably mounted recirpocating pusher device 60 and the pusher head 61 embodied therein, and the pusher plate member 71, push the ice cream sandwich 36, with its partially folded wrapper sheet 37 thereon, off the head 53 of the elevator device 51 and onto the horizontal trackway 49, and after the parts have reached the position in which they are shown in FIG. 32, the inner slotted movable folding shoe members 75 are moved further forwardly by the pusher head 61 toward and into cooperative folding relationship with the stationary folding shoe members 102 on the horizontal trackway 49. During this operation the horizontal flanges or shelf portions 103 on the stationary folding shoe members 102 enter into the horizontal slots 77 in the inner movable folding shoe members 75, as far as the inner end walls 78 of the slots 77 (FIG. 7), and when the two movable inner folding shoe members 75 have moved into this mating and cooperative folding relationship with the stationary folding shoe members 102, the inner wall surfaces of the shelf portions 103 of the stationary folding shoe members 102 cooperate with the inner wall surfaces of the bodies 76 of the inner movable shoe members 75 to form a continuous inner wall surface which engages and infolds the second and leading end panels 44 and completes the infolding of the leading end panels 44 against the inner walls of the ice cream sandwich 36, thereby completing the fourth folding operation involved in the use of the new wrapping machine 47 (FIGS. 33 and 35).

At this time, that is, at the completion of the fourth folding operation, as described above, the parts are disposed in the positions in which they are shown in FIG. 33, but as the cyclical operation of the reciprocating pusher and folding device 60 continues, the parts are returned to their initial positions, as in FIG. 30. During this operation, the slidable carriage 72 and the combination pusher and supporting plate 71 and the folding shoe members 73-74 thereon are returned to their initial position, as in FIG. 30, by the action of the reciprocating supporting arm structure 62-63-64 and during this operation the pusher head 61 engages the front end wall surface 188 of the adjustment screw head 80 (FIG. 36) and thus slidably returns the slidable and reciprocating carriage 72 and the pusher plate 71 and the first folding shoe members 73-74 thereon to their initial position, as in FIG. 30. During this operation the slidable and reciprocating carriage 72 and the combination pusher and supporting plate member 71 slide upon the horizontal guide rails 90 which engage in the guiding grooves 89 which are formed in the bottom surface of the combination pusher and supporting plate member 71 (FIG. 5), and the return movement of the carriage 72 is facilitated and stabilized by the then tensioned coil spring 94.

THE YIELDABLE AND FLEXIBLE PRESSURE MEMBERS (FIGS. 3, 7, 27, 28, 29 and 37 to 41, INCLUSIVE)

The new wrapping machine 47 includes a pair of horizontally extending and vertically upright back-up strip yieldable and flexible metallic pressure members 199 which are mounted in spaced relationship on the horizontal trackway 49 and extend lengthwise or longitudinally thereof inwardly of the stationary folding devices 108 and 113 and the heat-sealing devices 117 and the cooling devices 120, which will be described hereinafter (FIGS. 3, 27, 28, 29 and 37 to 41, inclusive). Each of the yieldable and flexible pressure members 199 is in the form of a relatively thin flexible metal strip having a front end mounting portion 200 which is mounted in a horizontal slot 201 which is formed in the body of the stationary folding shoe members 102 in which the mounting portion 200 is secured by screws 210 which are inserted through openings in the mounting portion 200 into screw threaded openings 209 in the body of the stationary folding shoe member 102 (FIGS. 7, 37 and 40). A reinforcing strip 211 is attached by the screws 210 to the mounting portion 200 of the back-up pressure member 199 within the slot 201 (FIG. 27). The other and rear end portion of each of the yieldable and flexible pressure members 199 is free so that the yieldable and flexible pressure members are thus yieldably and flexibly mounted for a reason which will be pointed out hereinafter in connection with the description of the heat-sealing devices.

As shown in FIGS. 38 and 39, the yieldably and flexible pressure members 199 are spaced slightly, in the order of about three-sixteenths of an inch, above the upper surface of the horizontal trackway 49 to allow the bottom end-sealing panels 46—46 to pass thereunder, as will be described hereinafter.

The function of these yieldable and flexible pressure members 199 will be described hereinfter in connection with the description of the heat-sealing devices and the cooling devices.

Thus, it will be noted (FIGS. 1, 3, 27, 28 and 29, and 37 to 41, inclusive) that each of the yieldable and flexible pressure members 199 includes a top edge portion 202; a bottom edge portion 203 spaced slightly above the horizontal trackway 49; a vertically extending inner wall surface 204 facing toward the horizontal trackway 49; a vertically extending outer wall surface 205 facing toward the convex inner wall surface 119 of the body of the adjacent heat-sealing device 117; and a relatively free, yieldable and flexible rear end portion 206.

THE FIFTH FOLDING DEVICE AND THEIR OPERATION (FIGS. 3, 4, 7, 9, 21 and 27)

Figure 9:
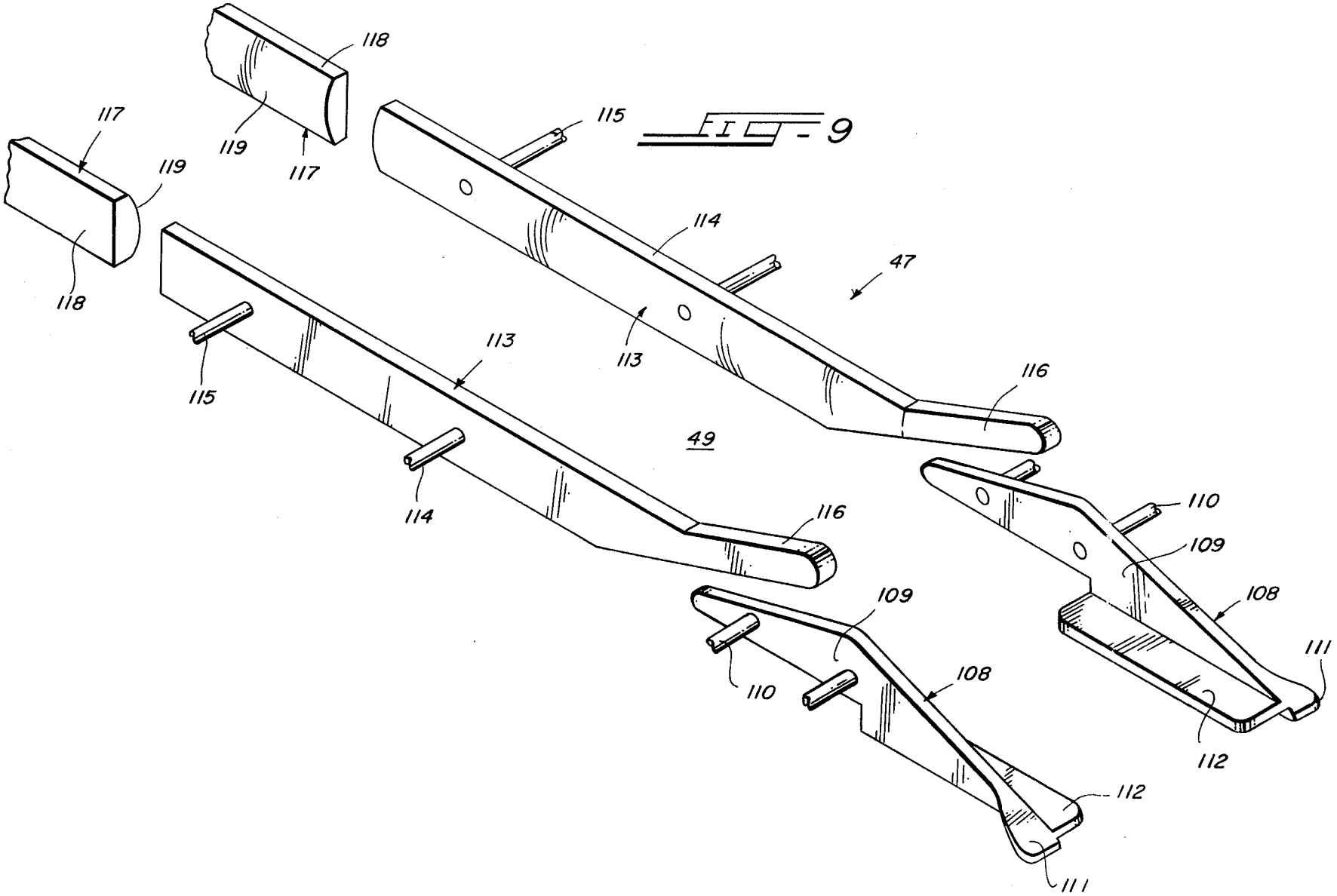
FIG. 9 is a fragmentary perspective view illustrating part of the horizontal trackway; the top and bottom end-sealing panel folding devices; and the heat-sealing devices.

The new wrapping machine 47 includes a fifth pair of folding devices, namely, a pair of bottom end-sealing panel folding devices, each of which is generally indicated at 108 (FIGS. 3, 4, 7, 9 and 21). Each of these bottom end-sealing panel folding devices 108 includes a generally upright or vertically extending wall 109 which is rigidly mounted in any suitable manner, as by means of supporting rods 110, on the supporting frame 48, and on the upper surface of the horizontal trackway 49, and each of the upright walls 109 preferably but not necessarily has an outwardly flared front end wall portion 111 (FIGS. 7 and 9). Each of the bottom end-sealing panel folding devices 108 also has an inwardly and horizontally extending bottom flange member 112 on the inner side of the upright wall 109 thereof (FIGS. 7 and 9).

In the use of the new wrapping machine 47, as each of the partially wrapped ice cream sandwiches 36 and its wrapper 37 are moved along the horizontal trackway 49 by the combined action of the pusher head 61 and the following horizontal row of ice cream sandwiches 36, the outwardly extending bottom end-sealing panels 46—46 engage the outwardly flared front end portions 111 of the upright walls 109 of the folding devices 108 and are folded inwardly thereby along the horizontal flanges 112, and as the ice cream sandwich 36 with its wrapper sheet 37 thereon is moved further along the horizontal trackway 49 the bottom end-sealing panels 46—46 pass under the back-up strip pressure members 199 (FIG. 27) and are upfolded and infolded by the vertically extending walls 109 of the folding devices 108 on the outer sides of the back-up strip pressure members 199 (FIG. 27) against the end wall panels 43 and 44 of the ice cream sandwich, into the position in which they are shown in FIG. 28, thereby completing the fifth folding operation involved in the use of the new wrapping machine 47.

THE SIXTH AND FINAL FOLDING DEVICES AND THEIR OPERATION (FIGS. 3, 4, 9, 10, 22, 28 AND 29)

The new ice cream sandwich wrapping machine 47 includes a sixth and final pair of folding devices, each of which is generally indicated at 113 (FIGS. 3, 4, 9, 10 and 22) and each of which includes a generally upright or vertically extending rail or wall member 114 which is attached, as by supporting rods 115, to the supporting frame 48, and each of the vertically extending rail or wall members 114 preferably but not necessarily includes an upwardly and somewhat outwardly flared front end portion 116.

In the use of the new ice cream sandwich wrapping machine 47, as the ice cream sandwich 36 with its wrapper sheet 37 thereon, is moved along the horizontal trackway 49, past the folding devices 108, by the combined action of the pusher head 61 and the following row of ice cream sandwiches 36, the then outwardly extending top end-sealing panels 45 engage and ride under the upwardly and somewhat outwardly flared front end portions 116 of the rail members 114 and the top end-sealing panels 45 of the wrapper sheet 37 are thus folded downwardly and inwardly over the upper edges of the back-up strip pressure members 199 and on the outer sides thereof (FIG. 28), and this downfolding of the top end-sealing panels 45 is completed by the inner side wall surfaces of the vertically extending rail members 114, thereby downfolding the top end-sealing panels 45 against the bottom end-sealing panels 46 on the outer sides of the back-up strip pressure members 199 (FIG. 29), thus completing the sixth and final folding operation involved in the use of the new wrapping machine 47.

THE HEAT-SEALING DEVICES (FIGS. 1, 2, 3, 4, 9, 10, 23, 38 AND 41)

After the thus wrapped ice cream sandwich 36 passes the sixth and final folding devices 113, the then infolded top and bottom end-sealing panels 45 and 46, respectively, pass between the back-up strip pressure members 199 and a pair of electrically energized heat-sealing devices, which are generally indicated at 117, and which are mounted in spaced upright position on the horizontal trackway 49 between the folding devices 113 and the delivery end 121 of the horizontal trackway 49 (FIGS. 3 and 38). Each of the heat-sealing devices 117 includes a metallic body 118 in which electrical heating coils of conventional design (not shown) are arranged.

The metallic body 118 of each of the heat-sealing devices 117-118 has a convex inner wall surface 119, as shown in FIGS. 9, 10, 11, 23, 38 and 41, and as the ice cream sandwich 36 with its wrapper sheet 37 thereon is moved along the horizontal trackway 49 it passes between the back-up strip pressure members 199 and urges them outwardly against the top and bottom end-sealing panels 45 and 46, respectively, of the wrapper sheet 37 which are thus urged into engagement with the convex inner wall surface 119 of the heat-sealing devices 117. This action creates pressure on the top and bottom end-sealing panels 45 and 46—46, respectively, and forces them into tight and intimate engagement with each other as the heat-sealable coating thereon is softened by the heat-sealing devices 117 and the top and bottom end-sealing panels 45 and 46—46, respectively, are thus securely heat-sealed together.

It has thus been found in the practice of the present invention that as the yieldable and flexible pressure members 199 are thus urged laterally outwardly by the wrapped ice cream sandwiches 36 against the top end-sealing panels 45—45 the top and bottom end-sealing panels 45—45 and 46—46, respectively, are thus urged into a firmer and more intimate and effective heat-sealing engagement with the convex inner wall surfaces 119 of the heat-sealing devices 117-118 by the metal-to-metal pressure thus applied to the top and bottom end-sealing panels 45—45 and 46—46 by the combined action of the metallic yieldable and flexible pressure members 199 and the heat-sealing devices 117-118, than could be obtained without the use of the yieldable and flexible pressure members 199 and by direct engagement of the relatively soft body of the ice cream sandwich 36 against the top and bottom end-sealing panels 45—45 and 46—46.

THE COOLING DEVICES (FIGS. 1, 3 AND 39)

After the ice cream sandwich 36 is thus wrapped and its wrapper completely folded and heat-sealed, it is slidably moved along the horizontal trackway 49 by the combined action of the pusher head 61 and the following row of ice cream sandwiches 36. During this operation the wrapped and heat-sealed ice cream sandwiches 36 pass between and engage the relatively free end portions of the yieldable and flexible back-up strip pressure members which are thus urged outwardly into close and intimate cooling engagement with the heat-conductive metallic cooling devices in the form of upright heat-conductive metallic bars 120 (FIGS. 1, 3 and 39) which ae stationarily mounted on the horizontal trackway 49 and may be made of any suitable highly heat-conductive metal such, for example, as steel, aluminum, or the like, thereby cooling the heat-sealed top and bottom end-sealing panels 45 and 46—46, respectively, and the adjacent end portions of the body of the ice cream sandwich 36.

As shown in FIG. 39, each of the cooling devices 120 includes an upright metallic body 207 having a convex inner wall surface 208 against which the heat-sealed top and bottom end-sealing panels 45—45 and 46—46, respectively, are urged by the yieldable and flexible pressure members 199 to effect a close and intimate cooling engagement between the metallic cooling bars 120-206 and the heat-sealed top and bottom end-sealing panels 45—45 and 46—46, respectively, of the wrapper sheet 37.

The thus wrapped, heat-sealed and cooled ice cream sandwich 36 with its wrapper sheet 37 thereon is then moved along the horizontal trackway 49 to the delivery end 121 thereof from which it may be discharged into a suitable receptacle or onto a conveyor (not shown) for packaging and storing or other disposition. During this operation the top and bottom end-sealing panels 45—45 and 46—46, respectively, travel along the top and bottom edges 202 and 203, respectively, of the yieldable and flexible back-up strip pressure members 199 and slide off the free end portions 206 thereof (FIG. 29).

THE ICE CREAM SANDWICH HOLD-DOWN DEVICE (FIGS. 1, 2 AND 6)

The new wrapping machine 47 includes an ice cream sandwich hold-down device 122 (FIGS. 1, 2 and 6) which includes an upright U-shaped handle portion 123 having downwardly and vertically extending arms 124 each of which is attached to an arm 125 of a generally flat hold-down plate member 126 (FIGS. 1 and 6). A pin 127 is attached to and depends from each of the arms 125 of the hold-down plate member 126 and the lower end portion of each of the pins 127 projects into and is removably mounted in a recess 128 which is formed in the body of the horizontal trackway 49 (FIG. 6).

In the use of the new wrapping machine 47, when the hold-down device 122 is mounted in position of use, as in FIGS. 1, 2 and 6, the outer end portions of the ice cream sandwich with its wrapping sheet 37 thereon pass under the arms 125 of the hold-down plate member 126 as they are successively moved off the head 53 of the elevator device 51 and onto and along the horizontal trackway 49 by the slidable and reciprocating pusher head 61, and in this manner the hold-down device 122 prevents jamming of the ice cream sandwiches 36 at the input end of the horizontal trackway 49.

When it is necessary to do so, the hold-down device 122 may be readily manually lifted off the horizontal trackway 49 by means of its handle 123 with the supporting pins 127 being thus lifted out of the recesses 128 in the trackway 49.

THE WRAPPER SHEET HOLD-DOWN DEVICE (FIGS. 3, 3A AND 3B)

Figure 3B:
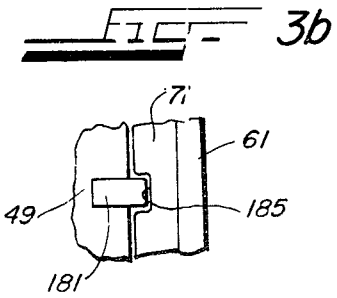
FIG. 3B is a fragmentary detail view of certain of the parts illustrated in FIGS. 3 and 3A.

As shown in FIGS. 3, 3A and 3B of the drawings, the new wrapping machine 47 includes a wrapper sheet hold-down device, which is generally indicated at 180, and which includes a pair of resilient spring-biased wrapper sheet hold-down fingers 181 which are pivotally mounted on supporting pintles 182 which are mounted in housings 183 which are, in turn, mounted on the supporting frame structure 48 below the horizontal trackway 49 adjacent the elevator device 51 (FIGS. 3 and 3A). These spring-biased wrapper sheet hold-down fingers 181 project upwardly through openings 184 in the horizontal trackway 49 and the outer and upper end portions thereof are biased by springs 198 on the pintles 182 and project inwardly over the upper surface of the adjacent combination elevator guide and folding rail member 57 into the path of the upwardly moving downfolded panel 58 of the wrapper sheet 37, and thereby yieldably engage the downfolded panel 58 of the wrapper sheet 37 and prevent it from becoming jammed between the adjacent combination elevator guide and folding rail member 57 and the adjacent side of the ice cream sandwich 36 as the ice cream sandwich with its wrapper sheet 37 thereon is elevated by the head 53 of the elevator device 51. During this action the spring-biased wrapper hold-down fingers 181 are pivoted on their supporting pintles 182 against the action of the springs 198.

As also shown in FIG. 3, the combination pusher and supporting plate member 71 has notches 185 formed in its inner and forward edge portion and when the combination pusher and supporting plate member 71 is moved forwardly over the head 53 of the elevator device 51 the upper end portions of the spring-biased wrapper sheet hold-down fingers 181 engage in the notches 185 in the pusher and supporting plate member 71 so that the ice cream sandwich 36 with its wrapper sheet 37 thereon is free to be moved off the elevator head 53 onto the horizontal trackway 49.

THE OPERATING MECHANISM FOR THE ELEVATOR DEVICE (FIG. 14)

The operating mechanism for the elevator device 51-52-53 is illustrated in FIG. 14 of the drawings, wherein it is generally indicated at 129 and includes an arm 130 which is attached to and extends laterally from the lower end portion of the vertically extending elevator supporting and operating rod 52 which is slidably guided in a tubular guide member 131 which is suitably mounted in the supporting frame 48 (FIG. 14). An internally threaded upwardly projecting member 132 has its lower end portion pivotally connected, as at 133, to the arm 130 and the member 132 has an upwardly projecting externally threaded member 134 adjustably mounted thereon. The upper end portion of the externally threaded member 134 is pivotally connected, as at 135, to one end portion of an oscillating rocker arm member 136, the other end portion of which is pivotally mounted, as at 137, to a supporting bracket 138 which is attached to and depends from part of the supporting frame 48 (FIG. 14).

A generally circular cam 139 is eccentrically mounted on a horizontally extending shaft 140, which is suitably mounted and journaled in the supporting frame 48, and the eccentric cam 139 works in a generally circular cam housing 141 which has a radially extending arm 142 which is pivotally connected, as at 143, to the oscillating rocker arm member 136. A timer belt gear 144 is mounted on the horizontal shaft 140 and a timer belt 145 meshes with the timer belt gear 144 and with a timer belt gear 146 which is mounted on the drive shaft 147 of an electric driving motor unit 148 which is suitably mounted on the supporting frame 48 (FIG. 14).

In the use of the wrapping machine, the elevator device 51, including its supporting shaft 52 and the elevator head 53 thereon, are reciprocated vertically in the guide member 131 by the operating mechanism 129 therefor, as follows: Power is delivered from the drive shaft 147 of the motor driving unit 148 by way of the timer belt gear 146 and timer belt 145 to the timer belt gear 144 on the shaft 140 which thus rotates the eccentric cam 139 in the cam housing 141. This motion of the eccentric cam 149 acts, through the radially extending arm 142 on the cam housing 141, and its pivotal connection 143 to the rocker arm 136, to pivot the rocker arm 136 on its pivotal mounting 137, and this motion of the rocker arm 136 acts, through its pivotal connection 135 with the members 134-132, to reciprocate the arm 130 on the lower end portion of the elevator shaft 52, thereby reciprocating the elevator shaft 52 and the elevator head 53 thereon vertically in the guide member 131 and in the elevator guideway 56.

THE OPERATING MECHANISM FOR THE ICE CREAM SANDWICH COMBINATION PUSHER AND FOLDING DEVICE (FIGS. 14, 14A, 15 AND 16)

The operating mechanism for the combination pusher and folding device 60 is generally indicated at 70 (FIGS. 1, 2, 14, 14A, 15 and 16) and includes an eccentric cam 149 which is mounted on a horizontally extending shaft 188 which is suitably mounted and journaled, as at 189 and 190, in the supporting frame 48 (FIG. 2). The eccentric cam 149 works in a generally circular cam housing 150 and the eccentric cam 149 has a groove 151 formed therein in one surface thereof and a cam follower 152 works in the groove 151 (FIGS. 15 and 16). An oscillating arm member 153 has one end portion pivotally connected to the cam follower 152 and has its other end portion pivotally connected, as at 154, to the linkage 69 which is attached to the pusher-operating slide bar 65. A sprocket gear 191 is mounted on the shaft 188 and a sprocket chain 192 meshes with the sprocket gear 191 and the sprocket chain 192 also meshes with a sprocket 193 on the shaft 140 (FIG. 14), the sprocket chain 192 being mounted in a housing 178 (FIG. 2). The sprocket chain 192 also meshes with a sprocket gear 193 on the shaft 140 (FIGS. 14 and 14A).

In the use of the new wrapping machine, when the motor unit 149 and its drive shaft 147 are operated and power is delivered by the gear 146 and driving belt 145 to the gear 144 and the shaft 140 to reciprocate the elevator device 51-52-53 in its vertical movement, as described above, the combination pusher and folding device 60 is reciprocated in timed sequence therewith, in its reciprocating horizontal movement, through the action of the gear 193 on the shaft 140 and the sprocket chain 192 and gear 191 (FIGS. 14 and 14A) to rotate the shaft 188 which acts, by way of the eccentric cam 149 on the shaft 188, the cam follower 152, the oscillating arm member 153 and its pivotal connection 154 with the linkage 69 and the end portion 68 of the operating slide bar 65, to reciprocate the operating slide bar 65, thereby reciprocating the supporting arm structure 64-63-62 and the adjustment screw head 80-82-83 and the combination pusher and folding device 60 including the pusher head 61 and the folding shoe members 75 on the pusher head 61 and the slidable and reciprocating carriage 72, the combination pusher and supporting plate member 71, and the folding shoe members 73-74 mounted thereon.

THE WRAPPER WEB-FEEDING AND WEB-ADVANCING DEVICE (FIGS. 1, 4 10 AND 14)

The wrapper web-feeding device is generally indicated at 155 (FIGS. 1 and 4) and includes a feed roll 156 which is mounted on a horizontal shaft 156 which is suitably journaled in the supporting frame 48 below the horizontal trackway 49. The web 54 of wrapping material is drawn from the feed roll 156 in a generally horizontal plane which is below the horizontal trackway 49.

Figure 4:
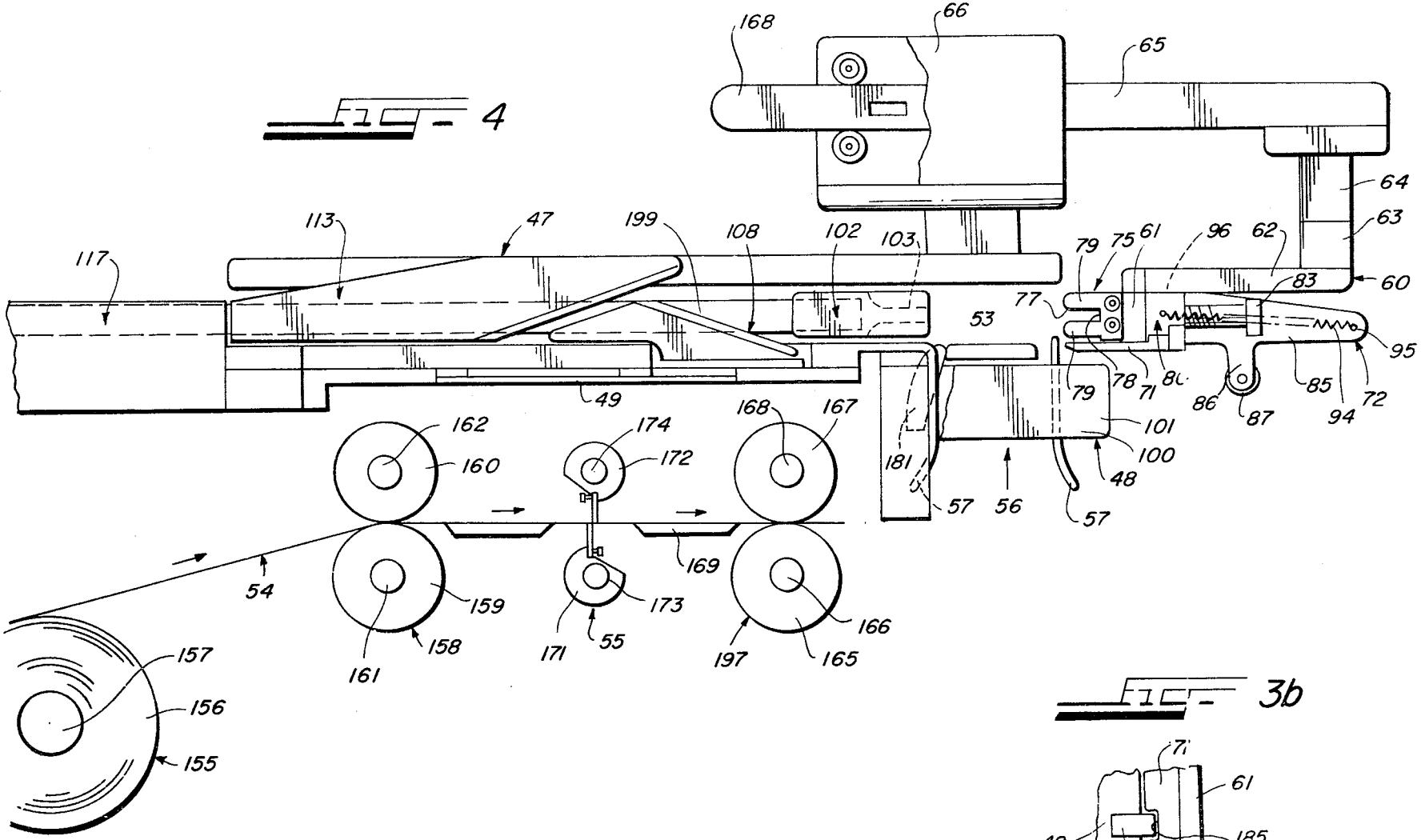
FIG. 4 is a side elevational view of the new wrapping machine, along the line 4—4 in FIG. 3.

As shown in FIGS. 4, 10 and 14, the web 54 of wrapping material is drawn from the feed roll 156 by a web-advancing device 158 which includes a web-advancing drive roller 159 and a driven or idler roller 160 which are mounted on rotatable shafts 161 and 162, respectively, which are suitably journaled in the supporting frame 48 below the trackway 49.

A belt pulley 163 is mounted on the web-advancing drive shaft 161 (FIG. 14) and a driving belt 164 works over the belt pulley 163 and the driving belt 164 is operated by operating means which will be described hereinafter in connection with the web-cutting device 55.

THE WRAPPER WEB-CUTTING DEVICE AND ITS OPERATING MECHANISM (FIGS. 4, 10 AND 14)

The new wrapping machine 47 includes a rotary cutter or web-severing device, which is generally indicated at 55 (FIGS. 4, 10 and 14), and includes a pair of rotary cutter knives 171 and 172 which are rotatably mounted on shafts 173 and 174, respectively, which are suitably journaled in the supporting frame 48, as at 193 and 194 below the trackway 49 (FIG. 1), and a pair of intermeshing gears 195 and 196 are mounted on the shafts 173 and 174, respectively, (FIG. 14). A belt pulley 175 is mounted on the shaft 173 and a drive belt 76 works over the belt pulley 175 on the rotary cutter shaft 173 and over the gear 144 on the shaft 140 (FIG. 14).

When the driving motor unit 148 is energized, power is delivered by way of the motor shaft 147, gear 146, sprocket chain 145, sprocket gear 193, shaft 140, sprocket gear 191, timer belt or chain 176, belt pulley 175, shaft 173 and gears 195 and 196, to rotate the rotary cutter knives 171 and 172 on the shafts 173 and 174, respectively, and thereby sever a wrapper sheet section 37 from the web 54 as the web 54 is advanced between the rotary cutter knives 171 and 172.

THE WRAPPER SHEET "KICKER" OR SPEED-UP ROLLS AND THEIR OPERATION (FIGS. 4, 10 AND 14)

The wrapper sheet "kicker" or speed-up device is generally indicated at 197 (FIGS. 4, 10 and 14) and includes a pair of wrapper sheet advancing rollers 165 and 167 which are mounted on shafts 166 and 168, respectively, which are suitably journaled in the supporting frame 48 below the horizontal trackway 49 and between the rotary web-cutting device 55 and the elevator device 51 (FIGS. 4 and 10). A belt pulley 170 is mounted on the shaft 166 and the driving belt 164 works over the pulley 170 (FIG. 14).

In the use of the new wrapping machine, the web-cutting or web-severing operation takes place as the leading edge portion 178 of the web 54 passes between the bite of the speed-up or "kicker" rolls 165 and 167 (FIGS. 10 and 14), which are driven by the driving belt 164, and which coact to speed up the advancing movement of the severed wrapper sheet 37 and to "kick" it rapidly into the path of the elevator head 53 where it is laid flat and centered over the upper surface of an ice cream sandwich 36 which has been deposited on the elevator head 53.

To this end the wrapper sheet speed-up or "kicker" rolls 165-167 are preferably designed and timed in relation to the web-advancing rolls 159-160 in a speed increasing ratio, which is preferably in the order of five (5) to four (4), so that as the web 54 is advanced between the speed-up or kicker rolls 165-167 its forward motion is increased so as to speed up and to expedite the advancing movement of the web 54 as the leading edge portion 178 thereof passes between the bite of the speed-up or kicker rolls 165-167 which thus rapidly move the severed wrapped sheet section 37 onto and over the upper surface of an ice cream sandwich 36 on the elevator head 53 in timed relationship with the vertical reciprocating movement of the elevator device 51 and the elevator head 53.

SUMMARY OF THE OPERATION OF THE ICE CREAM SANDWICH WRAPPING MACHINE

In the use and operation of the new ice cream sandwich wrapping machine 47, when the motor driving unit 148 is energized (FIG. 14), and the web-feeding device 258 is activated, as described hereinbefore, the elevator device 51-52-53 is reciprocated in its vertical movement by the operating mechanism 129 therefor by means of the motor driven shaft 147, the power transmission means 145-140-139-141-142-143-136-135-134-132-133-130 in its guide member 131 and in the elevator guideway 56 (FIG. 14).

During each cycle of its vertical reciprocating movement, when the elevator head 53 is in its lowermost position, an ice cream sandwich 36 is deposited thereon by means of a suitable feeding and conveyor device (not shown) but which may be of any suitable type and construction such, for example, as that shown in the Rapp U.S. Pat. No. 2,794,404.

As the motor drive unit 148 is energized, power is delivered by way of the motor shaft 147, timing belt 145, shaft 140, pulley 144, timer belt 176, pulley 175, shaft 173, belt 164, pulley 163 and shaft 161 to actuate the wrapper web-feeding device 155 (FIG. 4) and the wrapper we-advancing device 158 and its rollers 159 and 160 and thereby advance the web 54 of wrapping material from the feed roll 156 along the horizontal guide 169 (FIG. 4) into engagement with the rotary cutter device 55 and between the rotary cutter knives 171 and 172 which are rotated by the belt 176, pulley 175, shaft 173, gears 195 and 196, and shaft 174 (FIGS. 4, 10 and 14), thereby severing a wrapper sheet section 37 from the web 54. During this operation the speed-up or "kicker" device 197 and its rollers 165 and 167, on the supporting shafts 166 and 168, engage the severed wrapper sheet 37 and rapidly project it into the path of the elevator head 53 and the ice cream sandwich 36 carried thereby so that the wrapper sheet 37 is thus laid flat across and centered on the upper surface of the ice cream sandwich 36 (FIG. 10).

As the elevator device 51-52-53 is moved upwardly in each cycle of its operation, with an ice cream sandwich 36 disposed on the elevator head 53, it carries with it is severed wrapper sheet section 37 (FIG. 10) which has been severed from the web 54 by the rotary cutter device 55 and its rotary cutter knives 171-172 and which has been rapidly advanced into the path of the elevator head 53 by the speed-up or "kicker" rolls 165-167.

Accordingly, as the head 53 of the elevator device 51 moves rapidly upwardly in the elevator guide channel 56, it engages the outwardly flared lower end portions of the vertically extending combination guide plate and folding members 57—57 (FIG. 17) and passes upwardly between them. During this operation the two side panels 57 and 58 of the wrapper sheet 37 are downfolded from the center or top panel 38 of the wrapper sheet 37 into generally parallel and vertically extending position, by the combination elevator guide plate and folding members 57—57, along the side walls of the ice cream sandwich 36 (FIG. 18).

When the motor driving unit 148 is energized, as described above, to reciprocate the elevator device 51-52-53, and power is delivered to the shaft 140, the rotation of the shaft 140 acts, through the operating mechanism 70 for the combination pusher and folding device 60 including the shaft 140, the gear 193 thereon, sprocket chain 192, sprocket gear 191, shaft 188, the eccentric cam 149, cam follower 152, the reciprocating arm 153, pivotal connection 154, linkage 69 and the end portion 68 of the operating slide bar 65 to reciprocate the operating slide bar 65-68 horizontally in its guide housing 66 (FIGs. 14, 14A, 15 and 16). This action reciprocates the supporting arm structure 64-63-62 and the adjustment screw head 80-82, which is attached to the supporting arm 62, and the pusher head 61, which is attached to the adjustment screw head 80-82 by the adjustment screws 83, in timed sequence with the reciprocating vertical movement of the elevator device 51-52-53 and an ice cream sandwich 36 and its wrapper sheet 37 on the head 53 of the elevator device 51.

As the combination pusher and folding device 60 and the adjustment screw head 80-82 and attached pusher head 61, are thus moved forwardly toward the elevator device 51-52-53, including the elevator head 53, by the reciprocating slide bar 65 and the attached supporting arm structure 64-63-62, the adjustment screw head 80-82 acts, through the coil spring 94 attached thereto, to move the slidable and reciprocating carriage 72, including the combination pusher and supporting plate member 71 and the first and outer folding shoe members 73 thereon, forwardly toward the elevator head 53 and the ice cream sandwich 36 and its wrapper sheet 37 disposed thereon. During this movement the slidable and reciprocating carriage 72 and the combination pusher and supporting plate member 71, which forms a part thereof, slide upon the guide rails 90 which project into the grooves 89 which are formed in the undersurface of the combination pusher and supporting plate member 71 (FIG. 5).

During this operation the combination pusher and folding device 60, and the slidable and reciprocating carriage 72 and the first folding shoe members 73-74 attached thereto, move from their initial position, as in FIG. 30, into the position in which they are shown in FIG. 31. As the parts thus move into the position in which they are shown in FIG. 31, the front or nose portions 74 of the first folding shoe members 73, which are carried by the combination pusher and supporting plate member 71, engage the trailing end panels 43 of the downfolded side panel 59 of the wrapper sheet 37 and partially infold the trailing end panels 43 against the end walls of the ice cream sandwich 36, as shown in FIG. 31.

As the forward motion of the slidable and reciprocating combination pusher and folding device 60, and the slidable and reciprocating carriage 72 continues, the parts move from the position in which they are shown in FIG. 31 into the position in which they are shown in FIG. 32, and during this operation the combination pusher and supporting plate member 71 slidably moves onto and over the upper surface of the elevator head 53 and infolds the first bottom panel 41 of the wrapper sheet 37 under the bottom surface of the ice cream sandwich 36 (FIG. 19).

Continued forward movement of the combination pusher head and folding device 70, the combination pusher and supporting plate member 71, and the pusher head 61, slidably moves the ice cream sandwich 36 and its wrapper sheet 37 forwardly off the head 53 of the elevator device 51-52-53 and during this action the then downfolded side panel 58 of the wrapper sheet 37 engages the adjacent combination elevator guide and folding member 57 and infolds the second bottom panel 42 under the bottom surface of the ice cream sandwich (FIGS. 19 and 20).

During this operation the first folding shoe members 73-74 on the combination pusher and supporting plate member 71, and the second and slotted folding shoe members 75, which are attached to the outer end walls of the pusher head 61, move into the position in which they are shown in FIG. 31 and complete the infolding of the trailing end panels 43 of the wrapper sheet 37 against the end walls of the ice cream sandwich 36. As indicated above, during this operation the ice cream sandwich 36 and its wrapper sheet 37 are slidably moved off the head 53 of the elevator device 51-52-53 onto the input end of the horizontal trackway 49 by the combined action of the pusher head 61 and the combination pusher and supporting plate member 71.

When the parts reach the position in which they are shown in FIG. 32, the resilient motion-limiting stop or bumper roller 87 on the slidable and reciprocating carriage 72 engages the vertically extending wall surface 101 of the stationary wall 100 and thus prevents further forward movement of the slidable and reciprocating carriage 72 and of the combination pusher and supporting plate member 71 and attached first folding shoe members 70-74 carried thereby, and the then tensioned coil spring 94.

However, as the forward motion of the slidable and reciprocating combination pusher and folding device 60 and the adjustment screw head 80-82-83 to which it is attached, continues, the forward movement of the pusher head 61 and the second and inner slotted folding shoe members 75 which are carried by the pusher head 61, also continues, and these parts move from the position in which they are shown in FIG. 32 into the position in which they are shown in FIG. 33. During this operation the ice cream sandwich 36 and its wrapper sheet 37 are moved over and along the upper surface of the horizontal trackway 49, at the input end thereof, and as this operation continues the slotted second and inner folding shoe members 75, which are carried by the pusher head 61, move into the position in which they are shown in FIG. 33. As this operation takes place the horizontal shelf or flange portions 103 on the stationary folding shoe members 102 enter into the horizontal slots 77 in the second and inner folding shoe members 75 and the leading end panels 44 of the wrapper sheet 37 come between the end walls of the ice cream sandwich 36 and the vertically extending wall and folding surfaces which are thus provided by the coaction of the inner surfaces of the slotted folding shoe members 75 and inner wall surfaces of the horizontal shelf or flange portions 103 of the stationary folding shoe members 102 and thereby complete the infolding of the leading end panels 44 against the end walls of the ice cream sandwich 36 (FIGS. 27, 33 and 35).

After the parts have completed the folding operations illustrated in FIGS. 31, 32 and 33, the slidable and reciprocating combination pusher and folding device 60 begins its return or rearward stroke and during this return movement the rear end portion of the adjustment screw head 80-82-83 engages the front end portion 188 of the slidable and reciprocating carriage 72, as shown in FIG. 35, and coacts with the then tensioned coil spring 72 to return the slidable and reciprocating carriage 72 and the combination pusher and supporting plate member 71 and attached first folding shoe members 73-74 carried thereby, back into their initial position, as in FIG. 30.

As the cyclical vertically reciprocating movement of the elevator device 51-52-53 and the slidable and reciprocating horizontal movement of the combination pusher and folding device 60, and the slidable and reciprocatng carriage 72 is repeated, the ice cream sandwiches 36 and their partially folded wrapper sheets 37 are successively moved onto the horizontal trackway 49 and form a horizontal row of the ice cream sandwiches 36 and their wrapper sheets 37 on the horizontal trackway 49, as shown in FIG. 10.

During this operation, each leading ice cream sandwich in the horizontal row thereof is slidably moved along the horizontal trackway 49, between the back-up strip pressure members 199, by the combined action of the pusher head 61 and the succeeding or following sandwiches 36 in the row thereof, and as this operation continues the bottom end-sealing panels 46-46 of the leading ice cream sandwich 36 slide under the bottom edge of the back-up strip pressure members 199 (FIG. 27), and engage the outwardly flared front end portions 111 of this stationary folding shoe members 108 (FIG. 7) which fold the bottom end-sealing panels 46—46 inwardly and upwardly on the outer sides of the back-up strip pressure members 199, and this folding action is completed as the bottom end-sealing panels 46—46 ride over the horizontal flanges 112 along the vertical inner wall surfaces of the upright side rails 109 of the stationary folding shoe members 108 which coact to infold and upfold the bottom end-sealing panels 46—46 against the adjacent infolded end panels 43-44 and on the outer sides of the back-up strip pressure members 199 (FIG. 28).

As the leading ice cream sandwich 36 and its wrapper sheet 37, folded as shown in FIG. 28, continues to move along the horizontal trackway 49, the top end-sealing panels 45 engage and move under the upwardly flared front end portions 116 of the stationary folding shoe members 113 which coact with the vertically extending inner wall surfaces of the side rails 114 of the stationary folding shoe members 113 to downfold the top end-sealing panels 45 over the upper edges of the back-up strip pressure members 199, against the then upfolded and infolded bottom end-sealing panels 46—46 and on the outer sides of the back-up strip pressure members 199, thereby completing the sequence of folding operations which are performe in a cycle of operations of the wrapping machine 47 (FIG. 29).

The thus wrapped ice cream sandwich 36-37 is then further moved along the horizontal trackway 49 into engagement with the heat-sealing devices 117 and during this movement the wrapped ice cream sandwich engages the back-up strip pressure members 199 and urges then outwardly against the top and end-sealing panels 45 and 46—46, respectively, which are thus urged by the back-up strip pressure members 199 into the firm and intimate heat-sealing engagement with the convex inner wall surfaces 119 of the heat-sealing devices 117, thereby assuring a firm and effective heat seal between the top and bottom end-sealing panels 45 and 46—46, respectively.

The thus wrapped and heat-sealed ice cream sandwich 36-37 is then moved further along the horizontal trackway 49 into engagement with the cooling devices 120 by which the heat-sealed top and bottom end-sealing panels 45 and 46—46 and adjacent end portions of the ice cream sandwiches are cooled. During this operation the heat-sealed top and bottom end-sealing panels 45 and 46—46 are disposed on the outer sides of the yieldable and flexible pressure members 199 and the yiedable and flexible pressure members 199 are urged by the ice cream sandwiches 36-37, as the latter are moved along the horizontal trackway 49, into engagement with the top and bottom end-sealing panels 45 and 46—46, respectively, which are thereby urged into intimate engagement with the convex inner wall surfaces 208 of the metallic cooling members 207 to effect a firm and intimate cooling engagement between the heat-sealed top and bottom end-sealing panels 45 and 46—46 and the convex inner wall surfaces 208 of the metallic cooling members 207. The thus heat-sealed and cooled top and bottom end-sealing panels 45 and 46—46 then travel along the top and bottom edges 202 and 203, respectively, of the yieldable and flexible pressure members 199 and slide off the free end portions 206 thereof (FIG. 29).

The thus wrapped and heat-sealed and cooled ice cream sandwiches 36-37 are then moved along the horizontal trackway 49 by the succeeding or following row of ice cream sandwiches 36 (FIG. 10), to the delivery end 121 thereof (FIG. 3) from which they may be deposited in a suitable receptacle or onto a take-away conveyor, or otherwise handled, for packaging and storage, or other disposition.

As the ice cream sandwiches 36 with their wrapper sheets 37 thereon are successively moved off the head 53 of the elevator device 51-52-53 onto the horizontal trackway 49, they pass under the arms 125—125 of the ice cream sandwich hold-down device 122 and are prevented thereby from becoming jammed or moving upwardly off the horizontal trackway 49 (FIGS. 1, 2 and 6) as the row of ice cream sandwiches with their wrapper sheets 37 and thereon continues to move forwardly.

As the ice cream sandwich 36 with its wrapper sheet 37 thereon moves upwardly on the elevator head 53 in the elevator guideway 56, and between the combination elevator guide rails and folding members 57—57, the inner or forward downfolded panel 58 of the wrapper sheet 37 engages the inwardly extending upper end portions of the spring-biased wrapped sheet hold-down members 181 which prevent the downfolded panel 58 of the wrapper sheet 37 from becoming jammed between the elevator head 53 and the adjacent combination elevator guide and folding member 57 (FIGS. 3 and 3A).

It has been found in the practice of the present invention that the new wrapping machine 47 has the desirable advantages and characteristics hereinbefore pointed out and is capable of continued high speed production of the fully wrapped, heat-sealed and cooled ice cream sandwiches at rates in the order of 160 per minute while, at the same time, effecting a distinct economy in the amount of the flexible, coated, heat-sealable wrapping material 37 which is required to wrap the body of each ice cream sandwich.

Thus, it has been found that the amount of the wrapping material required for each individual wrapper sheet 37 is in the order of 8 percent less than the total of the length and thickness of the sandwich to be wrapped. This economy in the amount of the wrapping material required is due in substantial part to the fact that the new wrapping machine heat seals the top and bottom end-sealing panels together at the ends of the ice cream sandwich rather than heat-sealing the bottom panels together, as has been customary heretofore in the art.

It has further been found in the use of the new wrapping machine that it is possible to shorten the vertical stroke of the elevator device 51 to a relatively short vertical stroke of approximately 5 ¾ inch as compared to the much longer vertical stroke of approximately 9 ⅛ as in the elevator device of a leading prior art ice cream sandwich wrapping machine due, in substantial part, to the fact that 1 of the folding operations is performed during the upward vertical stroke of the elevator device 51 (FIG, 18), whereas in the aforesaid leading prior art ice cream sandwich wrapping machine most of the folding operations were performed during the relatively long upward stroke of the elevator device. In this manner the new wrapping machine 47 substantially reduces the amount of breakage of the wafers or cookies embodied in the ice cream sandwich and reduces the number of moving parts embodied in the new wrapping machine while, at the same time, having the other desirable advantages and characteristics hereinbefore referred to.

It will thus be seen from the foregoing description, considered in conjunction with the accompanying drawings, that the present invention provides a new and improved ice cream sandwich wrapping machine having the desirable advantages and characteristics and accomplishing its intended objects, including those hereinbefore pointed out and others which are inherent in the invention.

I claim:

1. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including
  (1) an input end; and
  (2) a delivery end; and having
  (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surfaces of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the said input end to the said delivery end thereof;

(h) means for reciprocably operating the said combination pusher and folding device in timed relationship with the vertical and reciprocating movement of the said elevator device;

(i) a plurality of means coacting with the said combinational pusher and folding device for sequentially folding the said side panels, the said bottom panels, the said end panels, and the said end-sealing panels of the said wrapper sheet folded into position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway at the sides thereof for heat-sealing the said top and bottom end-sealing panels of the said wrapper sheet together.

2. A wrapping machine for wrapping and folding a wrapper sheet of heat-sealable flexible coated wrapping material about the body of an ice cream sandwich, said wrapper sheet including a top panel which is foldable over the upper or top surface of the said ice cream side panels against the sides of the ice cream sandwich; first and second bottom panels foldable under the bottom surface of the said ice cream sandwich; and top and bottom end-sealing panels foldable against each other and over the said end panels; said wrapping machine comprising:

(a) a supporting frame;

(b) a generally horizontal trackway on the said supporting frame including
  (1) an input end; and
  (2) a delivery end; and
  (3) an upper surface along which the said ice cream sandwich with its said wrapper sheet thereon is adapted to be moved from the said input end to the said delivery end of the said horizontal trackway;

(c) a vertically movable and reciprocating elevator device mounted on the said supporting frame at the input end of and below the said horizontal trackway and adapted to elevate the said ice cream sandwich with its wrapper sheet thereon from a point below the said horizontal trackway to the said upper surface of the said horizontal trackway;

(d) feed roll means for supporting a roll of the said web of heat-sealable flexible coated wrapping material;

(e) web-advancing means for advancing the said web of the said heat-sealable flexible coated wrapping material from the said feed roll means along a path below the said horizontal trackway toward the said upper or top surface of an ice cream sandwich disposed on the said elevator device;

(f) web-severing means in the path of movement of the said web for severing an individual wrapper sheet section of the said flexible coated wrapper material from the said web thereof and thereby forming an individual wrapper sheet for the said ice cream sandwich;

(g) means for operating and vertically reciprocating the said elevator device and for moving the said elevator device with an ice cream sandwich and its said wrapper sheet thereon upwardly toward the said horizontal trackway and thereby forming the said top panel over the said upper or top surface of the said ice cream sandwich;

(h) a horizontally reciprocable combination pusher and folding device slidably and reciprocably mounted on the said supporting frame at the input end of the said elevator device for slidably moving the said ice cream sandwich with its said wrapper sheet thereon off the said elevator device onto the said upper surface of the said horizontal trackway and for advancing a horizontal row of ice cream sandwiches with their wrapper sheets thereon along the upper surface of the said horizontal trackway from the said input end to the delivery end of the said horizontal trackway;

(i) operating means for reciprocably operating the said combination pusher and folding device in timed relationship with the vertical reciprocating movement of the said elevator device;

(j) first folding means including (1) first and second vertically extending generally parallel combination elevator guide wall and folding members cooperating with the said elevator device for downfolding the said side panels and the said bottom panels of the said wrapper sheet downwardly along the side walls of the said ice cream sandwich as the ice cream sandwich is elevated by the said elevator device up to the upper surface of the said horzontal trackway;

(k) second folding means including the said elevator device, the said first and second combination elevator guide and folding members, and the said combination pusher and folding device for sequentially infolding the said first and second bottom panels under the bottom surface of the said ice cream sandwich as the said ice cream sandwich is slidably moved off the said elevator device onto the said horizontal trackway by the said combination pusher and folding device;

(l) third folding means cooperating with the said combination pusher and folding device for partially infolding the said first end panels against the end walls of the said ice cream sandwich as the said ice cream sandwich is slidably moved off the said elevator device and onto the said upper surface of the said horizontal trackway by the said combination pusher and folding device;

(m) fourth folding means cooperating with the said combinational pusher and folding device for completing the infolding of the said first end panels and for infolding the said second end panels against the end walls of the said ice cream sandwich as the said ice cream sandwich is moved off the said elevator device and along the said horizontal trackway by the said combination pusher and folding device;

(n) additional folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combination pusher and folding device; and (o) heat-sealing means disposed at a point along the said upper surface of the said horizontal trackway at the sides thereof between the said additional folding means and the said delivery end of the said horizontal trackway for heat-sealing the said top and bottom end-sealing panels together.

3. A wrapping machine as defined in claim 2 in which the said additional folding means includes (a) fifth folding means on the said horizontal trackway for infolding the said bottom endsealing panels upwardly against the said end panels as the said ice cream sandwich is slidably moved over and along the upper surface of the said horizontal trackway by the said combination pusher and folding device; and (b) sixth folding means on the said horizontal trackway between the said fifth folding means and the said heat-sealing means for downfolding the said top end-sealing panels against the said infolded and upfolded bottom end-sealing panels as the said ice cream sandwich is moved over and along the said horizontal trackway by the said combination pusher and folding device.

4. A wrapping machine as defined in claim 2 in which the said wrapper sheet includes a pair of the said bottom endsealing panels and in which the said additional folding means includes (a) fifth folding means on the said horizontal trackway for infolding the said pair of bottom end-sealing panels inwardly and upwardly against the said end panels as the ice cream sandwich is slidably moved over and along the upper surface of the said horizontal trackway by the said combination pusher and folding device; and (b) sixth folding means on the said horizontal trackway between the said fifth folding means and the said heat-sealing means for infolding and downfolding the said top end-sealing panels against the said bottom end-sealing panels as the said ice cream sandwich is slidably moved over and along the said horizontal trackway by the said combination pusher and folding device.

5. A wrapping machine as defined in claim 2 in which the said first end panels are the trailing end panels and the said second end panels are the leading end panels of the said wrapper sheet relative to the direction of movement of the ice cream sandwich over the upper surface of the said horizontal trackway from the input end toward the delivery end thereof, and in which the third folding means includes (a) first folding shoe members carried by and movable with the said combination pusher and folding device and movable thereby into folding engagement with the said first and trailing end panels for infolding the said first and trailing end panels against the end walls of the said ice cream sandwich as the said ice cream sandwich is slidably moved off the said elevator device and onto the upper surface of the said horizontal trackway by the said combination pusher and folding device.

6. A wrapping machine as defined in claim 5 in which the said additional folding means includes (a) second and movable folding shoe members carried by and movable with the said combination pusher and folding device and engageable with the said second and leading end panels; and (b) third folding shoe members stationarily mounted on the said horizontal trackway and cooperating with the said second and movable folding shoe members for infolding the said second and leading end panels against the end walls of the said ice cream sandwich as the ice cream sandwich is slidably moved along the upper surface of the said horizontal trackway by the said combination pusher and folding device and the said second and movable folding shoe members are moved into coacting folding relationship with the said third and stationary folding shoe members.

7. A wrapping machine as defined in claim 6 in which (a) the said means for operating the said combination pusher and folding device includes (1) means for slidably and horizontally reciprocating the said combination pusher and folding device and the said first and second folding shoe members carried thereby toward and away from the said elevator device and an ice cream sandwich disposed thereon.

8. A wrapping machine for wrapping and folding an individual wrapper sheet of heat-sealable flexible coated wrapping material about the body of an ice cream sandwich, said wrapper sheet including a top panel foldable over the upper or top surface of the said ice cream sandwich; side panels foldable against the sides of the said ice cream sandwich; first and second bottom panels foldable against the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including (1) an input end; and (2) a delivery end; and having (3) an upper surface along which the said ice cream sandwich is adapted to be moved from the said input end to the said delivery end to the said horizontal trackway;

(c) a vertically movable and reciprocating elevator device mounted on the said supporting frame at the input end of and adjacent the said horizontal trackway and including (1) an elevator head adapted to have an ice cream sandwich deposited thereon and to elevate the said ice cream sandwich from a point below the said horizontal trackway to the level of the said upper surfae of the said horizontal trackway;

(d) means for depositing the said wrapper sheet of the said heat-sealable flexible coated wrapping material in a substantially flat position over the said upper or top surface of the said ice cream sandwich disposed on the said elevator head;

(e) a vertically extending elevator guidway through which the said elevator head and the said ice cream sandwich with its wrapper sheet thereon are movable during the vertical reciprocating movement of the said elevator device and including (1) generally parallel vertically extending combination side wall elevator guide and folding members providing a guideway for the said elevator head of the said elevator device and providing first folding means for engaging and downfolding the said side panels and the said bottom panels of the said wrapper sheet along the sides of the said ice cream sandwich as the ice cream sandwich is elevated by the said elevator head from a point below the said horizontal trackway to the level of the upper surface of the said horizontal trackway;

(f) means for vertically and reciprocably operating the said elevator device and the said elevator head thereof and for moving the said elevator head with the said ice cream sandwich and its wrapper sheet thereon disposed on the said elevator head upwardly to the said upper surface of the said horizontal trackway;

(g) a combination pusher and folding device slidably and reciprocably mounted on the said supporting frame at the said input end of the said horizontal trackway and adjacent the said elevator device for slidably pushing the said ice cream sandwich with its wrapper sheet thereon off the said elevator head and onto the said upper surface of the said horizontal trackway and for pushing a horizontally extending row of the said ice cream sandwiches with their wrapper sheets thereon along the upper surface of the said horizontal trackway from the said input end to the said delivery end thereof;

(h) means for slidably and reciprocably operating the said combination pusher and folding device in timed relationship with the vertical reciprocating movement of the said elevator device;

(i) the said elevator head cooperating with the said combination pusher and folding device to provide second folding means for infolding the said first bottom panels under the bottom surface of the said ice cream sandwich as the ice cream sandwich with its wrapper sheet thereon is slidably pushed off the said elevator head by the said combination pusher and folding device;

(j) additional folding means for sequentially folding the said end panels and the said end-sealing panels of the said wrapper sheet into folded position against the body of the said ice cream sandwich as the said ice cream sandwich with its wrapper sheet thereon is slidably moved by the said combination pusher and folding device off the said elevator head and along the upper surface of the said horizontal trackway; and (k) head-sealing means disposed at a point on the said upper surface of the said horizontal trackway for heat-sealing the said top and bottom end-sealing panels together.

9. A wrapping machine as defined in claim 8 in which (a) one of the said generally parallel vertically extending combination elevator side wall guide and folding members cooperates with the said combination pusher and folding device to infold the said second bottom panel under and against the bottom surface of the said ice cream sandwich as the said ice cream sandwich with its wrapper sheet thereon is slidably pushed off the said elevator head onto the said horizontal trackway by the said pusher combination and folding device.

10. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the (b) said horizontal trackway thereon, and inclucing (1) an input end;

(2) a delivery end, and having (3) an upper surface along which the said ice cream sandwiches with their wrapper sheets thereon are adapted to be sequentially moved from the said input end to the said delivery end of the said trackway;

(4) generally parallel marginal side edge portions on opposite sides of the said upper surface;

(c) a vertically reciprocating elevator device mounted on the said supporting frame at the input end of the said trackway and including (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal trackway;

(f) a vertically extending guideway for the said head of the said elevator device including (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device;

(k) third folding means including (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(4) fourth folding means including (1) second folding shoe members stationarily mounted on the said horizontal trackway; and (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway, to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device; and (o) heat-sealing means disposed on the said horizontal trackway at the said marginal edge portions thereof and between the said sixth folding means and the said delivery end of the said horizontal trackway for heat-sealing the said first and second end-sealing panels together.

11. A wrapping machine as defined in claim 10 in which (a) the said third folding shoe members are rigidly attached to and are movable with the said combination pusher and folding device in horizontally spaced relationship thereon; and in which each of the said first folding shoe members has (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device.

12. A wrapping machine as defined in claim 11 in which (a) the said combination pusher and folding device includes (1) a pusher head extending transversely relative to the said horizontal trackway and including (a) end portions (b) having the said third folding shoe members rigidly attached thereto in upright position; and (c) a horizontally extending combination pusher and supporting plate member disposed forwardly of the said pusher head and having the said first folding shoe members rigidly attached thereto in upright and horizontally spaced relationship relative to and outwardly of the said third folding shoe members.

13. A wrapping machine for folding and wrapping a wrapper sheet of flexible heat-sealable coated wrapping material which includes a top panel; first and second bottom panels; first and second side panels; first and second end panels; and first and second end-sealing panels; about the top, bottom, sides and end walls of an ice cream sandwich, said wrapping machine comprising:

(a) a supporting frame;

(b) a generally horizontally extending trackway on the said supporting frame including (1) an input end;

(2) a delivery end; and having (3) a generally horizontally extending upper surface extending from the said input end to the delivery end of the said trackway;

(c) elevator means arranged adjacent the said input end of the said generally horizontally extending trackway for sequentially elevating ice cream sandwiches each with a wrapper sheet thereon laid generally flat over and in coplanar relationship with the top surface of the said ice cream sandwich from a point below the said horizontal trackway up to the level of the said upper surface of the said trackway;

(d) the said elevator means including (1) an elevator head;

(2) first folding means cooperating with the said elevator head for downfolding the said side and bottom panels of the said wrapper sheet in coplanar relationship downwardly along the sides of the ice cream sandwich as the ice cream sandwich with its wrapper sheet thereon is elevated by the said elevator head to the level of the said upper surface of the said horizontal trackway at the said input end thereof;

(e) means for cyclically reciprocating the said elevator means in a vertical plane;

(f) combination pusher and folding means for slidably and sequentially pushing the said ice cream sandwiches with their wrapper sheets thereon, and with the said side and bottom panels thereof downfolded in coplanar relationship, off the said elevator head onto the said upper surface of the said trackway at the said input end thereof;

(g) operating means for cyclically reciprocating the said combination pusher and folding means in a generally horizontal plane toward and away from the said elevator head;

(h) the said combination pusher and folding means including (1) second folding means cooperating with the said elevator head for infolding the said first bottom panel under the bottom surface of the said ice cream sandwich as the said ice cream sandwich is slidably pushed off the said elevator head onto the said upper surface of the said trackway by the said combination pusher and folding means;

(i) the said first folding means including (1) a folding member cooperating with the said combination pusher and folding means and with the said elevator head for infolding the said second bottom panel under the bottom surface of the said ice cream sandwich as the ice cream sandwich with its wrapper sheet thereon is slidably pushed off the said elevator head onto the upper surface of the said trackway by the said combination pusher and folding means;

(j) the said combination pusher and folding means including (1) first end panel folding means for partially infolding the said first end panels against the end walls of the said ice cream sandwich as the said ice cream sandwich with its wrapper sheet thereon is slidably pushed off the said elevator head onto the upper surface of the said trackway by the said combination pusher and folding means;

(k) second end panel folding means including (1) first and stationary end panel folding shoe members stationarily mounted on the upper surface of the said trackway adjacent the said elevator head; and (2) second folding shoe members carried by and movable with and by the said combination pusher and folding means into coacting folding relationship with the said first and stationary end panel folding shoe members on the said horizontal trackway for completing the infolding of the said first end panels and for infolding the said second end panels against the end walls of the said ice cream sandwich;

(l) first end-sealing panel folding means stationarily mounted on the said horizontal trackway for infolding the said first end-sealing panels against the said end panels of the said ice cream sandwich as the ice cream sandwich is slidably pushed along the said trackway by the coaction of the said combination pusher and folding means and succeeding or following ice cream sandwiches;

(m) second end-sealing panel folding means stationarily mounted on the said trackway for infolding the said second end-sealing panels against the said first end-sealing panels as the said ice cream sandwich is slidably pushed along the said trackway past the said first end-sealing panel folding means by the coaction of the said combination pusher and folding means and the succeeding or following ice cream sandwiches; and (n) heat-sealing means on the said trackway at the sides thereof and between the said second end-sealing panel folding means and the said delivery end of the said trackway for heat-sealing the said first and second end-sealing panels together.

14. A wrapping machine as defined in claim 13 in which (a) the said combination pusher and folding means includes (1) a slidable and reciprocating carriage cyclically movable with the said combination pusher and folding means toward and away from the said elevator head, and including (b) a combination pusher and supporting plate member having the said first end panel folding means rigidly mounted thereon and movable therewith; and in which (c) the said combination pusher and folding means includes (1) a pusher head disposed above and movable over the said combination pusher and supporting plate member and having the said second end panel folding shoe members rigidly mounted thereon and movable therewith.

15. A wrapping machine for wrapping a wrapper sheet of flexible coated heat-sealable material which includes a top panel, bottom panels, first and second end panels and first and second end-sealing panels about an ice cream sandwich which includes generally parallel top and bottom surfaces, generally parallel side walls, and generally parallel end walls, said wrapping machine comprising:

(a) a supporting frame;

(b) a generally horizontally extending trackway on the said supporting frame and including (1) an input end; and (2) a delivery end;

(c) means for sequentially positioning ice cream sandwiches with a wrapper sheet thereon and with the top panel thereof extending over the across the top surface of the ice cream sandwich at the input end of the said trackway;

(d) a combination pusher and folding device reciprocably mounted on the said supporting frame adjacent the said input end thereof for reciprocating generally horizontal movement toward and away from the said input end of the said trackway in forward and rearward strokes, respectively, and including (1) pusher means for slidably moving the said ice cream sandwiches with their wrapper sheets thereon sequentially onto and along the said horizontal trackway;

(e) means for reciprocably operating the said combination pusher and folding device in its forward and rearward strokes in a generally horizontal plane;

(f) first bottom panel infolding folding means cooperating with the said pusher means for infolding the said bottom panels under the said bottom surface of the said ice cream sandwich;

(g) the said combination pusher and folding device including (1) first end panel folding means carried by and cooperating with the said pusher means on each forward stroke of the said combination pusher and folding device to infold the said first end panels against the end walls of the said ice cream sandwich;

(h) second end panel folding means including (1) stationary second end panel folding members stationarily mounted on the said horizontal trackway; and (2) second and movable end panel folding members carried by and movable with the said combination pusher and folding device and coacting with the said stationary second end panel folding members to infold the said second end panels against the said end walls of the ice cream sandwich as the ice cream sandwich is slidably moved along the said trackway from the input end thereof toward the said delivery end thereof by the said pusher means;

(i) first stationary end-sealing panel folding means stationarily mounted on the said trackway between the said stationary second end-panel folding members and the delivery end of the said trackway for infolding the said first end-sealing panels against the said end panels on the said ice cream sandwich;

(j) second stationary end-sealing panel folding means stationarily mounted on the said trackway between the said first stationary end-sealing panels and the said delivery end of the said trackway for infolding the said second end-sealing panels against the said first end-sealing panels as the ice cream sandwiches are sequentially moved along the said trackway in a horizontal row thereof by the said pusher means; and (k) heat-sealing means on the said trackway between the said second stationary end-sealing panel folding means and the said delivery end of the said trackway for heat-sealing the said end-sealing panels together as the ice cream sandwiches are slidably and sequentially moved along the said trackway by the said pusher means and a horizontal row of the said ice cream sandwiches.

16. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of th said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including (1) an input end; and (2) a delivery end; and having (3) an upper surface along which the said ice cream sandwich with the said wrapper sheet thereon is adapted to be moved from the said input end to the said delivery end of the said horizontal trackway;

(c) a plurality of means for folding the said panels into folded position on and relative to the said body of the said ice cream sandwich;

(d) means for moving the said ice cream sandwich along the said generally horizontal trackway from the said input end to the said delivery end thereof;

(e) heat-sealing means arranged along the said generally horizontal trackway between the said input end and the said delivery end thereof for heat-sealing the said top and bottom end-sealing panels together as the wrapped ice cream sandwich is moved along the said generally horizontal trackway; and (f) yieldable and flexible pressure members on the said generally horizontal trackway engageable by the said ice cream sandwich as it is moved along the said generally horizontal trackway for urging the said top and bottom end-sealing panels together and into intimate heat-sealing engagement with the said heat-sealing means.

17. A wrapping machine as defined in claim 16 in which (a) the said generally horizontal trackway includes
(1) outer marginal edge portions; and in which (b) the said heat-sealing means includes
(1) a pair of metallic heat-sealing members mounted on the said outer marginal edge portions of the said generally horizontal trackway; and in which (c) the said yieldable and flexible pressure means comprises:
(1) a pair of yieldable and flexible pressure members mounted on the said generally horizontal trackway and extending lengthwise thereof inwardly of the said metallic heat-sealing members and urged by the said wrapped ice cream sandwich into engagement with the said top and bottom end-sealing panels and forcing the said top and bottom end-sealing panels into engagement with each other and into intimate heat-sealing engagement with the said metallic heat-sealing members.

18. A wrapping machine as defined in claim 17 in which (a) each of the said yieldable and flexible pressure members includes
(1) a front end portion; and
(2) a rear end portions; relative to the direction of movement of the said ice cream sandwich over the said generally horizontal trackway from the said input end to the said delivery end thereof; and in which the said wrapping machine includes (b) means for rigidly mounting the said front end portion of each of the said yieldable and flexible pressure members on the said generally horizontal trackway; and in which (c) the rear end portion of each of the said yieldable and flexible pressure members is free and flexible to enable the said yieldable and flexible pressure members to be yieldably flexed into engagement with the said metallic heat-sealing members by engagement of the said ice cream sandwich with the said yieldable and flexible pressure members as the said ice cream sandwich is moved along the said generally horizontal trackway.

19. A wrapping machine as defined in claim 18 in which (a) each of the said metallic heat-sealing members has
(1) a convex inner wall surface facing toward one of the said yieldable and flexible pressure members and against which the said yieldable and flexible pressure members force to the said top and bottom end-sealing panels into intimate heat-sealing engagement.

20. A wrapping machine as defined in claim 17 which includes (a) cooling means including
(1) a pair of metallic heat-conductive cooling members mounted on the said outer marginal edge portions of the said generally horizontal trackway between the said metallic heat-sealing members and the said delivery end of the said trackway; and in which (b) the said yieldable and flexible pressure members are urged by engagement of the said ice cream sandwich into engagement with the heat-sealed top and bottom end-sealing panels and force the said heat-sealed top and bottom end-sealing panels into intimate cooling engagement with the said metallic heat-conductive cooling members as the said ice cream sandwich is moved along the said generally horizontal trackway from the said heat-sealing means toward the said delivery end thereof.

21. A wrapping machine as defined in claim 20 in which (a) each of the said metallic heat-conductive cooling members has
(1) a convex inner wall surface facing toward one of the said yieldable and flexible pressure members and against which the said yieldable and flexible pressure members force the said heat-sealed top and bottom end-sealing panels into intimate cooling engagement.

22. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including
(1) an input en; and
(2) a delivery end; and having
(3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice ceam andwiches with their wrapper sheets thereon along the upper surface of the said horizontal trackway from the said input end to the said delivery end thereof;

(h) means for reciprocably operating the said combination pusher and folding device in timed relationship with the vertical and reciprocating movement of the said elevator device;

(i) a plurality of means coacting with the said combination pusher and folding device for sequentially folding the said side panels, the said bottom panels, the said end panels, and the said end-sealing panels of the said wrapper sheet into folded position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway for heat-sealing the said top and bottom end-sealing panels of the said wrapper sheet together; and (k) cooling means mounted on the said horizontal trackway between the said heat-sealing means and the said delivery end of the said horizontal trackway and engageable by the heat-sealed top and bottom end-sealing panels for cooling the said heat-sealed top and bottom end panels as they are slidably moved along the said horizontal trackway by a row of the said ice cream sandwiches from the said heat-sealing means to the delivery end of the said horizontal trackway.

23. A wrapping machine for wrapping and folding a wrapper sheet of heat-sealable flexible coated wrapping material about the body of an ice cream sandwich, said wrapper sheet including a top panel which is foldable over the upper or top surface of the said ice cream side panels foldable against the sides of the ice cream sandwich; first and second bottom panels foldable under the bottom surface of the said ice cream sandwich; and top and bottom end-sealing panels foldable against each other and over the said end panels; said wrapping machine comprising:

(a) a supporting frame;

(b) a generally horizontal trackway on the said supporting frame including
  (1) an input end; and
  (2) a delivery end; and
  (3) an upper surface along which the said ice cream sandwich with its said wrapper sheet thereon is adapted to be moved from the said input end to the said delivery end of the said horizontal trackway;

(c) a vertically movable and reciprocating elevator device mounted on the said supporting frame at the input end of and below the said horizontal trackway and adapted to elevate the said ice cream sandwich with its wrapper sheet thereon from a point below the said horizontal trackway to the said upper surface of the said horizontal trackway;

(d) a feed roll means for supporting a roll of the said web of heat-sealable flexible coated wrapping material;

(e) web-advancing means for advancing the said web of the said heat-sealable flexible coated wrapping material from the said feed roll means along a path below the said horizontal trackway toward the said upper or top surface of an ice cream sandwich disposed on the said elevator device;

(f) web-servering means in the path of movement of the said web for severing an individual wrapper sheet section of the said flexible coated wrapper material from the said web thereof and thereby forming an individual wrapper sheet for the said ice cream sandwich; (g) means for operating and vertically reciprocating the said elevator device and for moving the said elevator device with an ice cream sandwich and its said wrapper sheet thereon upwardly toward the said horizontal trackway and thereby forming the said top panel over the said upper or top surface of the ice cream sandwich;

(h) a horizontally reciprocable combination pusher and folding device slidably and reciprocably mounted on the said supporting frame at the input end of the said elevator device for slidably moving the said ice cream sandwich with its said wrapper sheet thereon off the said elevator device onto the said upper surface of the said horizontal trackway and for advancing a horizontal row of ice cream sandwiches with their wrapper sheets thereon along the upper surface of the said horizontal trackway from the said input end to the delivery end of the said horizontal trackway;

(i) operating means for reciprocably operating the said combination pusher and folding device in timed relationship with the vertical reciprocating movement of the said elevator device;

(j) first folding means including
  (1) first and second vertically extending generally parallel combination elevator guide wall and folding members cooperating with the said elevator device for downfolding the said side panels and the said bottom panels of the said wrapper sheet downwardly along the side walls of the said ice cream sandwich as the ice cream sandwich is elevated by the said elevator device up to the upper surface of the said horizontal trackway;

(k) second folding means including the said elevator device, the said first and second combination elevator guide and folding members, and the said combination pusher and folding device for sequentially infolding the said first and second bottom panels under the bottom surface of the said ice cream sandwich as the said ice cream sandwich is slidably moved off the said elevator device onto the said horizontal trackway by the said combination pusher and folding device;

(l) third folding means cooperating with the said combination pusher and folding device for infolding the said first end panels against the end walls of the said ice cream sandwich as the said ice cream sandwich is slidably moved off the said elevator device and onto the said upper surface of the said horizontal trackway by the said combination pusher and folding device;

(m) fourth folding means cooperating with the said combination pusher and folding device for infolding the said second end panels against the end walls of the said ice cream sandwich as the said ice cream sandwich is moved off the said elevator device and along the said horizontal trackway by the said combination pusher and folding device;

(n) additional folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combination pusher and folding device;

(o) heat-sealing means disposed at a point along the said upper surface of the said horizontal trackway between the said additional folding means and the said delivery end of the said horizontal trackway for heat-sealing the said top and bottom end-sealing panels together;

(p) the said third folding means including (1) first folding shoe members carried by and movable with the said combination pusher and folding device and movable thereby into folding engagement with the said first and trailing end panels for infolding the said first and trailing end panels against the end walls of the said ice cream sandwich as the said ice cream sandwich is slidably moved off the said elevator device and onto the upper surface of the said horizontal trackway by the said combination pusher and folding device;

(g) the said fourth folding means including (1) second and movable folding shoe members carried by and movable with the said combination pusher and folding device and engageable with the said second and leading end panels;

(2) third folding shoe members stationarily mounted on the said horizontal trackway and cooperating with the said second and movable folding shoe members for infolding the said second and leading end panels against the end walls of the said ice cream sandwich as the ice cream sandwich is slidably moved along the upper surface of the said horizontal trackway by the said combination pusher and folding device and the said second and movable folding shoe members are moved into coacting folding relationship with the said thrd and stationary folding shoe members;

(r) each of the said second folding shoe members including (1) a vertically extending body having (2) a front end portion; and (3) a rear end portion; and having therein (4) a generally horizontally extending slot extending inwardly from the said front end portion thereof toward the said rear end portion thereof;

(s) each of the said third folding shoe members including (1) an upright body portion stationarily mounted on the said horizontal trackway and including (a) an inner vertically extending inner side wall surface facing laterally toward the said horizontal trackway;

(b) a horizontally extending shelf portion on the said vertically extending inner side wall surface of the said upright body portion of each of the said second folding shoe members and projecting inwardly therefrom and having an inner wall surface facing toward the said horizontal trackway; and (t) the said horizontal shelf portion of each of the said third folding shoe members being adapted to enter into the said horizontally extending slot in one of the said second folding shoe members and the said inner wall surfaces of the said second folding shoe members cooperating with the inner wall surfaces of the said horizontally extending shelf portions of the said third folding shoe members to provide vertically extending folding surfaces for infolding the said second and leading end panels against the end walls of the ice cream sandwich as the said second folding shoe members are moved over the said horizontal trackway by the said combination pusher and folding device and the said horizontally extending sheld portions of the said third folding shoe members enter into the said generally horizontally extending slots in the said second folding shoe members.

24. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the (b) said horizontal trackway thereon, and including (1) an input end;

(2) a delivery end; and having (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coacted wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal trackway;

(f) a vertically extending guideway for the said upper head of the said elevator device including (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon for infolding the said second bottom panel under the bottom surface of the said ice cream sandwich as the said ice cream sandwich is slidably pushed off the said elevator head by the said combination pusher and folding device;

(k) third folding means including (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including (1) second folding shoe members stationarily mounted on the said horizontal trackway; and (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway to infold the said second end panels against the end walls of the said ice cream sandwich.

(m) fifth folding means on the said horizontal trackway for infolding the said irst end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said ice cream sandwich as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-panels together; (p) the third folding shoe members being rigidly attached to and movable with the said combination pusher and folding device in horizontally spaced relationship thereon;

(q) each of the said first folding shoe members having (1) a forwardly extending tapered front end or nose portion which is adapted to engage and infold one of the aid first end panels toward the end walls of the said ice cream sandwich as the said ice cream sandwich is slidably moved off the said elevator head and along the said horizontal trackway by the said combination pusher and folding device;

(r) the said combination pusher and folding device including (1) a pusher head extending transversely relative to the said horizontal trackway and including a. end portions b. having the said third folding shoe members rigidly attached thereto in upright position; and c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) each of the said third folding shoe members including a body portion having a vertically extending inner wall surface and including
(1) front and rear end portions;

(t) each of the said body portions having formed therein
(1) a horizontally extending slot extending partially therethrough from the said front end portion toward the said rear end portion thereof;

(u) each of the said second folding shoe members including an upright body portion having a vertically extending inner wall surface including top and bottom and front and rear edge portions and having formed on the said inner wall surface between the said top and bottom edge portions thereof and extending from a point between the said front and rear edge portions thereof to the said front edge portion thereof
(1) a horizontally extending shelf portion which is adapted to enter into the said horizontally extending slot in one of the said third folding shoe members and having
(2) an inner wall surface cooperating with the said vertically extending inner wall surface of one of the said third folding shoe members to provide a folding surface for infolding the said second end panels against the end walls of the said ice cream sandwich as the said ice cream sandwich is moved along the said horizontal trackway by the said pusher head.

25. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; said panels foldable against the sides of the ice cream sandwich; first and second bottom panels foldable against the bottom surface of the ice cream sandwich; first and second end panels folable over the end walls of the ice cream sandwich; first and second end-sealing panels foldable one against the other and over the said end panels, said wrapping machine comprising:

(a) a supporting frame; having the
(b) said horizontal trackway thereon, and including
(1) an input end;
(2) a delivery end; and having
(3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including
(1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal tackway;

(f) a vertically extending guideway for the said upper head of the said elevator device including
(1) a pair of horizontally spaced generally parallel vertically extending combination elevator guide and folding members providing first folding means cooperating with the said elevator head for down-folding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device;

(k) third folding means including
(1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including
(1) second folding shoe members stationarily mounted on the said horizontal trackway; and (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway to infold the said second end panels against the end walls of the said ice cream sandwich;

(m) fifth folding means on the said horizontal trackway for infolding the said first end-sealing panels against the said end panels as the ice cream sandiwch is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said ice cream sandwich as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the third folding shoe members being rigidly attached to and movable with the said combination pusher and folding device in horizontally spaced relationship thereon;

(q) each of the said first folding shoe members having (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including (1) a pusher head extending transversely relative to the said horizontal trackway and including a. end portions b. having the said third folding shoe members rigidly attached thereto in upright position; and c. a horizontally extending combination pusher and supporting plate member disposed forwardly of the said pusher head and having the said first folding shoe members rigidly attached thereto in upright and horizontally spaced relationship relative to and outwardly of the said third folding shoe members; and (s) the said fifth folding means including (1) first stationary folding members mounted on the upper surface of the said horizontal trackway between the said second folding shoe members and the said heat-sealing means and adapted to engage and infold the said first and outwardly extending end-sealing panels against the said end panels as the said ice cream sandwich with its wrapper sheet thereon is moved along the upper surface of the said horizontal trackway by the said pusher device in cooperation with a horizontal row of succeeding or following ice cream sandwiches moved by the said pusher head.

26. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the (b) said horizontal trackway thereon, and including (1) an input end;

(2) a delivery end; and having (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said heat for moving the said elevator head with one of the said ice cream sandwiches and its wrapper sheet thereon upwardly to the level of the upper surface of the said horizontal trackway;

(f) a vertically extending guideway for the said upper head of the said elevator device including (1) a pair of horizontally spaced generally parallel vertically extending combination elevator guide and folding members providing first folding means cooperating with the said elevator head for down-folding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device;

(k) third folding means including
  (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including
  (1) second folding shoe members stationarily mounted on the said horizontal trackway; and
  (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said ice cream sandwich as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having
  (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including
  (1) a pusher head extending transversely relative to the said horizontal trackway and including
    a. end portions;
    b. having the said third folding shoe members rigidly attached thereto in upright position; and
    c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) the said fifth folding means including
  (1) first stationary folding members mounted on the upper surface of the said horizontal trackway between the said second folding shoe members and the said heat-sealing means and adapted to engage and infold the said first and outwardly extending end-sealing panels against the said end panels as the said ice cream sandwich with its wrapper sheet thereon is moved along the upper surface of the said horizontal trackway by the said pusher device in cooperation with a horizontal row of succeeding or following ice cream sandwiches moved by the said pusher head;

(t) the said sixth folding means including
  (1) second stationary folding means mounted on the upper surface of the said horizontal trackway between the said first stationary folding shoe members and the said heat-sealing means and adapted to engage and infold the outwardly extending second end-sealing panels against the said first end-sealing panels as the said ice cream sandwich is moved over the upper surface of the said horizontal trackway by the said pusher head in cooperation with a horizontal row of successive or following ice cream sandwiches.

27. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including
  (1) an input end; and
  (2) a delivery end; and having
  (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the said input end to the said delivery end thereof;

(h) means for reciprocably operating the said combination pusher and folding device in timed relationship with the vertical and reciprocating movement of the said elevator device;

(i) a plurality of means coacting with the said combination pusher and folding device for sequentially folding the said side panels, the said bottom panels, the said end panels, and the said end-sealing panels of the said wrapper sheet folded into position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway for heat-sealing the said top and bottom end-sealing panels of the said wrapper sheet together; and (k) a hold-down device removably mounted on the said horizontal trackway adjacent to and forwardly of the said elevator device for holding the said ice cream sandwiches down on the horizontal trackway at the said input end thereof and preventing jamming of the said ice cream sandwiches as they are slidably moved off the said elevator device and onto and along the said horizontal trackway by the said combination pusher and folding device.

28. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surfaces of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including
  (1) an input end; and
  (2) a delivery end; and having
  (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the said input end to the said delivery end thereof;

(h) means for reciprocably operating the said combination pusher and folding device in timed relationship with the vertical and reciprocating movement of the said elevator device;

(i) a plurality of means coacting with the said combinational pusher and folding device for sequentially folding the said side panels, the said bottom panels, the said end panels, and the said end-sealing panels of the said wrapper sheet into folded position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway for heat-sealing the said top and bottom end-sealing panels of the said wrapper sheet together;

(k) a hold-down device removably mounted on the said horizontal trackway adjacent to and forwardly of the said elevator device for holding the said ice cream sandwiches down on the horizontal trackway at the said input end thereof and preventing jamming of the said ice cream sandwiches as they are slidably moved off the said elevator device and onto and along the said horizontal trackway by the said combination pusher and folding device;

(1 the said hold-down device including (1) a generally flat plate member adapted to lie in a generally horizontal position over the said ice cream sandwiches as they are slidably moved off the said elevator device and onto and along the said horizontal trackway by the said combination pusher and folding device.

29. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottomm panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including (1) an input end; and (2) a delivery end; and having (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontaly recprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the said input end to the said delivery end thereof;

(h) means for reciprocably operating the said combination pusher and folding device in timed relationship with the vertical and reciprocating movement of the said elevator device;

(i) a plurality of means coacting with the said combination pusher and folding device for sequentially folding the said side panels, the said bottom panels, the said end panels, and the said end-sealing panels of the said wrapper sheet into folded position against the body of the ice cream sandwich as the ice cream sandwich is slidably moved off the said elevator device and along the said horizontal trackway by the said combination pusher and folding device;

(j) heat-sealing means diposed at a point along the said upper surface of the said horizontal trackway for heat-sealing the said top and bottom end-sealing panels of the said wrapper sheet together;

(k) a hold-down device removably mounted on the said horizontal trackway adjacent to and forwardly of the said elevator device for holding the said ice cream sandwiches down on the horizontal trackway at the said input end thereof and preventing jamming of the said ice cream sandwiches as they are slidably moved off the said elevator device and onto and along the said horizontal trackway by the said combination pusher and folding device;

(l) the said hold-down device including (1) a generally flat plate member adapted to lie in a generally horizontal position over the said ice cream sandwiches as they are slidably moved off the said elevator device and onto and along the said horizontal trackway by the said combination pusher and folding device;

(m) the said hold-down device including (1) means for removably mounting the said generally flat member on the said horizontal trackway; and (2) a handle member attached to the said generally flat plate member for manipulating the said hold-down device onto and off the said horizontal trackway.

30. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including (1) an input end; and (2) a delivery end; and having (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontaly reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the aid input end to the said delivery end thereof;

(h) means for reciprocably operating the said combination pusher and folding device in timed relationship with the vertical and reciprocating movement of the said elevator device;

(i) a plurality of means coacting with the said combination pusher folding device for sequentially folding the said side panels, the said bottom panels, the said end panels, and the said end-sealing panels of the said wrapper sheet into folded position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway for heat-sealing the said top and bottom end-sealing panels of the said wrapper sheet together; and (k) the said generally horizontal trackway including (1) a generally horizontal upper surface having thereon (2) spaced generally parallel raised rib members extending lengthwise of the said horizontal trackway relative to the direction of movement of the said ice cream sandwiches thereover and facilitating the slidable movement of the said horizontal sandwiches over the said horizontal trackway.

31. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels said wrapping machine comprising:

(a) a supporting frame; having the (b) said horizontal trackway thereon, and including (1) an input end;

(2) a delivery end; and having (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including (1) an elevator head adapted to elevate the said ice cream sandwiches one at a time from a point below the said horzontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the aid ice cream sandwiches and its wrapper sheet thereon upwardly to the level of the upper surface of the said horizontal trackway;

(f) a vertically extending guideway for the said head of the said elevator device including (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including
  (1) first folding shoe members carried by and movable with the said combinaton pusher and folding device and engaging and partially infolding the said first end panels toward the end walls of the said ice cream sandwich as the ice cream sandwich is slidably pushed off the said elevator head and onto the said horizontal trackway;

(l) fourth folding means including
  (1) second folding shoe members stationarily mounted on the said horizontal trackway; and
  (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway, to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having
  (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including
  (1) a pusher head extending transversely relative to the said horizontal trackway and including
    a. end portions
    b. having the said third folding shoe members rigidly attached thereto in upright position; and
    c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) an adjustment screw head extending transversely relative to the said horizontal trackway rearwardly of and extending generally parallel to the said pusher head and attached to and carried by the said operating means for slidably and reciprocably operating the said combination pusher and folding device; and (t) adjustment screw means mounted on the said adjustment screw head and adjustably connected to the said pusher head for adjusting the said pusher head and the said third folding shoe members attached thereto toward and away from the said elevator device.

32. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the (b) said horizontal trackway thereon, and including
  (1) an input end;
  (2) a delivery end; and having
  (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including
  (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said heat for moving the said elevator head with one of the said ice cream sandwiches and its wrapper sheet thereon upwardly to the level of the upper surface of the said horizontal trackway;

(f) a vertically extending guideway for the said upper head of the said elevator device including
  (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher combination folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including
  (1) first folding shoe members carried by and movable with the said combination pusher and folding device and engaging and partially infolding the said first end panels toward the end walls of the said ice cream sandwich as the ice cream sandwich is sidably pushed off the said elevator head and onto the said horizontal trackway;

(l) fourth folding means including
  (1) second folding shoe members stationarily mounted on the said horizontal trackway; and
  (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway, to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for in-folding the said second end-sealing panels against the said end panels as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having
  (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including
  (1) a pusher head extending transversely relative to the said horizontal trackway and including
    a. end portions
    b. having the said third folding shoe members rigidly attached thereto in upright position; and
    c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) the said combination pusher and folding device including
  (1) a slidable and reciprocating carriage including
  (2) a front end portion having attached thereto the said combination pusher and supporting plate member with the said first folding shoe members thereon and attached thereto;

(t) means for slidably mounting the said slidable and reciprocating carriage and the said combination pusher and supporting plate member attached thereto on the said wrapper machine supporting frame for slidable and reciprocating movement in a generally horizontal plane toward and away from the said elevator device;

(u) means for interconnecting the said pusher head and the slidable and reciprocating carriage and the said combination pusher and supporting plate member attached thereto and the said first folding shoe members on the said combination pusher and supporting plate member for simultaneous limited forward movement of the said pusher head and the said third folding shoe members thereon and the said combination pusher and supporting plate member and the said first folding shoe member thereon toward the said elevator head and toward the said end panels of a wrapper sheet on an ice cream sandwich disposed on the said elevator head; and (v) motion-limiting means for limiting the simultaneous forward movement of the said slidable and reciprocating carriage and the combination pusher and supporting plate member and the said first folding shoe members thereon with the said pusher head and with the said third folding shoe members thereon toward the said elevator head and toward the said first end panels of a wrapper sheet on the ice cream sandwich disposed on the said elevator head while allowing the said pusher head and the said third folding shoe members thereon to continue to be moved forwardly by the said operating means for the said slidable and reciprocating combination pusher and folding device toward the said elevator head and toward the said end panels of the wrapper sheet on the said ice cream sandwich disposed on the said elevator head.

33. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the
(b) said horizontal trackway thereon, and including
  (1) an input end;
  (2) a delivery end; and having
  (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including
  (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal trackway;

(f) a vertically extending guideway for the said upper head of the said elevator device including
  (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches and their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including
  (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including
  (1) second folding shoe members stationarily mounted on the said horizontal trackway; and
  (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having
  (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including
  (1) a pusher head extending transversely relative to the said horizontal trackway and including
    a. end portions
    b. having the said third folding shoe members rigidly attached thereto in upright position; and
    c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) the said combination pusher and folding device including
  (1) a slidable and reciprocating carriage including
  (2) a front end portion having attached thereto the said combination pusher and supporting plate member with the said first folding shoe members thereon and attached thereto;

(t) means for slidably mounting the said slidable and reciprocating carriage and the said combination pusher and supporting plate member attached thereto on the said wrapper machine supporting frame for slidable and reciprocating movement in a generally horizontal plane toward and away from the said elevator device;

(u) means for interconnecting the said pusher head and the slidable and reciprocating carriage and the said combination pusher and supporting plate member attached thereto and the said first folding shoe members on the said combination pusher and supporting plate member for simultaneous limited forward movement of the said pusher head and the said third folding shoe members thereon and the said combination pusher and supporting plate member and the said first folding shoe member thereon towad the said elevator head and toward the said end panels of a wrapper sheet on an ice cream sandwich disposed on the said elevator head;

(v) motion-limiting means for limiting the simultaneous forward movement of the said slidable and reciprocating carriage and the combination pusher and supporting plate member and the said first folding shoe members thereon with the said usher head and with the said third folding shoe members thereon toward the said elevator head and toward the said first end panels of a wrapper sheet on the ice cream sandwich disposed on the said elevator head while allowing the said pusher head and the said third folding show members thereon to continue to be moved forwardly by the said operating means for the said slidable and reciprocating combination pusher and folding device toward the said elevator head and toward the said end panels of the wrapper sheet on the said ice cream sandwich disposed on the said elevator head; and (w) the said means for interconnecting the said pusher head and the said slidable and reciprocating carriage including (1) resilient means.

34. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the (b) said horizontal trackway thereon, and including (1) an input end;

(2) a delivery end; and having (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal trackway;

(f) a vertically extending guideway for the said upper head of the said elevator device including (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end of the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cram sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including (1) second folding shoe members stationarily mounted on the said horizontal trackway; and (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members, as the ice cream sandwich is slidably pushed along the upper surface of the said horizontal trackway, to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having
(1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including
(1) a pusher head extending transversely relative to the said horizontal trackway and including
a. end portions
b. having the said third folding shoe members rigidly attached thereto in upright position; and
c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) the said combination pusher and folding device including
(1) a slidable and reciprocating carriage including
(2) a front end portion having attached thereto the said combination pusher and supporting plate member with the said first folding shoe members thereon and attached thereto;

(t) means for slidably mounting the said slidable and reciprocating carriage and the said combination pusher and supporting plate member attached thereto on the said wrapper machine supporting frame for slidable and reciprocating movement in a generally horizontal plane toward and away from the said elevator device;

(u) means for interconnecting the said pusher head and the slidable and reciprocating carriage and the said combination pusher and supporting plate member attached thereto and the said first folding shoe members on the said combination pusher and supporting plate member for simultaneous limited forward movement of the said pusher head and the said third folding shoe members thereon and the said combination pusher and supporting plate member and the said first folding shoe member thereon toward the said elevator head and toward the said end panels of a wrapper sheet on an ice cream sandwich disposed on the said elevator head;

(v) motion-limiting means for limiting the simultaneous forward movement of the said slidable and reciprocating carriage and the combination pusher and supporting plate member and the said first folding shoe members thereon with the said pusher head and with the said third folding shoe members thereon toward the said elevator head and toward the said first end panels of a wrapper sheet on the ice cream sandwich disposed on the said elevator head while allowing the said pusher head and the said third folding shoe members thereon to continue to be moved forwardly by the said operating means for the said slidable and reciprocating combination pusher and folding device toward the said elevator head and toward the said end panels of the wrapper sheet on the said ice cream sandwich disposed on the said elevator head;

(w) the said means for interconnecting the said pusher head and the said slidable and reciprocating carriage including
(1) resilient means;

(x) the said slidable and reciprocating carriage including
(1) a carriage frame;

(y) the said resilient means being in the form of
(1) spring means having a rear end portion attached to the said carriage frame and having a front end portion; and (z) the said combination pusher and folding device including
(1) means for operatively interconnecting the said front end portion of the said spring means and the said pusher head.

35. A wrapping machine for folding and wrapping a wrapper sheet of heat-sealable flexible coated wrapping material sequentially about the body of each of a horizontal row or ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the
(b) said horizontal trackway thereon, and including
(1) an input end;
(2) a delivery end; and having
(3) an upper surface along which the said ice cream sandwiches with their wrapper sheets thereon are adpated to be sequentially moved from the said input end to the said delivery end of the said trackway;

(c) a vertically reciprocating elevator device mounted on the said supporting frame at the input end of the said trackway and including
(1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal trackway;

(f) a vertically extending guideway for the said upper head of the said elevator device including (1) a pair of horizontally spaced generally parallel vertically extending combination elevator guide and folding members providing first folding means cooperating with the said elevator head for downfolding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including (1) second folding shoe members stationarily mounted on the said horizontal trackway; and (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device;

(o) heat-sealing mans disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including (1) a pusher head extending transversely relative to the said horizontal trackway and including a. end portions b. having the said third folding shoe members rigidly attached thereto in upright position; and c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) the said combination pusher and folding device including
(1) a slidable and reciprocating carriage including
(2) a front end portion having attached thereto the said combination pusher and supporting plate member with the said first folding shoe members thereon and attached thereto;

(t) means for slidably mounting the said slidable and reciprocating carriage and the said combination pusher and supporting plate member attached thereto on the said wrapper machine supporting frame for slidable and reciprocating movement in a generally horizontal plane toward and away from the said elevator device;

(u) means for interconnecting the said pusher head and the slidable and reciprocating carriage and the said combination pusher and supporting plate member attached thereto and the said first folding shoe members on the said combination pusher and supporting plate member for simultaneous limited forward movement of the said pusher head and the said third folding shoe members thereon and the said combination pusher and supporting plate member and the said first folding shoe member thereon toward the said elevator head and toward the said end panels of a wrapper sheet on an ice cream sandwich disposed on the said elevator head;

(v) motion-limiting means for limiting the simultaneous forward movement of the said slidable and reciprocating carriage and the combination pusher and supporting plate member and the said first folding shoe members thereon with the said pusher head and with the said third folding shoe members thereon toward the said elevator head and toward the said first end panels of a wrapper sheet on the ice cream sandwich disposed on the said elevator head while allowing the said pusher head and the said third folding shoe members thereon to continue to be moved forwardly by the said operating means for the said slidable and reciprocating combination pusher and folding device toward the said elevator head and toward the said end panels of the wrapper sheet on the said ice cream sandwich disposed on the said elevator head;

(w) the said means for interconnecting the said pusher head and the said slidable and reciprocating carriage including
(1) resilient means;

(x) the said slidable and reciprocating carriage including
(1) a carriage frame;

(y) the said resilient means being in the form of
(1) spring means having a rear end portion attached to the said carriage frame and having a front end portion; and (z) the said combination pusher and folding device including
(1) means for operatively interconnecting the said front end portion of the said spring means and the said pusher head;

(z-1) the said means for operatively interconnecting the said front end portion of the said spring means and the said pusher head including
(1) an adjustment screw head disposed rearwardly of and extending generally parallel to the said pusher head;

(z-2) said adjustment screw head including
(1) screw adjustment means adjustably interconnecting the said pusher head and the said adjusting screw head; and (z-3) the said front end portion of the said spring means being attached to the said adjustment screw head.

36. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the
(b) said horizontal trackway thereon, and including
(1) an input end;
(2) a delivery end; and having
(3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including
(1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said head for moving the said elevator head with one of the said ice cream sandwiches and its wrapper sheet thereon upwardly to the level of the upper surface of the said horizontal trackway;

(f) a vertically extending guideway for the said upper head of the said elevator device including
(1) a pair of horizontally spaced generally parallel vertically extending combination elevator guide and folding members providing first folding means cooperating with the said elevator head for down-folding the said side panels of the said wrapper sheet along the sides of the said ice cream sandwich as the ice cream sandwich with its wrapper sheet thereon is elevated by the said elevator head to the upper surface of the said horizontal trackway;

(g) a combination pusher and folding device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidable and reciprocable operating the said combination pusher and folding device towad and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including
  (1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;

(l) fourth folding means including
  (1) second folding shoe members stationarily mounted on the said horizontal trackway; and
  (2) third folding shoe members carried by and movable with the said combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway to infold the said second end panels against the end walls of the said ice cream sandwich;

(m) fifth folding means on the said horizontal trackway for infolding the said first end-sealing panels against the said end panels as the ice cream sandwich is slidably moved by the said combination pusher and folding device along the upper surface of the said horizontal trackway;

(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device;

(o) heat-sealing means disposed on the said horizontal trackway between the said sixth folding means and the said delivery end of the said horizontal trackway for heat-sealing the said first and second end-sealing panels together;

(p) the said third folding shoe members being rigidly attached to and movable with the said combination pusher and folding device in horizontally spaced relationship thereon;

(q) each of the said first folding shoe members having
  (1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;

(r) the said combination pusher and folding device including
  (1) a pusher head extending transversely relative to the said horizontal trackway and including
    a. end portions
    b. having the said third folding shoe members rigidly attached thereto in upright position; and
    c. a horizontally extending combination pusher and supporting plate member disposed forwardly of the said pusher head and having the said first folding shoe members rigidly attached thereto in upright and horizontally spaced relationship relative to and outwardly of the said third folding shoe members;

(s) the said combination pusher and folding device including
  (1) a slidable and reciprocating carriage including
  (2) a front end portion having attached thereto the said combination pusher and supporting plate member with the said first folding shoe members thereon and attached thereto;

(t) means for slidably mounting the said slidable and reciprocating carriage and the said combination pusher and supporting plate member attached thereto on the said wrapping machine supporting frame for slidable and reciprocating movement in a generally horizontal plane toward and away from the said elevator device;

(u) means for interconnecting the said pusher head and the slidable and reciprocating carriage and the said combination pusher and supporting plate member attached thereto and the said first folding shoe members on the said combination pusher and supporting plate member for simultaneous limited forward movement of the said pusher head and the said third folding shoe members thereon and the said combination pusher and supporting plate member and the said first folding shoe member thereon toward the said elevator head and toward the said end panels of a wrapper sheet on an ice cream sandwich disposed on the said elevator head;

(v) motion-limiting means for limiting the simultaneous forward movement of the said slidable and reciprocating carrriage and the combination pusher and suppporting plate member and the said first folding shoe members thereon with the said pusher head and with the said third folding shoe members thereon toward the said elevator head and toward the said first end panels of a wrapper sheet on the ice cream sandwich disposed on the said elevator head while allowing the said pusher head and the said third folding shoe members thereon to continue to be moved forwardly by the said operating means for the said slidable and reciprocating combination pusher and folding device toward the said elevator head and toward the said end panels of the wrapper sheet on the said ice cream sandwich disposed on the said elevator head;

(w) the said motion-limiting means including (1) resilient bumper means carried by and suspended from the said carriage frame; and (x) stop means on the said supporting frame for the said wrapping machine and engageable by the resilient bumper means on the said carriage frame for limiting the forward movement of the said slidable and reciprocating carriage and the said combination pusher and supporting plate member and the said first folding shoe members thereon toward the said elevator head and toward the said first end panels of the wrapper sheet on the ice cream sandwich disposed on the said elevator head while allowing the said pusher head and the said third folding shoe members thereon to continue their forward movement.

37. A wrapping machine for folding and wrapping a wrapper sheet of heat-sealable flexible coated wrapping material sequentially about the body of each of a horizontal row of ice cream sandwiches as the said row of ice cream sandwiches is moved along and over a horizontal trackway; each of the said wrapper sheets including a top panel foldable over the upper or top surface of the ice cream sandwich; side panels foldable against the sides of the ice cream sandwich; first and second bottom panels foldable against the bottom surface of the ice cream sandwich; first and second end panels foldable over the end walls of the ice cream sandwich; first and second end-sealing panels foldable one against the other and over the said end panels, said wrapping machine comprising:

(a) a supporting frame; having the (b) said horizontal trackway thereon, and including (1) an input end;

(2) a delivery end; and having (3) an upper surface along which the said ice cream sandwiches with their wrapper sheets thereon are adapted to be sequentially moved from the said input end to the said delivery end of the said trackway;

(c) a vertically reciprocating elevator device mounted on the said supporting frame at the input end of the said trackway and including (1) an elevator head adapted to elevate the said ice cream sandwiches one at a time from a point below the said horizontal trackway to the level of the said upper surface of the said horizontal trackway;

(d) means for successively and sequentially depositing a wrapper sheet of the said heat-sealable flexible coated wrapping material in a generally flat position on the upper surface of each of a succession of ice cream sandwiches deposited on the said head of the said elevator device at a point below the said horizontal trackway and thereby forming the said top panel over each of the said ice cream sandwiches;

(e) means for vertically operating and reciprocating the said elevator device and its said heat for moving the said elevator head with one of the said ice cream sandwiches and its wrapper sheet thereon upwardly to the level of the upper surface of the said horizontal trackway;

(f) a vertically extending guideway for the said upper head of the said elevator device including (1) a pair of horizontally spaced generally parallel vertical extending combination elevator guide and folding members providing first folding means cooperating with the said elevator head for downfolding the said side panels of the said wrapper sheet along the side of the said ice cream sandwich as the ice cream sandwich with its wrapper sheet thereon is elevated by the said elevator head to the upper surface of the said horizontal trackway;

(g) a combination pusher and folder device slidably and reciprocably mounted on the said supporting frame adjacent the said input end of the said horizontal trackway for sequentially and slidably pushing each of the said ice cream sandwiches with its wrapper sheet thereon off the said elevator head onto the said upper surface of the said horizontal trackway and for advancing the said row of ice cream sandwiches with their wrapper sheets thereon along the upper surface of the said horizontal trackway from the said input end to the said delivery end thereof;

(h) operating means for slidably and reciprocably operating the said combination pusher and folding device toward and away from the said elevator head in timed relationship with the vertical reciprocating movement of the said elevator device;

(i) the said combination pusher and folding device and the said elevator head cooperating with each other to infold the said first bottom panel under the said bottom surface of the said ice cream sandwich as the said ice cream sandwich with its wrapper sheet thereon is slidably pushed off the said elevator head and onto the said upper surface of the said horizontal trackway;

(j) second folding means including one of the said vertically extending combination elevator guide and folding members cooperating with the said combination pusher and folding device as the said ice cream sandwich with its wrapper sheet thereon is slidably pushed off the said elevator head by the said combination pusher and folding device for infolding the said second bottom panel under the said ice cream sandwich as the ice cream sandwich is slidably pushed off the said elevator head by the said combination pusher and folding device;

(k) third folding means including
(1) first folding shoe members carried by and movable with the said combination pusher and folding device and engaging and partially infolding the said first end panels toward the end walls of the said ice cream sandwich as the ice cream sandwich is slidably pushed off the said elevator head and onto the said horizontal trackway;
(l) fourth folding means including
(1) second folding shoe members stationarily mounted on the said horizontal trackway; and
(2) third folding shoe members carried by and movable with the sad combination pusher and folding device and movable thereby into engagement with the said first end panels and cooperating with the said first folding shoe members to complete the infolding of the said first end panels against the end walls of the said ice cream sandwich and movable by the said combination pusher and folding device into cooperative folding relationship with the said second folding shoe members and cooperating with the said third folding shoe members, as the ice cream sandwich is slidably pushed along the upper surface of the said horizontal trackway, to infold the said second end panels against the end walls of the said ice cream sandwich;
(m) fifth folding means on the said horizontal trackeway for infolding the said first end-sealing panels against the said end panels as the ice cream sandwich is slidably moved by the said combination pusher and folding device along the upper surface of the said horizontal trackway;
(n) sixth folding means on the said horizontal trackway between the said fifth folding means and the said delivery end of the said horizontal trackway for infolding the said second end-sealing panels against the said end panels as the said ice cream sandwich is slidably moved along the said horizontal trackway by the said combination pusher and folding device;
(o) heat-sealing means disposed on the said horizontal trackway between the said sixth folding means and the said delivery end of the said horizontal trackway for heat-sealing the said first and second end-sealing panels together;
(p) the said third folding shoe members being rigidly attached to and movable with the said combination pusher and folding device in horizontally spaced relationship thereon;
(q) each of the said first folding shoe members having
(1) a forwardly extending tapered front end or nose portion which is adapted to engage and infold one of the said first end panels toward the end walls of the said ice cream sandwich as the said ice cream sandwich is slidably moved off the said elevator head and along the said horizontal trackway by the said combination pusher and folding device;
(r) the said combination pusher and folding device including
(1) a pusher head extending transversely relative to the said horizontal trackway and including
a. end portions
b. having the said third folding shoe members rigidly attached thereto in upright position; and
c. a horizontally extending combination pusher and supporting plate member disposed forwardly of the said pusher head and having the said first folding shoe members rigidly attached thereto in upright and horizontally spaced relationship relative to and outwardly of the said third folding shoe members;
(s) the said combination pusher and folding device including
(1) A slidable and reciprocating carriage including
(2) a front end portion having attached thereto the said combination pusher and supporting plate member with the said first folding shoe members thereon and attached thereto;
(t) means for slidably mounting the said slidable and reciprocating carriage and the said combination pusher and supporting plate member attached thereto on the said wrapping machine supporting frame for slidable and reciprocating movement in a generally horizontal plane toward and away from the said elevator device;
(u) means for interconnectig the said pusher head and the slidable and reciprocating carriage and the said combination pusher and supporting plate member attached thereto and the said first folding shoe members on the said combination pusher and supporting plate member for simultaneous limited forward movement of the said pusher head and the said third folding shoe members thereon and the said combination pusher and supporting plate member and the said first folding shoe member thereon toward the said elevator head and toward the said end panels of a wrapper sheet on an ice cream sandwich disposed on the said elevator head;
(v) motion-limiting means for limiting the simultaneous forward movement of the said slidable and reciprocating carriage and the combination pusher and supporting plate member and the said first folding shoe members thereon with the said pusher head and with the said third folding shoe members thereon toward the said elevator head and toward the said first end panels of a wrapper sheet on the ice cream sandwich disposed on the said elevtor head while allowing the said pusher head and the said third folding shoe members thereon to continue to be moved forwardly by the said operating means for the said slidable and reciprocating combination pusher and folding device toward the said elevator head and toward the said end panels of the wrapper sheet on the said ice cream sandwich disposed on the said elevator head; and
(w) the said means for interconnecting the said pusher head and the said slidable and reciprocating carriage including
(1) resilient means;
(x) the said slidable and reciprocating carriage including
(1) a carriage frame;
(y) the said resilient means being in the form of
(1) spring means having a rear end portion attached to the said carriage frame and having a front end portion;
(z) the said combination pusher and folding device including
(1) means for operatively interconnecting the said front end portion of the said spring means and the said pusher head; and (z-1) the said combintion pusher and folding device including (1) means cooperating with the said spring means for returning the said slidable and reciprocating carriage and the said combination pusher and supporting plate member and the said first folding shoe members thereon to their initial position after each forward movement thereof toward the said elevator head and toward the end panels of the wrapper sheet on the ice cream sandwich disposed on the said elevator head.

38. A wrapping machine for folding and wrapping a wrapper sheet of flexible heat-sealable coated wrapping material which includes a top panel; first and second bottom panels; first and second side panels; first and second end panels; and first and second end-sealing panels; about the top, bottom, sides and end walls of an ice cream sandwich, said wrapping machine comprising:

(a) a supporting frame;

(b) a generally horizontally extending trackway on the said supporting frame including (1) an input end;

(2) a delivery end; and having (3) a generally horizontally extending upper surface extending from the said input end to the delivery end of the said trackway;

(c) elevator means arranged adjacent the said input end of the said generally horizontally extending trackway for sequentially elevating ice cream sandwiches each with a wrapper sheet thereon laid generally flat over and in coplanar relationship with the top surface of the said ice cream sandwich from a point below the said horizontal trackway up to the level of the said upper surface of the said trackway;

(d) the said elevator means including (1) an elevator head;

(2) first folding means cooperating with the said elevator head for downfolding the said side and bottom panels of the said wrapper sheet in coplanar relationship downwardly along the sides of the ice crean sandwich as the ice cream sandwich with its wrapper sheet thereon is elevated by the said elevator head to the level of the said upper surface of the said horizontal trackway at the said input end thereof;

(e) means for cyclically reciprocating the said elevator means in a vertical plane;

(f) combination pusher and folding means for slidably and sequentially pushing the said ice cream sandwiches with their wrapper sheets thereon, and with the said side and bottom panels thereof downfolded in coplanar relationship, off the said elevator head onto the said upper surface of the said trackway at the said input end thereof;

(g) operating means for cyclically reciprocating the said combination pusher and folding means in a generally horizontal plane toward and away from the said elevator head;

(h) the said combination pusher and folding means including (1) second folding means cooperating with the said elevator head for infolding the said first bottom panel under the bottom surface of the said ice cream sandwich as the said ice cream sandwich is slidably pushed off the said elevator head onto the said upper surface of the said trackway by the said combination pusher and folding means;

(i) the said first folding means including (1) a folding member cooperating with the said combination pusher and folding means and with the said elevator head for infolding the said second bottom panel under the bottom surface of the said ice cream sandwich as the ice cream sandwich with its wrapper sheet thereon is slidably pushed off the said elevator head onto the upper surface of the said trackway by the said combination pusher and folding means;

(j) the said combination pusher and folding means including (1) first end panel folding means for infolding the said first end panels against the end walls of the said ice cream sandwich as the said ice cream sandwich with its wrapper sheet thereon is slidably pushed off the said elevator head onto the upper surface of the said trackway by the said combination pusher and folding means;

(k) second end panel folding means including (1) first and stationary end panel folding shoe members stationarily mounted on the upper surface of the said trackway adjacent the said elevator head; and (2) second folding shoe members carried by and movable with and by the said combination pusher and folding means into coacting folding relationship with the said first and stationary end panel folding shoe members on the said horizontal trackway for infolding the said second end panels against the end walls of the said ice cream sandwich;

(l) first end-sealing panel folding means stationarily mounted on the said horizontal trackway for infolding the said first end-sealing panels against the said end panels of the said ice cream sandwich as the ice cream sandwich is slidably pushed along the said trackway by the coaction of the said combination pusher and folding means and succeeding or following ice cream sandwiches;

(m) second end-sealing panel folding means stationarily mounted on the said trackway for infolding the said second end-sealing panels against the said first end-sealing panels as the said ice cream sandwich is slidably pushed along the said trackway past the said first end-sealing panel folding means by the coaction of the said combination pusher and folding means and the succeeding or following ice cream sandwiches;

(n) heat-sealing means on the said trackway between the said second end-sealing panels folding means and the said delivery end of the said trackway for heat-sealing the said first and second end-sealing panels together;

(o) the said combination pusher and folding means including

1. A slidable and reciprocating carriage cyclically movable with the said combination pusher and folding means toward and away from the said elevator head, and including 2. a combination pusher and supporting plate member having the said first end panel folding means rigidly mounted thereon and movable therewith;

p. the said combination pusher and folding means including 1. a pusher head disposed above and movable over the said combination pusher and supporting plate member and having the said second end panel folding shoe members rigidly mounted thereon and movable therewith;

(q) the said combination pusher and supporting plate member being in the form of a generally flat plate member, having 1. outer end portions; and (r) the said first end panel folding means being in the form of 1. first end panel folding shoe members mounted in upright position, and in horizontaly spaced relationship on and rigidly attached to the said outer end portions of the said generally flat plate member.

39. A wrapping machine for folding and wrapping a wrapper sheet of flexible heat-sealable coated wrapping material which includes a top panel; first and second bottom panels; first and second side panels; first and second end panels; and first and second end-sealing panels; about the top, bottom, sides and end walls of an ice cream sandwich, said wrapping machine comprising:

(a) a supporting frame;

(b) a generally horizontally extending trackway on the said supporting frame including (1) an input end;

(2) a delivery end; and having (3) a generally horizontally extending upper surface extending from the said input end to the delivery end of the said trackway;

(c) elevator means arranged adjacent the said input end of the said generally horizontally extending trackway for sequentially elevating ice cream sandwiches each with a wrapper sheet thereon laid generally flat over and in coplanar relationship with the top surface of the said ice cream sandwich from a point below the said horizontal trackway up to the level of the said upper surface of the said trackway;

(d) the said elevator means including (1) an elevator head;

(2) first folding means cooperating with the said elevator head for downfolding the said side and bottom panels of the said wrapper sheet in coplanar relationship downwardly along the sides of the ice cream sandwich as the ice cream sandwich with its wrapper sheet thereon is elevated by the said elevator head to the level of the said upper surface of the said horizontal trackway at the said input end thereof;

(e) means for cyclically reciprocating the said elevator means in a vertical plane;

(f) combination pusher and folding means for slidably and sequentially pushing the said ice cream sandwiches with their wrapper sheets thereon, and with the said side and bottom panels thereof downfolded in copolanar relationship, off the said elevator head onto the said upper surface of the said trackway at the said input end thereof;

(g) operating means for cyclically reciprocating the said combination pusher and folding means in a generally horizontal plane toward and away from the said elevator head;

(h) the said combination pusher and folding means including (1) second folding means cooperating with the said elevator head for infolding the said first bottom panel under the bottom surface of the said ice cream sandwich as the said ice cream sandwich is slidably pushed off the said elevator head onto the said upper surface of the said trackway by the said combination pusher and folding means;

(i) the said first folding means including (1) a folding means cooperating with the said combination pusher and folding means and with the said elevator head for infolding the said second bottom panel under the bottom surface of the said ice cream sandwich as the ice cream sandwich with its wrapper sheet thereon is slidably pushed off the said elevator head onto the upper surface of the said trackway by the said combination pusher and folding means;

(j) the said combination pusher and folding means including (1) first end panel folding means for infolding the said first end panels against the end walls of the said ice cream sandwich as the said ice cream sandwich with its wrapper sheet thereon is slidably pushed off the said elevator head onto the upper surface of the said trackway by the said combination pusher and folding means;

(k) second end panel folding means including (1) first and stationary end panel folding shoe members stationarily mounted on the upper surface of the said trackway adjacent the said elevator head; and (2) second folding shoe members carried by and movable with and by the said combination pusher and folding means into coacting folding relationship with the said first and stationary end panel folding shoe members on the said horizontal trackway for infolding the said second end panels against the end walls of the said ice cream sandwich;

(l) first end-sealing panel folding means stationarily mounted on the said horizontal trackway for infolding the said first end-sealing panels against the said end panels of the said ice cream sandwich as the ice cream sandwich is slidably pushed along the said trackway by the coaction of the said combination pusher and folding means and succeeding or following ice cream sandwiches;

(m) second end-sealing panel folding means stationarily mounted on the said trackway for infolding the said second end-sealing panels against the said first end-sealing panels as the said ice cream sandwich is slidably pushed along the said trackway past the said first end-sealing panel folding means by the coaction of the said combination pusher and folding means and the succeeding or following ice cream sandwiches;

(n) heat-sealing means on the said trackway between the said second end-sealing panels folding means and the said delivery end of the said trackway for heat-sealing the said first and second end-sealing panels together;

(o) the said combination pusher and folding means including (1) a slidable and reciprocating carriage cyclically movable with the said combination pusher and folding means toward and away from the said elevator head, and including (2) a combination pusher and supporting plate member having the said first end panel folding the upper surface of the said horizontal trackway;

(k) second folding means including the said elevator device, the said first and second combination elevator guide and folding members, and the said combinagtion pusher and folding device for sequentially infolding the said first and second bottom panels under the bottom surface of the said ice cream sandwich as the said ice cream sandwich is slidably moved off the said elevator device onto the said horizontal trackway by the said combination pusher and folding device;

(l) third folding means cooperating with the said combination pusher and folding device for infolding the said first end panels against the end walls of the said ice cream sandwich as the said ice cream sandwich is slidably moved off the said elevator device and onto the said upper surface of the said horizontal trackway by the said combination pusher and folding device;

(m) fourth folding means cooperating with the said combination pusher and folding device for infolding the said second end panels against the end walls of the said ice cream sandwich as the said ice cream sandwich is moved off the said elevator device and along the said horizontal trackway by the said combination pusher and folding device;

(n) additional folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combination pusher and folding device;

(o) heat-sealing means disposed at a point along the said upper surface of the said horizontal trackway between the said additional folding means and the said delivery end of the said horizontal trackway for heat-sealing the said top and bottom end-sealing panels together; and (p) speed-up roller means arranged below the said trackway and between the said web-severing means and the said elevator device for increasing the speed of movement of the severed individual wrapper sheet into the vertical path of the said elevator head and an ice cream sandwich disposed thereon as the elevator head is moved upwardly in its upward stroke relative to the speed of travel of the said web of wrapping material from the feed roll means to the said web-severing means.

41. A wrapping machine for wrapping and folding a wrapper sheet of heat-sealable flexible coated wrapping material about the body of an ice cream sandwich, said wrapper including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including (1) an input end; and (2) a delivery end; and having (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame and the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the said input end to the said delivery end thereof;

(h) means for reciprocably operating the said combination pusher and folding device in times relationship with the vertical and reciprocating movement of the said elevator device;

(i) a plurality of means coacting with the said combination pusher and folding device for sequentially folding the said side panels, the said bottom panels, the said end panels, and the said end-sealing panels of the said wrapper sheet into folded position against the body of the ice cream sandwich as the ice cream sandwich is slidably moved off the said elevator device and along the said horizontal trackway by the said combination pusher and folding device;

(j) heat-sealing means disposed at a point along the said upper surfaces of the said horizontal trackway for heat-sealing the said top and bottom end-sealing panels of the said wrapper sheet together;

(k) the said heat-sealing means including (1) a metallic heat body including a. an outer wall; and b. an inner wall having (1) a convex inner wall surface facing toward the said generally horizontal trackway; and (l) the said top and bottom end-sealing panels being urged into heat-sealing engagement with the said convex inner wall surface of the said metallic heating body as the ice cream sandwich with its said wrapper sheet thereon is moved along the said means rigidly mounted thereon and movable therewith;

(p) the said combination pusher and folding means including (1) a pusher head disposed above and movable over the said combination pusher and supporting plate member and having the said second end panel folding shoe members rigidly mounted thereon and movable therewith;

(q) the said combination pusher and supporting plate member being in the form of a generally flat plate member, having (1) outer end portions; and (r) the said first end panel folding means being in the form of (1) first end panel folding shoe members mounted in upright position, and in horizontally spaced relationship on and rigidly attached to the said outer end portions of the said generally flat plate member;

(s) the said pusher head including (1) an upright pusher body member having (a) outer end portions;

(t) the said second end panel folding shoe members being mounted in horizontally spaced relationship on the said outer end portions of the said upright pusher body member and disposed horizontally inwardly of the said first end panel folding shoe members and being movable with the said upright pusher body member over the said combination pusher and supporting plate member between the first end panel folding shoe members as the said combination pusher and supporting plate member and the said first end panel folding shoe members thereon and the said upright pusher body member and the said second end panel folding shoe members thereon are slidably moved over the said elevator head by the said operating means for the said combination pusher and folding means;

(u) fourth folding means cooperating with the said combination pusher and folding device for infolding the said second end panels against the end walls of the said ice cream sandwich as the said ice cream sandwich is moved off the said elevator device and along the said horizontal trackway by the said combination pusher and folding device;

(v) additional folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combination pusher and folding device; and (w) heat-sealing means disposed at a point along the said upper surface of the said horizontal trackway between the said additional folding means and the said delivery end of the said horizontal trackway for heat-sealing the said top and bottom end-sealing panels together.

40. A wrapping machine for wrapping and folding a wrapper sheet of heat-sealable flexible coated wrapping material about the body of an ice cream sandwich, said wrapper sheet including a top panel which is foldable over the upper or top surface of the said ice cream side panels foldable against the sides of the ice cream sandwich; first and second bottom panels foldable under the bottom surface of the said ice cream sandwich; and top and bottom end-sealing panels foldble against each other and over the said end panels; said wrapping machine comprising:

(a) a supporting frame;

(b) a generally horizontal trackway on the said supporting frame including (1) an input end; and (2) a delivery end; and (3) an upper surface along which the said ice cream sandwich with its said wrapper sheet thereon is adapted to be moved from the said input end to the said delivery end of the said horizontal trackway;

(c) a vertically movable and reciprocating elevator device mounted on the said supporting frame at the input end of and below the said horizontal trackway and adapted to elevate the said ice cream sandwich with its wrapper sheet thereon from a point below the said horizontal trackway to the said upper surface of the said horizontal trackway;

(d) feed roll means for supporting a roll of the said web of heat-sealable flexible coated wrapping material;

(e) web-advancing means for advancing the said web of the said heat-sealable flexible coated wrapping material from the said feed roll means along a path below the said horizontal trackway toward the said upper or top surface of an ice cream sandwich disposed on the said elevator device;

(f) web-severing means in the path of movement of the said web for severing an individual wrapper sheet section of the said flexible coated wrapper material from the said web thereof and thereby forming an individual wrapper sheet for the said ice cream sandwich;

(g) means for operating and vertically reciprocating the said elevator device and for moving the said elevator device with an ice cream sandwich and its said wrapper sheet thereon upwardly toward the said horizontal trackway and thereby forming the said top panel over the said upper or top surface of the said ice cream sandwich;

(h) a horizntally reciprocable combination pusher and folding device slidably and reciprocably mounted on the said supporting frame at the input end of the said elevator device for slidably moving the said ice cream sandwich with its said wrapper sheet thereon off the said elevator device onto the said upper surface of the said horizontal trackway and for advancing a horizontal row of ice cream sandwiches with their wrapper sheets thereon along the upper surface of the said horizontal trackway from the said input end to the delivery end of the said horizontal trackway;

(i) operating means for reciprocably operating the said combination pusher and folding device in timed relationship with the vertical reciprocating movement of the said elevator device;

(j) first folding means including (1) first and second vertically extending generally parallel combination elevator guide wall and folding members cooperating with the said elevator device for downfolding the said side panels and the said bottom panels of the said wrapper sheet downwardly along the side walls of the said ice cream sandwich as the ice cream sandwich is elevated by the said elevator device up to generally horizontal trackway into engagement with the said heat-sealing means.

42. A wrapping machine for wrapping and folding a wrapper sheet of heat-sealable flexible coated wrapping material about the body of an ice cream sandwich, said wrapper sheet including a top panel which is foldable over the upper or top surface of the said ice cream side panels against the sides of the ice cream sandwich; first and second bottom panels foldable under the bottom surface of the said ice cream sandwich; and top and bottom end-sealing panels foldable against each other and over the said end panels; said wrapping machine comprising:

(a) a supporting frame;

(b) a generally horizontal trackway on the said supporting frame including
  (1) an input end; and
  (2) a delivery end; and
  (3) an upper surface along which the said ice cream sandwich with its said wrapper sheet thereon is adapted to be moved from the said input end to the said delivery end of the said horizontal trackway;

(c) a vertically movable and reciprocating elevator device mounted on the said supporting frame at the input end of and below the said horizontal trackway and adapted to elevate the said ice cream sandwich with its wrapper sheet thereon from a point below the said horizontal trackway to the said upper surface of the said horizontal trackway;

(d) feed roll means for supporting a roll of the said web of heat-sealable flexible coated wrapping material;

(e) web-advancing means for advancing the said web of the said heat-sealable flexible coated wrapping material from the said feed roll means along a path below the said horizontal trackway toward the said upper or top surface of an ice cream sandwich disposed on the said elevator device;

(f) web-severing means in the path of movement of the said web for severing an individual wrapper sheet section of the said flexible coated wrapping material from the said web thereof and thereby forming an individual wrapper sheet for the said ice cream sandwich;

(g) means for operating and vertically reciprocating the said elevator device and for moving the said elevator device with an ice cream sandwidh and its said wrapper sheet thereon upwardly toward the said horizontal trackway and thereby forming the said top panel over the said upper or top surface of the said ice cream sandwich;

(h) a horizontally reciprocable combination pusher and folding device slidably and reciprocably mounted on the said supporting frame at the input end of the said elevator device for slidably moving the said ice cream sandwich with its said wrapper sheet thereon off the said elevator device onto the said upper surface of the said horizontal trackway and for advancing a horizontal row of ice cream sandwiches with their wrapper sheets thereon along the upper surface of the said horizontal trackway from the said input end to the delivery end of the said horizontal trackway;

(i) operating means for reciprocably operating the said combination pusher and folding device in timed relationship with the vertical reciprocating movement of the said elevator device;

(j) first folding means including
  (1) first and second vertically extending generally parallel combination elevator guide wall and folding members cooperating with the said elevator device for downfolding the said side panels and the said bottom panels of the said wrapper sheet downwardly along the side walls of the said ice cream sandwich as the ice cream sandwich is elevated by the said elevator device up to the upper surface of the said horizontal trackway;

(k) second folding means including the said elevator device, the said first and second combination elevator guide and folding members, and the said combination pusher and folding device for sequentially infolding the said first and second botom panels under the bottom surface of the said ice cream sandwich as the said ice cream sandwich is slidably moved off the said elevator device onto the said horizontal trackway by the said combination pusher and folding device;

(l) third folding means cooperating with the said combination pusher and folding device for infolding the said first end panels against the end walls of the said ice cream sandwich as the said ice cream sandwich is slidably moved off the said elevator device and onto the said upper surface of the said horizontal trackway by the said combination pusher and folding device;

(m) fourth folding means cooperating with the said combination pusher and folding device for infolding the said second end panels against the end walls of the said ice cream sandwich as the said ice cream sandwich is moved off the said elevator device and along the said horizontal trackway by the said combination pusher and folding device;

(n) additional folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combination pusher and folding device;

(o) heat-sealing means disposed at a point along the said upper surface of the said horizontal trackway between the said additional folding means and the said delivery end of the said horizontal trackway for heat-sealing the said top and bottom end-sealing panels together;

(p) a pair of horizontally spaced yieldable and flexible pressure members arranged at the sides of and extending longitudinally of the said generally horizontally extending trackway and spaced inwardly of the said heat-sealing means and each including
  (1) an upper edge portion; and
  (2) a bottom edge portion spaced slightly above the said generally horizontally extending trackway;
  (3) a vertically extending inner wall surface facing toward the said generally horizontally extending trackway; and
  (4) a vertically extending outer wall surface facing toward the said heat-sealing means;

(q) the said top end-sealing panels of the said wrapper sheet passing over the said upper edge portions of the said yieldable and flexible pressure members and the said bottom end-sealing panels passing under the said bottom edge portions of the said yieldable and flexible pressure members as the said ice cream sandwiches are moved along the said generally horizontal trackway between and in engagement with the said yieldable and flexible pressure members; and (r) the said bottom and top end-sealing panels being urged by the said yieldable and flexible pressure members into intimate heat-sealing engagement with the said heat-sealing means after the said bottom and top-sealing panels of the said wrapper sheet are folded one against the other and over the said bottom and top panels by the said additional folding means.

43. A wrapping machine for wrapping and folding a wrapper sheet of heat-sealable flexible coated wrapping material about the body of an ice cream sandwich, said wrapper sheet including a top panel which is foldable over the upper or top surface of the said body of ice cream; side panels foldable against the sides of the ice cream sandwich; first and second bottom panels foldable under the bottom surface of the said ice cream sandwich; and top and bottom end-sealing panels foldable against each other and over the said end panels; said wrapping machine comprising:

(a) a supporting frame;

(b) a generally horizontal trackway on the said supporting frame including
(1) an input end; and
(2) a delivery end; and
(3) an upper surface along which the said ice cream sandwich with its said wrapper sheet thereon is adapted to be moved from the said input end to the said delivery end of the said horizontal trackway;

(c) a vertically movable and reciprocating elevator device mounted on the said supporting frame at the input end of and below the said horizontal trackway and adapted to elevate the said ice cream sandwich with its wrapper sheet thereon from a point below the said horizontal trackway to the said upper surface of the said horizontal trackway;

(d) feed roll means for supporting a roll of the said web of heat-sealable flexible coated wrapping material;

(e) web-advancing means for advancing the said web of the said heat-sealable flexible coated wrapping material from the said feed roll means along a path below the said horizontal trackway toward the said upper or top surface of an ice cream sandwich disposed on the said elevator device;

(f) web-severing means in the path of movement of the said web for severing an individual wrapper sheet section of the said flexible coated wrapping material from the said web thereof and thereby forming an individual wrapper sheet for the said ice cream sandwich;

(g) means for operating and vertically reciprocating the said elevator device and for moving the said elevator device with an ice cream sandwich and its said wrapper sheet thereon upwardly toward the said horizontal trackway and thereby forming the said top panel over the said upper or top surface of the said ice cream sandwich;

(h) a horizontally reciprocable combination pusher and folding device slidably and reciprocably mounted on the said supporting frame at the input end of the said elevator device for slidably moving the said ice cream sandwich with its said wrapper sheet thereon off the said elevator device onto the said upper surface of the said horizontal trackway and for advancing a horizontal row of ice cream sandwiches with their wrapper sheets thereon along the upper surface of the said horizontal trackway from the said input end to the delivery end of the said horizontal trackway;

(i) operating means for reciprocably operating the said combination pusher and folding device in timed relationship with the vertical reciprocating movement of the said elevator device;

(j) first folding means including
(1) first and second vertically extending generally parallel combination elevator guide wall and folding members cooperating with the said elevator device for downfolding the said side panels and the said bottom panels of the said wrapper sheet downwardly along the side walls of the said ice cream sandwich as the ice cream sandwich is elevated by the said elevator device up to the upper surface of the said horizontal trackway;

(k) second folding means including the said elevator device, the said first and second combination elevator guide and folding members, and the said combination pusher and folding device for sequentially infolding the said first and second bottom panels under the bottom surface of the said ice cream sandwich as the said ice cream sandwich is slidably moved off the said elevator device onto the said horizontal trackway by the said combination pusher and folding device;

(l) third folding means cooperating with the said combination pusher and folding device for infolding the said first end panels against the end walls of the said ice cream sandwich as the said ice cream sandwich is slidably moved off the said elevator device and onto the said upper surface of the said horizontal trackway by the said combination pusher and folding device;

(m) fourth folding means cooperating with the said combinational pusher and folding device for infolding the said second end panels against the end walls of the said ice cream sandwich as the said ice cream sandwich is moved off the said elevator device and along the said horizontal trackway by the said combination pusher and folding device;

(n) additional folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combintion pusher and folding device;

(o) heat-sealing means disposed at a point along the said upper surface of the said horizontal trackway between the said additional folding means and the said delivery end of the said horizontal trackway for heat-sealing the said top and bottom end-sealing panels together;

(p) a pair of horizontally spaced yieldable and flexible pressure members arranged at the sides of and extending longitudinally of the said generally horizontally extending trackway and spaced inwardly of the said heat-sealing means and each including
(1) an upper edge portion; and (2) a bottom edge portion spaced slightly above the said generally horizontally extending trackway;
(3) a vertically extending inner wall surface facing toward the said generally horizontally extending trackway; and
(4) a vertically extending outer wall surface facing toward the said heat-sealing means;

(q) the said top end-sealing panels of the said wrapper sheet passing over the said upper edge portions of the said yieldable and flexible pressure members and the said bottom end-sealing panels passing under the said bottom edge portions of the said yieldable and flexible pressure memebrs as the said ice cream sandwiches are moved along the said generally horizontal trackway between and in engagement with the said yieldable and flexible pressure members; and (r) the said bottom and top end-sealing panels being urged by the said yieldable and flexible pressure members into intimate heat-sealing engagement with the said heat-sealing means after the said bottom and top end-sealing panels of the said wrapper sheet are folded one against the other and over the said bottom and top panels by the said additional folding means; and (s) means for yieldably mounting each of the said yieldable and flexible pressure members on and above the said generally horizontal trackway.

44. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and a top and bottom end-sealing panels foldable one against the other and over the said end panels; said wrapping machine comprising:

(a) a supporting frame;

(b) a generally horizontal trackway on the said supporting frame including
(1) an input end; and
(2) a delivery end; and having
(3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device;

(e) web-severing means for severing an individual wrapper sheet section of the said flexible coated wrapping material from said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheet thereon along the upper surface of the said horizontal trackway from the said input end to the said delivery end thereof;

(h) means for reciprocably operating the said combination pusher and folding device in timed relationship with the vertical and reciprocating movement of the said elevator device;

(i) a plurality of means coacting with the said combinational pusher and folding device for sequentially folding the said side panels, the said bottom panels, the said end panels, and the said end-sealing panels of the said wrapper sheet into folded position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway for heat-sealing the said top and bottom end-sealing panels of the said wrapper sheet together;

(k) cooling means mounted on the said horizontal trackway between the said heat-sealing means and the said delivery end of the said horizontal trackway and engageable by the heat-sealed top and bottom end-sealing panels for cooling the said heat-sealed top and bottom end-sealing panels as they are slidably moved along the said horizontal trackway by a row of the said ice cream sandwiches from the said heat-sealing means to the delivery end of the said horizontal trackway;

(l) the said cooling means includng a metallic cooling body including
(1) an outer wall; and
(2) an inner wall having
a. a convex inner wall surface facing toward the said generally horizontal trackway; and (m) the said top and bottom heat-sealed end-sealing panels being urged into cooling engagement with the said convex inner wall surface of the said metallic cooling body as the ice cream sandwich with its said wrapper sheet thereon is moved along the said generally horizontal trackway into engagement with the said cooling means.

45. A wrapping machine for wrapping and folding a wrapper sheet of heat-sealable flexible coated wrapping material about the body of an ice cream sandwich, said wrapper sheet including a top panel foldable over the upper or top surface of the said ice cream sandwich; side panels foldable against the sides of the ice cream sandwich; bottom panels foldable under the bottom surface of the said ice cream sandwich; first and second end panels foldable over the end walls of the said ice cream sandwich; and top and bottom end-sealing panels foldable one against the other and over the said end panels; said wrapping machine comprising:

(a) a supporting frame;

(b) a generally horizontal trackway on the said supporting frame including
  (1) an input end; and
  (2) a delivery end; and having
  (3) an upper surface along which the said ice cream sandwich with the said wrapper sheet thereon is adapted to be moved from the said input end to the said delivery end of the said horizontal trackway;

(c) a vertically movable and reciprocating elevator device mounted on the said supporting frame at the input end of and below the said generally horizontal trackway and adapted to elevate the said ice cream sandwich with its wrapper sheet thereon from a point below the said horizontal trackway to the said upper surface of the said trackway;

(d) web-advancing means for advancing a web of the said heat-sealable flexible coated wrapping material along a path below the said horizontal trackway over the said upper or top surface of an ice cream sandwich disposed on the said elevator device; ( (e) web-severing means for severing an individual wrapper sheet section of the said flexible coated wrapping material from the said web thereof;

(f) means for operating and vertically reciprocating the said elevator device and for moving the said elevator device and the said ice cream sandwich and its wrapper sheet thereon upwardly toward the said horizontal trackway and thereby forming the said top panel over the said upper or top surface of the said ice cream sandwich;

(g) a horizontally reciprocable pusher and folding device slidably and reciprocably mounted on the said supporting frame at the input end of the said horizontal trackway and adjacent the said elevator device for slidably pushing the said ice cream sandwich with its wrapper sheet thereon off the said elevator device onto the said upper surface of the said horizontal trackway and for sequentially advancing a horizontal row of ice cream sandwiches with their wrapper sheets thereon along the upper surface of the said horizontal trackway from the said input end to the delivery end thereof;

(h) means for reciprocably operating the said combination pusher and folding device in timed relationship with the vertical and reciprocating movement of the said elevator device;

(i) a plurality of means coacting with the said combinational pusher and folding device for sequentially folding the said side panels, the said bottom panels, the said end panels, and the said end-sealing panels of the said wrapper sheet folded into position against the body of the ice cream sandwich as the ice cream sandwich is slidably moved off the said elevator device and along the said horizontal trackway by the said combination pusher and folding device;

(j) heat-sealing means disposed at a point along the said upper surface of the said horizontal trackway for heat-sealing the said top and bottom end-sealing panels of the said wrapper sheet together;

(k) cooling means mounted on the said horizontal trackway between the said heat-sealing means and the said delivery end of the said horizontal trackway and engageable by the heat-sealed top and bottom end-sealing panels as they are slidably moved along the said horizontal trackway by a row of the said ice cream sandwiches from the said heat-sealng means to the delivery end of the said horizontal trackway;

(l) a pair of horizontally spaced yieldable and flexible pressure members arranged at the sides of and extending longitudinally of the said generally horizontally extending trackway and spaced inwardly of the said coolng means and each including
  (1) an upper edge portion; and
  (2) a bottom edge portion spaced slightly above the said generally horizontally extending trackway;
  (3) a vertically extending inner wall surface facing toward the said generally horizontally extending trackway; and
  (4) a vertically extending outer wall surface facing toward the said cooling means;

(m) the said top end-sealing panels of the said wrapper sheet passing over the said upper edge portions of the said yieldable and flexible pressure members and the said bottom end-sealing panels passing under the said bottom edge portions of the said yieldable and flexible pressure members as the said ice cream sandwiches are moved along the said generally horizontal trackway between and in engagement with the said yieldable and flexible pressure members; and (n) the said bottom and top end-sealing panels being urged by the said yieldable and flexible pressure members into engagement with the said cooling means after the said bottom and top end-sealing panels of the said wrapper sheet are folded into position against the body of the said ice cream sandwich.

46. A wrapping machine for wrapping and folding a wrapper sheet of heat-sealable flexible coated wrapping material about the body of an ice cream sandwich, said wrapper sheet includng a top panel which is foldable over the upper or top surface of the said ice cream sandwich; side panels foldable against the sides of the ice cream sandwich; first and second bottom panels foldable under the bottom surface of the said ice cream sandwich; first and second end panels foldable over the end walls of the said ice cream sandwich; and top and bottom end-sealing panels foldable against each other and over the said end panels; said wrapping machine comprising:

(a) a supporting frame;

(b) a generally horizontal trackway on the said supporting frame including
  (1) an input end; and
  (2) a delivery end; and
  (3) an upper and generally horizontal surface along which the said ice cream sandwich with its said wrapper sheet thereon is adapted to be moved from the said input end to the said delivery end of the said horizontal trackway;

(c) a vertically movable and reciprocating elevator device mounted on the said supporting frame at the input end of and below the said horizontal trackway and adapted to elevate the said ice cream sandwich with its wrapper sheet thereon from a point below the said horizontal trackway to the said generally horizontal upper surface of the said horizontal trackway;

(d) feed roll means for supporting a roll of the said web of heat-sealable flexible coated wrapping material;

(e) web-advancing means for advancing the said web of the heat-sealable flexible coated wrapping material from the said feed roll means along a path below the said horizontal trackway toward the said upper or top surface of an ice cream sandwich disposed on the said elevator device;

(f) web-severing means in the path of movement of the said web for severing an individual wrapper sheet section of the said flexible coated wrapper material from the said web thereof and thereby forming an individual wrapper sheet for the said ice cream sandwich;

(g) means for operating and vertically reciprocating the said elevator device and for moving the said elevator device with an ice cream sandwich and its said wrapper sheet thereon upwardly toward the said horizontal trackway and thereby forming the said top panel over the said upper or top surface of the said ice cream sandwich;

(h) a horizontally reciprocable combination pusher and folding device slidably and reciprocably mounted on the said supporting frame at the input end of the said elevator device for slidably moving the said ice cream sandwich with its said wrapper sheet thereon off the said elevator device onto the said upper surface of the said horizontal trackway and for advancing a horizontal row of ice cream sandwiches with their wrapper sheets thereon along the upper surface of the said horizontal trackway from the said input end to the delivery end of the said horizontal trackway;

(i) operating means for reciprocably operating the said combination pusher and folding device in timed relationship with the vertical reciprocating movement of the said elevator device;

(j) first folding means including (1) first and second vertically extending generally parallel combination elevator guide wall and folding members cooperating with the said elevator device for downfolding the said side panels and the said bottom panels of the said wrapper sheet downwardly along the side walls of the ice cream sandwich as the ice cream sandwich is elevated by the said elevator device up to the upper surface of the said horizontal trackway;

(k) second folding means including the said elevator device, the said first and second combination elevator guide and folding members, and the said combination pusher and folding device for sequentially infolding the said first and second bottom panels under the bottom surface of the said ice cream sandwich as the ice cream sandwich is slidably moved off the said elevator device onto the said horizontal trackway by the said combination pusher and folding device;

(l) end panel folding means cooperating with the said combination pusher and folding device for infolding the said first end panels against the end walls of the said ice cream sandwich as the said ice cream is slidably moved off the said elevator device and onto the said upper surface of the said horizontal trackway by the said combination pusher and folding device and for infolding the said second end panels against the end walls of the said ice cream sandwich as the said ice cream sandiwch is moved off the said elevator device and along the said horizontal trackway by the said combination pusher and folding device;

(m) end-sealing panel folding means on the upper surface of the said horizontal trackway for folding the said bottom and top end-sealing panels one against the other and over the said bottom and top end panels as the ice cream sandwich is slidably moved over and along the upper surface of the said horizontal trackway by the said combination pusher and folding device; and (n) heat-sealing means disposed at a point along the said upper surface of the said horizontal trackway between the said end-sealing panel folding means and the said delivery end of the said horizontal trackway for heat-sealing the said top and bottom end-sealing panels together.

47. A wrapping machine as defined in claim 46 in which the said end-sealing panel folding means includes (a) bottom end-sealing panel folding means on the said horizontal trackway for infolding the said bottom end-sealing panels upwardly against the said end panels as the said ice cream sandwich is slidably moved over and along the upper surface of the said horizontal trackway by the said combination pusher and folding device; and (b) top end-sealing panel folding means on the said horizontal trackway between the said bottom end-sealing panel and the said heat-sealing means for downfolding the said top end-sealing panels against the said infolded and upfolded bottom end-sealing panels as the said ice cream sandwich is moved over and along the said horizontal trackway by the said combination pusher and folding device.

48. A wrapping machine as defined in claim 46 in which the said first end panels are the trailing end panels and the said second end panels are the leading end panels of the said wrapper sheet relative to the direction of movement of the ice cream sandwich over the upper surface of the said horizontal trackway from the input end toward the delivery end thereof, and in which the end panel folding means includes (a) movable folding shoe members carried by and movable with the said combination pusher and folding device and movable thereby into folding engagement with the said first and trailing end panels for infolding the said first and trailing end panels against the end walls of the said ice cream sandwich as the said ice cream sandwich is slidably moved off the said elevator device and onto the upper surface of the said horizontal trackway by the said combination pusher and folding device and for infolding the said second and leading end panels against the end walls of the said ice cream sandwich as the said ice cream sandwich is moved off the said elevator device and along the said horizontal trackway by the said combination pusher and folding device.

49. A wrapping machine as defined in claim 48 in which the said end panel folding means includes (a) stationary folding shoe members stationarily mounted on the said horizontal trackway and cooperating with the said movable folding shoe members for infolding the said second and leading end panels against the end walls of the said ice cream sandwich as the said ice cream sandwich is slidably moved along the upper surface of the said horizontal trackway by the said combination pusher and folding device and the said movable folding shoe members are moved into coacting folding relationship with the said stationary folding shoe members.

50. A wrapping machine for folding and wrapping a wrapper sheet of flexible heat-sealable coated wrapping material which includes a top panel; first and second bottom panels; first and second side panels; first and second end panels; and first and second end-sealing panels; about the top, bottom, sides and end walls of an ice cream sandwich, said wrapping machine comprising:

(a) a supporting frame;

(b) a generally horizontally extending trackway on the said supporting frame including
  (1) an input end;
  (2) a delivery end; and having
  (3) a generally horizontally extending upper surface extending from the said input end to the delivery end of the said trackway;

(c) elevator means arranged adjacent the said input end of the said generally horizontally extending trackway for sequentially elevating ice cream sandwiches each with a wrapper sheet thereon laid generally flat over and in coplanar relationship with the top surface of the said ice cream sandwich from a point below the said horizontal trackway up to the level of the said upper surface of the said trackway;

(d) the said elevator means including
  (1) an elevator head;
  (2) first folding means cooperating with the said elevator head for downfolding the said side and bottom panels of the said wrapper sheet in coplanar relationship downwardly along the sides of the ice cream sandwich as the ice cream sandwich with its wrapper sheet thereon is elevated by the said elevator head to the level of the said upper surface of the said horizontal trackway at the said input end thereof;

(e) means for cyclically reciprocating the said elevator means in a vertical plane;

(f) combination pusher and folding means for slidably and sequentially pushing the said ice cream sandwiches with their wrapper sheets thereon, and with the said side and bottom panels thereof downfolded in coplanar relationship, off the said elevator head onto the said upper surface of the said trackway at the said input end thereof;

(g) operating means for cyclically reciprocating the said combination pusher and folding means in a generally horizontal plane toward and away from the said elevator head;

(h) the said combination pusher and folding means including
  (1) second folding means cooperating with the said elevator head for infolding the said first bottom panel under the bottom surface of the said ice cream sandwich as the said ice cream sandwich is slidably pushed off the said elevator head onto the said upper surface of the said trackway by the said combination pusher and folding means;

(i) the said first folding means including
  (1) a folding member cooperatng with the said combination pusher and folding means and with the said elevator head for infolding the said second bottom panel under the bottom surface of the said ice cream sandwich as the ice cream sandwich with its wrapper sheet thereon is slidably pushed off the said elevator head onto the upper surface of the said trackway by the said combination pusher and folding means;

(j) the said wrapping machine including
  (1) stationary end panel folding shoe members stationarily mounted on the upper surface of the said trackway adjacent the said elevator head; and
  (2) movable folding shoe members carried by and movable with and by the said combination pusher and folding means into coacting folding relationship with the said first and stationary end panel folding shoe members on the said horizontal trackway for infolding the said first end panels against the said end walls of the said ice cream sandwich and for infolding the said second end panels against the said end walls of the said ice cream sandwich;

(k) first end-sealing panel folding means stationarily mounted on the said horizontal trackway for infolding the said first end-sealing panels against the said end panels of the said ice cream sandwich as the said ice cream sandwich is slidably pushed along the said trackway by the said end combination pusher and folding means;

(l) second end-sealing panel folding means stationarily mounted on the said trackway for infolding the said second end-sealing panels against the said first end-sealing panels as the said ice cream sandwich is slidably pushed along the said trackway past the said first end-sealing panel folding means by the coaction of the said combination pusher and folding means and the succeeding or following ice cream sandwiches; and (m) heat-sealing means on the said trackway between the said second end-sealing panel folding means and the said delivery end of the said trackway for heat-sealing the said first and second end-sealing panels together.

51. A wrapping machine as defined in claim 50 in which (a) the said combination pusher and folding means includes
  (1) a supporting member having
  (2) outer end portions; and in which (b) the said movable folding shoe members are mounted in upright position and in horizontally spaced relationship on and are rigidly attached to the said outer end portions of the said supporting member.

* * * * *